US012031314B2

(12) United States Patent
Bryant et al.

(10) Patent No.: US 12,031,314 B2
(45) Date of Patent: Jul. 9, 2024

(54) BUILDING PANELS

(71) Applicant: Megawall Pty Ltd, Highton (AU)

(72) Inventors: Jonathan Paul Bryant, Highton (AU); Simon Trevor Flannery, Highton (AU); Rudolf Willem Steinbusch, Highton (AU)

(73) Assignee: Megawall Australia Pty Ltd, Highton (AU)

( * ) Notice: Subject to any disclaimer, the term of this patent is extended or adjusted under 35 U.S.C. 154(b) by 0 days.

(21) Appl. No.: 17/273,987

(22) PCT Filed: Sep. 6, 2019

(86) PCT No.: PCT/AU2019/050967
§ 371 (c)(1),
(2) Date: Mar. 5, 2021

(87) PCT Pub. No.: WO2020/047617
PCT Pub. Date: Mar. 12, 2020

(65) Prior Publication Data

US 2021/0355672 A1 Nov. 18, 2021

(30) Foreign Application Priority Data

Sep. 6, 2018 (AU) ..... 2018903334

(51) Int. Cl.
*E04B 7/02* (2006.01)
*E04B 1/02* (2006.01)
(Continued)

(52) U.S. Cl.
CPC ..... *E04B 1/02* (2013.01); *E04B 1/40* (2013.01); *E04B 7/22* (2013.01); *E04C 2/296* (2013.01); *E04C 2/521* (2013.01)

(58) Field of Classification Search
CPC ..... E04B 1/40; E04C 2/521
(Continued)

(56) References Cited

U.S. PATENT DOCUMENTS 5,771,645 A 6/1998 Porter
6,412,243 B1 7/2002 Sutelan
(Continued)

FOREIGN PATENT DOCUMENTS

CA 2776267 A1 11/2013
CN 2149437 Y 12/1993
(Continued)

*Primary Examiner* — Basil S Katcheves
(74) *Attorney, Agent, or Firm* — Warner Norcross + Judd LLP

(57) ABSTRACT

There is disclosed a method of constructing a building, comprising installing: wall structure of the building, the wall structure comprising a panel having opposed skins and a core within which extends at least one cavity; and a ceiling structure of the building, such that the ceiling structure is adjacent the wall structure, and the wall structure bounds a space at a side of the space and the ceiling structure bounds the space at a top of the space, and such that: the space is sheltered and/or isolated from the elements; and/or lock-up is attained in respect of said space, the method further comprising: thereafter installing at least one service line through at least one said cavity of said panel and/or installing at least one service line which comprises at least one said cavity of that panel; and thereafter installing a roof structure of the building over the ceiling structure, wherein a connector is secured between the wall structure and the ceiling structure to form therebetween a connection which is such that the connector engages both the ceiling structure and at least one of the skins so as to direct, to the skin(s) engaged thereby, loading exerted by the ceiling structure, and wherein said at least one said cavity is accessed through said
(Continued)

connector and/or through said ceiling structure, to install the service line(s).

31 Claims, 25 Drawing Sheets

(51) Int. Cl.
*E04B 1/41* (2006.01)
*E04B 7/22* (2006.01)
*E04C 2/296* (2006.01)
*E04C 2/52* (2006.01)

(58) Field of Classification Search
USPC ..... 52/91.1
See application file for complete search history.

(56) References Cited

U.S. PATENT DOCUMENTS 9,145,679 B2 * 9/2015 Ahern ..... E04C 5/0627
9,163,396 B1 * 10/2015 Kersey, Jr. ..... E04B 1/40
9,428,901 B2 * 8/2016 Price ..... E04C 2/46
9,890,531 B2 * 2/2018 Liberman ..... E04B 2/42
2007/0163197 A1 7/2007 Payne et al.
2008/0295450 A1 12/2008 Yogev
2014/0000192 A1 1/2014 Cramb et al.
2014/0090768 A1 4/2014 Bauer et al.
2015/0191905 A1 * 7/2015 Pidcock ..... E04B 7/00 52/79.5
2015/0267405 A1 9/2015 Smed et al.
2016/0208489 A1 * 7/2016 Gibson ..... E04B 1/14
2016/0305123 A1 * 10/2016 Ljubicic Rubio ..... H01R 24/76
2017/0121976 A1 * 5/2017 Neumayr ..... E04C 2/324
2018/0073244 A1 * 3/2018 Conybeare ..... E04B 1/7612
2018/0073248 A1 * 3/2018 Derleth ..... E04B 5/48
2018/0100302 A1 * 4/2018 Olarte Michel ..... E04C 1/397

FOREIGN PATENT DOCUMENTS

CN 2632190 8/2004
EP 3098363 A1 3/2018
GB 2441603 A 3/2011

* cited by examiner

BUILDING PANELS

FIELD OF THE INVENTION

The present invention relates to interconnection of a panel and another component in a structure, such as a building. The invention has particular, though not exclusive, application to composite panels, including panels having substrate layer comprising a substrate throughout which are distributed interstices (such as a suitably rigid foam and/or aerated substrate) and which defines most of the thickness of the panel, and a polymeric covering over either or each side of the substrate layer. The invention has particular, though not exclusive, application to construction of a building using prefabricated panels, and to connection of panels in the building to other panels, including like panels, and/or to other components in the building. The invention has particular, though not exclusive, application to structural insulated panels (SIPs) and/or sandwich panels.

BACKGROUND

Panels of the kind to which the invention relates have become increasingly popular for building construction. There is an ongoing need in the art for improvements in relation to such panels and construction methods involving them.

SUMMARY OF THE INVENTION

A first aspect of the invention provides a method of forming a connection between a structural component and a panel, the panel comprising a substrate and a load-resistant covering over either or each side of the substrate, the method comprising securing a connector to the component and panel such that the connector engages at least one said covering and the component so as to direct, to the covering(s) engaged thereby, loading exerted by the component.

A second aspect of the present invention provides a panel comprising a substrate and a load-resistant covering over either or each side of the substrate.

A third aspect of the invention provides a connector for use in forming a connection between a structural component and a panel, the panel comprising a substrate and a load-resistant covering over either or each side of the substrate, the connector being securable to the component and panel such that it engages at least one said covering and the component so as to direct, to the covering(s) engaged thereby, loading exerted by the component.

In accordance with a preferred embodiment of the invention, the connector comprises respective portions arranged to engage the panel and the component, and securing the connector to or between the component and panel comprises effecting load-transmissive engagement between each of the panel and the component and the respective portion(s) arranged to engage it. Preferably, the portion(s) arranged to engage the panel comprise/s at least one portion arranged so as to engage at least one said covering.

In accordance with another preferred embodiment of the invention, the connector is integral with one of the panel and the component and securing the connector between the component and the panel consists of securing the connector to the other of the panel and the component. Preferably, said one of the panel and the component is said panel, whereby said other of the panel and the component is said component.

Alternatively, said one of the panel and the component is said component, whereby said other of the panel and the component is said panel.

In accordance with a preferred embodiment of the invention, the portion(s) arranged to engage the panel comprise/s at least one portion arranged to engage the substrate, whereby the loading directed to the covering(s) comprises loading exerted on the substrate by the component and transferred by the connector to the covering(s) engaged by said portion(s) arranged so as to engage the substrate.

In accordance with a preferred embodiment of the invention, effecting the engagement between at least one said covering and the respective portion(s) arranged to engage it/them comprises bringing the covering into abutment with the connector, such that that engagement is transmissive to loading tending to increase pressure of the abutment. The abutment may comprise abutment effected through contact between the covering and the respective portion(s). The abutment may comprise indirect abutment. The abutment may comprise abutment between an end face or edge of the covering and at least one said respective portion.

In accordance with a preferred embodiment of the invention, the connector comprises a plate or strip section one side of which is arranged to engage an end face of the panel comprising a surface defined by the substrate and the covering end face/edge(s), thus defining the portions arranged to engage the substrate and to abut the covering end face/edge(s), and the other side of which defines the portion(s) arranged to engage the component. The plate or strip section may be defined by a web portion of the connector.

In accordance with a preferred embodiment of the invention, effecting the load-transmissive engagement between the panel and portion(s) arranged to engage it comprises bonding said one side to said end face or said surface defined by said substrate, such that that engagement is transmissive to loading which subjects the bond(s) to tension and/or shear.

In accordance with a preferred embodiment of the invention, said bonding comprises applying adhesive between said one side and said end face or said surface defined by said substrate.

In accordance with a preferred embodiment of the invention, said one side is configured with a protuberance defining a said portion arranged to abut the covering end face/edge, such that defined between said one side and the substrate surface is a void, and applying the adhesive is such that the adhesive occupies the void so as to be retained between that side and the substrate surface.

In accordance with a preferred embodiment of the invention, said protuberance extends throughout a length of the connector.

In accordance with a preferred embodiment of the invention, said panel is a ceiling or roof panel and said component is a wall panel.

In accordance with a preferred embodiment of the invention, wherein said panel is a wall panel and said component is a ceiling or roof panel.

In accordance with a preferred embodiment of the invention, the connection defines a mitre joint between the panel and component.

In accordance with a preferred embodiment of the invention, said abutment comprises abutment between a side face of the covering and at least one said respective portion.

In accordance with a preferred embodiment of the invention, effecting the load-transmissive engagement between either or each of the panel and the component and the respective portion(s) arranged to engage it comprises bonding it to the respective portion(s), such that that engagement is transmissive to loading which subjects the bond(s) to tension and/or shear. Preferably, the bonding of either or each of the panel and component to the respective portion(s) comprises applying adhesive between panel/component and the respective portion(s). The bonding of either or each of the panel and component to the respective portion(s) may comprise fusing the panel/component and the respective portion(s) together. Fusing the panel/component and the respective portion(s) together may be effected by heat and/or chemical fusion.

In accordance with a preferred embodiment of the invention, at least one said covering and the portion(s) arranged to engage it are bonded together.

In accordance with a preferred embodiment of the invention, at least one said portion arranged to engage the substrate comprises a surface which is arranged to engage a corresponding surface defined by the substrate, and effecting the engagement between that portion and the substrate comprises bringing said surface of said portion into engagement with said corresponding surface.

In accordance with a preferred embodiment of the invention, bringing said surface of said portion into engagement with said corresponding surface comprises bringing the former into abutment with the latter, such that the engagement effected thereby transmissive to loading tending to increase pressure of that abutment.

In accordance with a preferred embodiment of the invention, bringing said surface of said portion into engagement with said corresponding surface comprises bonding said surface of said portion to said corresponding surface, such that the engagement effected thereby is transmissive to loading which subjects the bond(s) thus created to tension and/or shear.

In accordance with a preferred embodiment of the invention, the bonding of said surface of said portion to the said corresponding surface comprises applying adhesive between the former and the latter.

In accordance with a preferred embodiment of the invention, the bonding of said surface of said portion to said corresponding surface comprises fusing said surface of said portion and said corresponding surface together.

In accordance with a preferred embodiment of the invention, fusing said surface of said portion and said corresponding surface together is effected by heat and/or chemical fusion.

In accordance with a preferred embodiment of the invention, the connector comprises at least one cover portion arranged so as to overlie at least one face of the panel and/or component, whereby securing of the connector effects concealment of the face(s) by the cover portion(s).

In accordance with a preferred embodiment of the invention, the or each cover portion is arranged so as to extend throughout an entirety of a length of the face it is arranged to overlie.

In accordance with a preferred embodiment of the invention, the or each cover portion is arranged so as to extend throughout an entirety of a width of the face it is arranged to overlie.

In accordance with a preferred embodiment of the invention, the at least one cover portion comprises a cover portion arranged to overlie an end face of the panel whereby the securing of the connector to the panel effects concealment of the end face of the panel. The end face may comprise a face defined by the substrate.

In accordance with a preferred embodiment of the invention, the at least one cover portion comprises a cover portion arranged to overlie an end face of the component whereby the securing of the connector to the component effects concealment of the end face of the component.

In accordance with a preferred embodiment of the invention, the at least one cover portion comprises a cover portion arranged to overlie a face defined by a portion of a side surface of the panel whereby the securing of the connector to the panel effects concealment of that face.

In accordance with a preferred embodiment of the invention, the at least one cover portion comprises a cover portion arranged to overlie a face defined by a portion of a side surface of the component whereby the securing of the connector to the component effects concealment of that face.

In accordance with a preferred embodiment of the invention, the at least one cover portion is configured to define capping over the face(s) it overlies in the connection.

In accordance with a preferred embodiment of the invention, the at least one cover portion is configured to define a fascia over the face(s) it overlies in the connection.

In accordance with a preferred embodiment of the invention, securing of the connector comprises securing at least one said cover portion against and/or to the face it is arranged to overlie, that cover portion thus defining a respective one of said respective portions.

In accordance with a preferred embodiment of the invention, the connector comprises at least one flange portion, the or each flange portion defining a said portion of the connector arranged to engage a respective said covering and being arranged so as to extend parallel to that covering, and effecting the engagement between that portion of the connector and the covering comprises securing a side face of the flange portion against a side face of the covering parallel to which it extends. The connector may comprise a web portion from which the or each flange portion extends, the web portion being arranged so as to overlie an end face of the panel.

In accordance with a preferred embodiment of the invention, the web portion defines a said portion arranged to engage the substrate, and the method includes effecting the load-transmissive engagement between the web portion and the substrate.

In accordance with a preferred embodiment of the invention, the end face comprises a surface defined by said substrate.

In accordance with a preferred embodiment of the invention, said load-transmissive engagement between the web portion and the substrate is effected by bonding a face of the web portion to said surface defined by said substrate, the web portion and said face thereof thus respectively defining a said portion arranged to engage the substrate and a said surface of that portion, and said surface defined by said substrate is a said corresponding surface, whereby said engagement between the web portion and the substrate is transmissive to loading which subjects the bond(s) thus formed to tension and/or shear resulting from any one or more of bending, tensile, torsional and shear loading between the substrate and web portion. Bonding of said face of the web portion to the end face preferably comprises applying adhesive between said face of the web portion and the end face. Bonding of said face of the web portion to the end face may comprise fusing them together. Fusing said face of the web portion and the end face together may be effected by heat and/or chemical fusion.

In accordance with a preferred embodiment of the invention, the web portion is arranged to cover fully and/or conceal the end face.

In accordance with a preferred embodiment of the invention, the end face is defined by an edge of the panel whereby said connection is between the structural component and said edge.

In accordance with a preferred embodiment of the invention, one side of the web portion defines said portions arranged to engage the substrate and the covering end face/edge(s) and the other side of the web defines said portion(s) arranged to engage the component.

In accordance with a preferred embodiment of the invention, at least one said flange portion is arranged such that the said side face thereof is an outer side face thereof and the side face of the covering parallel to which that flange portion extends is an inner side face of that covering. The or each flange portion the side face of which is a said outer side face may be received in a slot between a surface defined by the substrate and the inner side face of the covering against which it is secured, the slot opening through the/an end face of the panel.

In accordance with a preferred embodiment of the invention, at least one said flange portion is arranged such that said side face thereof is an inner side face thereof and the side face of the covering parallel to which that flange portion extends is an outer side face of that covering.

In accordance with a preferred embodiment of the invention, the panel comprises a pair of said coverings each of which is over a respective one of said sides of the substrate, and the connector comprises a pair of said flange portions arranged to as to lie adjacent and/or against the respective covering parallel to which it extends.

In accordance with a preferred embodiment of the invention, the flange portions extend in the same direction from the web portion.

In accordance with a preferred embodiment of the invention, the or each said flange portion is inclined to a degree to which said panel is to be inclined when said connection has been formed.

In accordance with a preferred embodiment of the invention, said panel and the or each said flange portion are arranged to extend horizontally.

In accordance with a preferred embodiment of the invention, the connector includes at least one further flange portion arranged so as to overlie an end of the component to preclude ingress, to or towards the component, of water which runs down a said covering engaged by a said flange portion. The connector may comprise at least one flange, the or each flange defining respective said flange and further flange portions. The at least one said further flange portion may define a said cover portion.

In accordance with a preferred embodiment of the invention, the connector comprises at least one additional flange or web portion, defining a said portion arranged to engage the component, and securing the connector to the component comprises securing a side face of a said additional flange or web portion to or against a side face of the component.

In accordance with a preferred embodiment of the invention, said panel is a wall or ceiling panel, the component is a roof panel, and said side face of the component defines an underside of the roof panel.

In accordance with a preferred embodiment of the invention, at least one said additional flange portion is inclined relative to said flange portion(s), to an extent that the component is to be inclined when said connection is formed.

In accordance with a preferred embodiment of the invention, the connector comprises a bracing portion between a said flange portion and a said additional flange portion to transmit loading therebetween. The bracing portion may be defined by a web portion of the connector.

In accordance with a preferred embodiment of the invention, the panel comprises a roof panel and the component comprises a soffit connection bracket.

In accordance with a preferred embodiment of the invention, the connector comprises a pair of said additional flange portions arranged to receive said component therebetween and defining respective ones of said portions arranged to engage said component.

In accordance with a preferred embodiment of the invention, securing of the connector to the component comprises securing a face of at least one of the additional flange portions to the component.

In accordance with a preferred embodiment of the invention, at least one of said respective portions is configured with a spacer positioned to abut the panel or component which that portion is arranged to engage such that defined between that portion and the panel/component is a void, and applying the adhesive is such that the adhesive occupies the void so as to be retained between that portion and the panel/component. Preferably, the or each portion configured with a spacer is configured with a further spacer positioned to abut the panel or component which that portion is arranged to engage, the spacers with which that portion is configured being laterally spaced such that the void is bounded thereby. Preferably, the or each spacer is defined by a protuberance. Preferably, the or each spacer extends throughout a length of the connector.

Preferably, the panel comprises a said covering over each side of the substrate, whereby the substrate defines a core of the panel.

The connector may be formed from metal. The metal may comprise aluminium.

The connector may be plastically formed.

The connector may be cold formed.

The connector may be rolled.

The connector may be polymeric.

The connector may comprise a thermoplastic.

The connector may be made of fibre-reinforced glass or fibreglass.

The connector may be thermoformed.

The connector may be pultruded.

The connector may be moulded.

The connector may be extruded.

In accordance with one preferred embodiment of the invention, the connector is of unitary construction.

In accordance with another preferred embodiment of the invention, the connector comprises connector pieces.

Securing of the connector to the component and panel may comprise interconnecting said pieces.

Said pieces may comprise two pieces defining respective portions of said web portion and interconnecting said pieces comprises interconnecting said portions to form said web portion.

Said pieces may comprise interengageable connector portions. Interconnecting said pieces may comprise effecting interengagement of the connector portions.

Preferably, the connector portions extend throughout a length of the connector.

The connector portions may comprise tongue-and-groove connector portions.

The connector may be defined by a joiner.

The connector may be defined by a bracket.

The connector may be of substantially uniform cross-section along a longitudinal axis thereof.

In accordance with a preferred embodiment of the invention, the method includes applying a self-expanding compound within an empty gap between the panel and component, the compound thereafter expanding so as to occupy the gap in the connection.

Preferably, the compound comprises a foaming compound.

The compound may comprise self-expanding polyurethane foam.

The gap may be between ends or edges of the panel and component which are interconnected by the connection.

The empty gap may be a portion of a gap between the panel and component which is occupied by at least one said portion arranged to engage the panel and the component.

The compound may be one which when expanded bonds the panel and component.

The compound may be one which when expanded affords the connection strength.

The compound may be one which when expanded affords the connection acoustic and/or thermal insulation.

The compound may be one which when expanded affords the connection resistance to liquid/moisture ingress.

In accordance with a preferred embodiment of the invention, one of the panel and the component is a wall panel and the other of the panel and the component is a roof and/or ceiling panel, and the connector defines a top plate securing the wall panel to the roof and/or ceiling panel.

In accordance with a preferred embodiment of the invention, one of the panel and the component is a wall panel and the other of the panel and the component is a floor panel, and the connector defines a bottom plate securing the wall panel to the floor panel.

In accordance with a preferred embodiment of the invention, effecting the load-transmissive engagement between either or each of the panel and the component and the respective portion(s) arranged to engage it comprises interconnecting it and the portion(s) with at least one fastener, such that that engagement is transmissive to loading which subjects the fastener(s) to tension and/or shear.

In accordance with a preferred embodiment of the invention, effecting the load-transmissive engagement between the component and the respective portion(s) arranged to engage it comprises interconnecting it and the portion(s) with at least one fastener, such that that engagement is transmissive to loading which subjects the fastener(s) to tension and/or shear.

In accordance with a preferred embodiment of the invention, the panel is a wall panel and the component is a floor, slab or foundation structure arranged to support the wall panel thereover, whereby the connection is between a lower end of the panel and the floor, slab or foundation structure.

In accordance with a preferred embodiment of the invention, the connector defines a bottom plate securing the wall panel to the floor, slab or foundation structure.

In accordance with a preferred embodiment of the invention, the or each fastener comprises a through-fastener. The or each through-fastener preferably comprises a threaded fastener. The or each threaded fastener preferably comprises a screw or bolt.

In accordance with a preferred embodiment of the invention, the web portion defines a said portion arranged to engage the substrate.

In accordance with a preferred embodiment of the invention, the other component comprises a hinge.

In accordance with a preferred embodiment of the invention, the component comprises another panel.

The other panel may comprise a window panel.

In accordance with a preferred embodiment of the invention, the other panel comprises a substrate and a load-resistant covering over either or each side of the substrate, and securing of the connector to the other panel is such that the connector engages at least one said covering of said other panel, whereby said loading exerted by the component comprises loading exerted through the covering(s) of the other panel engaged by the connector.

In accordance with a preferred embodiment of the invention, the portion(s) arranged to engage the other panel comprise/s at least one portion arranged so as to engage at least one said covering of the other panel.

In accordance with a preferred embodiment of the invention, wherein the portion(s) arranged to engage the other panel comprise/s at least one portion arranged to engage the substrate of the other panel, whereby the loading exerted by the other panel comprises loading exerted by the substrate of the other panel.

In accordance with a preferred embodiment of the invention, effecting the engagement between at least one said covering of the other panel and the respective portion(s) arranged to engage it/them comprises bringing that/those covering/s into abutment with the connector, such that that engagement is transmissive to loading tending to increase pressure of that abutment.

In accordance with a preferred embodiment of the invention, said abutment comprises abutment effected through contact between the covering of the other panel and the respective portion(s).

In accordance with a preferred embodiment of the invention, said abutment between the covering of the other panel and the respective portion(s) comprises indirect abutment.

In accordance with a preferred embodiment of the invention, said abutment between the covering of the other panel and the respective portion(s) comprises abutment between an end face or edge of the covering of the other panel and at least one said respective portion.

In accordance with a preferred embodiment of the invention, the connector comprises a plate or strip section one side of which defines the portion(s) arranged to engage said panel and the other side of which is arranged to engage an end face of the other panel, comprising a surface defined by the substrate of the other panel and the covering end face/edge(s) of the other panel, thus defining the portions arranged to engage the substrate of the other panel and to abut the other panel covering end face/edge(s).

In accordance with a preferred embodiment of the invention, the plate or strip section is defined by a web portion of the connector.

In accordance with a preferred embodiment of the invention, effecting the load-transmissive engagement between the other panel and portion(s) arranged to engage it comprises bonding said other side to said end face or said surface defined by said substrate of the other panel, such that that engagement is transmissive to loading which subjects the bond(s) to tension and/or shear.

In accordance with a preferred embodiment of the invention, said bonding comprises applying adhesive between said other side and said end face or said surface defined by said substrate of the other panel.

In accordance with a preferred embodiment of the invention, one of said panel and said other panel is a ceiling or roof panel and the other of said panel and said other panel is a wall panel.

In accordance with a preferred embodiment of the invention, the connection defines a mitre joint between the panel and component.

In accordance with a preferred embodiment of the invention, effecting the load-transmissive engagement between the other panel and the portion(s) arranged to engage it comprises the bonding of the other panel to the portion(s).

In accordance with a preferred embodiment of the invention, the bonding of the other panel to the portion(s) comprises the applying of the adhesive between the other panel and the portion(s).

In accordance with a preferred embodiment of the invention, the bonding of the other panel to the portion(s) comprises the fusing of the other panel and the portion(s) together.

In accordance with a preferred embodiment of the invention, fusing the other panel and the portion(s) together is effected by said heat and/or chemical fusion.

In accordance with a preferred embodiment of the invention, securing of the connector to the other panel comprises bonding together at least one said covering of the other panel and the portion(s) arranged to engage it.

In accordance with a preferred embodiment of the invention, at least one said portion arranged to engage the substrate of the other panel comprises a surface which is arranged to engage a corresponding surface defined by the substrate of the other panel, and effecting the engagement between that portion and the substrate of the other panel comprises bringing said surface of said portion into engagement with said corresponding surface defined by the substrate of the other panel.

In accordance with a preferred embodiment of the invention, bringing said surface of said portion into engagement with said corresponding surface defined by the substrate of the other panel comprises bringing the former into abutment with the latter, such that the engagement effected thereby transmissive to loading tending to increase pressure of that abutment.

In accordance with a preferred embodiment of the invention, bringing said surface of said portion into engagement with said corresponding surface defined by the substrate of the other panel comprises bonding said surface of said portion to that corresponding surface, such that the engagement effected thereby is transmissive to loading which subjects the bond(s) thus created to tension and/or shear.

In accordance with a preferred embodiment of the invention, the bonding of said surface of said portion to the said corresponding surface defined by the substrate of the other panel comprises applying adhesive between the former and the latter.

In accordance with a preferred embodiment of the invention, the bonding of said surface of said portion to said corresponding surface defined by the substrate of the other panel comprises fusing the former and latter surfaces together. Fusing said surface of said portion and said corresponding surface defined by the substrate of the other panel together may be effected by heat and/or chemical fusion.

In accordance with a preferred embodiment of the invention, at least one said cover portion is arranged so as to overlie at least one said face of the other panel, whereby securing of the connector effects concealment of the face(s) of the other panel by the cover portion(s) arranged to overlie said face(s).

In accordance with a preferred embodiment of the invention, at least one said cover portion arranged so as to overlie at least one said face of the other panel comprises a cover portion arranged to overlie an end face of the other panel whereby the securing of the connector to the other panel effects concealment of the end face of the other panel.

In accordance with a preferred embodiment of the invention, the end face of the other panel comprises a face defined by the substrate of the other panel.

In accordance with a preferred embodiment of the invention, at least one said cover portion arranged so as to overlie at least one said face of the other panel comprises a cover portion arranged to overlie a face defined by a portion of a side surface of the other panel whereby the securing of the connector to the other panel effects concealment of that face.

In accordance with a preferred embodiment of the invention, securing of the connector comprises securing at least one said cover portion arranged to overlie at least one said face of the other panel against and/or to that face, that cover portion thus defining a respective one of said portions of the connector.

In accordance with a preferred embodiment of the invention, the connector comprises at least one flange portion defining a portion of the connector arranged to engage a side-facing surface of the other panel ("other flange portion") and being arranged so as to extend parallel to that side-facing surface, and securing the connector to the other panel comprises securing a side face of the or each other flange portion against the side-facing surface which it is arranged to engage.

In accordance with a preferred embodiment of the invention, the connector comprises a web portion from which the or each other flange portion extends, the web portion being arranged so as to overlie an end face of the other panel.

In accordance with a preferred embodiment of the invention, the web portion defines a said portion arranged to engage the substrate of the other panel.

In accordance with a preferred embodiment of the invention, the end face of the other panel comprises a surface defined by the substrate of the other panel.

In accordance with a preferred embodiment of the invention, securing of the connector to the other panel comprises bonding a face of the web portion to said surface defined by said substrate of said other panel, the web portion and said face thereof thus respectively defining a said portion arranged to engage the substrate of the other panel and a said surface of that portion, and said surface defined by the substrate of the other panel is a said corresponding surface, whereby said engagement between the web portion and the substrate of the other panel is transmissive to loading which subjects the bond(s) thus formed to tension and/or shear resulting from any one or more of bending, tensile, torsional and shear loading between the substrate of the other panel and the web portion.

In accordance with a preferred embodiment of the invention, bonding of said face of the web portion to the end face of the other panel comprises applying adhesive between said face of the web portion and the end face of the other panel.

In accordance with a preferred embodiment of the invention, bonding of said face of the web portion to the end face of the other panel comprises fusing together said face of the web portion and the end face of the other panel. The fusing together of said face of the web portion and the end face of the other panel may be effected by heat and/or chemical fusion.

In accordance with a preferred embodiment of the invention, the web portion is arranged to cover fully and/or conceal the end face of the other panel.

In accordance with a preferred embodiment of the invention, the end face of the other panel is defined by an edge of the other panel whereby said connection is between said panel and said edge of the other panel.

In accordance with a preferred embodiment of the invention, a side of the web portion defines the portions arranged to engage the other panel substrate and other panel covering end face/edge(s).

In accordance with a preferred embodiment of the invention, the or each side-facing surface is a side face of a said covering of the other panel.

In accordance with a preferred embodiment of the invention, at least one said other flange portion is arranged such that the said side face thereof is an outer side face thereof and the side face of the covering is an inner side face of that covering.

In accordance with a preferred embodiment of the invention, the or each other flange portion the side face of which is a said outer side face is received in a slot between a surface defined by the substrate of the other panel and the inner side face of the covering of the other panel against which covering it is secured, the slot opening through the/an end face of the other panel.

In accordance with a preferred embodiment of the invention, at least one said other flange portion is arranged such that said side face thereof is an inner side face thereof and the side-facing surface of the other panel which it is arranged to engage is an outer side face of the other panel.

In accordance with a preferred embodiment of the invention, said outer side face of said other panel is an outer side face of a said covering of said other panel.

In accordance with a preferred embodiment of the invention, the other panel comprises a pair of said coverings each of which is over a respective one of said sides of the substrate of the other panel, and the connector comprises a pair of said other flange portions arranged to as to lie adjacent and/or against the respective covering side face parallel to which it extends.

In accordance with a preferred embodiment of the invention, the connector comprises a pair of said other flange portions arranged to as to lie adjacent and/or against the respective side-facing surface parallel to which it extends.

In accordance with a preferred embodiment of the invention, the other flange portions extend in the same direction from the web portion.

In accordance with a preferred embodiment of the invention, the other panel comprises a said covering over each side of the substrate thereof, whereby that substrate defines a core of the other panel.

In accordance with a preferred embodiment of the invention, the or each covering defines a skin of the other panel.

In accordance with a preferred embodiment of the invention, the web portion from which the or each flange portion extends is the web portion from which the or each other flange portion extends.

In accordance with a preferred embodiment of the invention, the panels are arranged such that the end faces thereof are in opposed relation and the flange and other flange portions project bilaterally from the web portion(s) so as to engage the covering(s) of said panel and side-facing surface(s) of the other panel respectively.

In accordance with a preferred embodiment of the invention, the flange and other flange portions consist of the flange portion and the other flange portion.

In accordance with a preferred embodiment of the invention, the flange and other flange portions comprise one of said flange portions and one of said other flange portions extending bilaterally—each from one end or edge of the web portion/respective web portion, and the other of said flange portions and the other of said other flange portions extending bilaterally—each from the other end or edge of the web portion/respective web portion.

In accordance with a preferred embodiment of the invention, the flange and other flange portions project in opposite directions whereby sides of the panel and other panel between which the connection is formed are parallel.

In accordance with a preferred embodiment of the invention, the or each said flange portion and the respective said other flange portion project such that there is an included angle therebetween.

In accordance with a preferred embodiment of the invention, the flange and other flange portions comprise a said flange portion and a said other flange portion projecting from an upper end of the web portion/respective web portion.

In accordance with a preferred embodiment of the invention, the flange portion and other flange portion projecting from said upper end are downwardly divergent, and wherein the panels are roof panels defining a ridge, whereby the downwardly divergent flange portions define a ridge cap of the roof.

In accordance with a preferred embodiment of the invention, the flange portion and other flange portion projecting from said upper end are upwardly divergent, and the panels are roof panels defining a valley, whereby the downwardly divergent flange portions define a valley gutter of the roof.

In accordance with a preferred embodiment of the invention, the panels define side-by-side ceiling, roof or floor panels.

In accordance with a preferred embodiment of the invention, the panels define a lower panel and upper panel.

In accordance with a preferred embodiment of the invention, the lower panel defines a wall panel.

In accordance with a preferred embodiment of the invention, the upper panel defines a gable panel.

In accordance with a preferred embodiment of the invention, the or each covering of the, either or each panel defines a skin.

In accordance with a preferred embodiment of the invention, the substrate of the, either or each panel is porous and/or includes interstices distributed therethroughout.

In accordance with a preferred embodiment of the invention, the substrate of the, either or each panel is of aerated form.

In accordance with a preferred embodiment of the invention, the substrate of the, either or each panel comprises a foam. The foam may comprise a rigid foam.

Preferably, the foam comprises polystyrene foam. Preferably, the polystyrene foam comprises extruded polystyrene foam. The polystyrene foam may alternatively or additionally comprise expanded polystyrene foam may instead comprise, for example, any one or more of: polyethylene, polyurethane, polyethylene terephthalate, polypropylene, polyvinylchloride and polycarbonate.

In accordance with a preferred embodiment of the invention, the substrate of the, either or each panel is defined by a honeycomb structure.

In accordance with a preferred embodiment of the invention, the or each covering of the, either or each panel is polymeric.

In accordance with a preferred embodiment of the invention, the or each covering of the, either or each panel is fibre-reinforced.

Preferably, the or each covering of the, either or each panel comprises polymeric material.

In accordance with a preferred embodiment of the invention, the or each covering of the, either or each panel comprises thermoset polymer material. In accordance with a preferred embodiment of the invention, the or each covering of the, either or each panel comprises resin. Preferably, the resin comprises polyester resin. The resin may, alternatively or additionally, comprise any one or more of epoxy resin, melamine formaldehyde resin, urea formaldehyde resin, vinyl ester resin, phenolic resin, polyurethane resin, cyanate ester resin, polyimide resin, maleimide resin.

In accordance with a preferred embodiment of the invention, the or each covering of the, either or each panel is reinforced. That covering may include reinforcement or reinforcing material comprising, for example, any one or more of ceramic, clay, metal, metal oxide, metal carbide, glass, quartz, basalt, carbon, graphite, boron, boron nitride and plant matter. The reinforcement or reinforcing material may comprise, for example, any one of, or combination from: particles, fibres, woven material, non-woven material and fabric.

In accordance with a preferred embodiment of the invention, the or each covering of the, either or each panel is fibre-reinforced glass or fibreglass.

In accordance with a preferred embodiment of the invention, the, either or each panel is a fibre-composite panel.

A fourth aspect of the present invention provides the connection formed by a method as defined above.

A fifth aspect of the invention provides a connector for use as the connector in a method or connection as defined above.

A sixth aspect of the invention provides an assembly comprising said panel and the connector of the third or fifth aspect secured thereto, wherein the connector is securable to said component such that said connection of the fourth aspect is formed.

A seventh aspect of the invention provides an assembly comprising said component and the connector of the third or fifth aspect secured thereto, wherein the connector is securable to said panel such that said connection of the fourth aspect is formed.

An eighth aspect of the present invention provides an assembly comprising the connector and said panel, wherein the connector is secured to the panel and securable to said component such that said connection can be formed.

A ninth aspect of the present invention provides an assembly comprising the connector and said component, wherein the connector is securable to said panel such that said connection can be formed.

The loading may comprise, for example, any one or more of dead loads, live loads, wind loads, snow loads, earthquake loads, thermal loads and settlement loads.

A tenth aspect of the present invention provides a method of manufacturing a panel, the method comprising arranging substrate sections end-to-end whereby an edge of one section and an edge of another are in abutting relation, either or each of the edges, in a thus formed pair of abutting edges, being configured with a channel which opens laterally outwardly and extends therealong, such that a cavity is defined by the channel(s), the method including securing opposite sides of each substrate section to a respective sheet section, whereby the panel comprises opposed skins, each comprising a respective one of the sheet sections, and a core, comprising the end-to-end arranged substrate sections, and either or each of fluid and power is suppliable through the panel via the or each cavity.

An alternative tenth aspect of the present invention provides a method of manufacturing a panel, the method comprising arranging substrate sections one-adjacent-another in abutting relation, either or each of the sections being configured with a channel which extends therealong and opens towards a said section adjacent to which it is arranged, such that a cavity is defined by the channel(s), the method including securing opposite sides of the substrate sections to respective sheet sections, whereby the panel comprises opposed skins, each comprising a respective one of the sheet sections, and a core, comprising the substrate sections, and either or each of fluid and power is suppliable through the panel via the or each cavity.

Preferably, each skin defines a respective said load-resistant covering and the core defines said substrate.

Preferably, securing of the opposite sides of each section to the respective sheet section comprising bonding/and or fusing the opposite sides to that sheet section.

Preferably, arranging the substrate sections end-to-end comprises laying each of them over one sheet section, the other sheet section is thereafter laid over the laid substrate sections, and each of said laid substrate sections is secured to said one sheet and to the other sheet section laid thereover.

Preferably, applying bonding agent to said one sheet section, such that one side of each substrate section contacts the bonding agent upon that substrate section being laid over said one sheet section, and applying bonding agent to the other side of each of the substrate sections such that said other sheet section contacts that bonding agent upon being laid over the laid substrate sections, securing of the sheet sections to the substrate sections comprising bonding via the bonding agent applied to said one sheet and the bonding agent applied to said other sides of the substrate sections.

The bonding agent may comprise adhesive.

The bonding agent may comprise resin.

Preferably, said one sheet section lies substantially flat while the substrate sections are laid thereover.

Preferably, said laid substrate sections lie substantially flat while said other sheet section is laid thereover.

Preferably, said one sheet is supported on a press while the substrate sections are laid thereover and while said other sheet section is laid over the laid substrate sections, and securing of the opposite sides of the substrate sections to the sheet sections comprises operating the press to clamp each sheet section against the substrate sections.

Preferably, either or each side of each of the substrate sections and/or a side of the respective sheet section which received is against that side is configured with grooves such that excess bonding agent flows into and along at least one of the grooves.

Preferably, each groove extends to an edge of the section the side of which is configured therewith, such that excess bonding agent escapes from between the sheet sections.

Preferably, said press is a vacuum press and operation of the press includes applying a vacuum to the clamped sheet sections to draw excess bonding agent along each of ones of the grooves to the edge to which it extends.

Preferably, the number of substrate sections exceeds two, whereby there are plural said pairs of abutting edges and the end-to-end arranged sections comprise laterally outer sections and at least one intermediate section therebetween, laterally outer edges of the intermediate section(s) and respective laterally inner edges of the laterally outer sections being in abutting relation.

In one embodiment of the invention, the number of substrate sections is three, whereby there are two said pairs of abutting edges and the end-to-end arranged sections comprise laterally outer sections and one said intermediate section therebetween, laterally outer edges of the intermediate section and respective laterally inner edges of the laterally outer sections being in abutting relation.

In another embodiment of the invention, the number of substrate sections is four, whereby there are three said pairs of abutting edges and the end-to-end arranged sections comprise laterally outer sections and two said intermediate sections therebetween, laterally inner edges of the intermediate section being in abutment.

In an embodiment of the invention, each of the edges is configured with a said channel.

Preferably, the or each channel is concave in cross-section.

Preferably, the or each channel is semi-circular in cross-section.

Preferably, the method includes forming the or each channel in a face defined by the edge to be configured therewith.

The forming of the or each channel may comprise machining the edge. Machining the edge may comprise routing the edge.

The forming of the or each channel may comprise thermoforming the channel in the edge.

The forming of the or each channel may comprise thermopressing the edge.

The forming of the or each channel may comprise pressing a hot object against the edge so as to cause melting and/or softening of the material at the edge, thereby impressing the channel into the edge.

Preferably, the hot object is elongate and arranged to extend along the edge when pressed thereagainst.

Preferably, the hot object is maintained axially stationary relative to the edge when pressed thereagainst.

Preferably, the hot object comprises a rod.

In an embodiment of the invention, the method includes forming said substrate sections.

Preferably, forming said substrate sections comprises separating a substrate sheet into said sections.

Preferably, forming said substrate sections comprises cutting a substrate sheet to form said sections.

In one embodiment of the invention, the method includes arranging at least one conduit member between the edges of at least one said pair such that extending along the cavity defined by the channel(s) with which either/each of those edges is formed is a conduit through which the fluid and/or power is suppliable.

The or each conduit member may be arranged between the edges which are to form at least one said pair is so arranged prior to the end-to-end arranging of the substrate sections defining the pair. Alternatively, arranging the or each conduit member between the edges of at least one said pair may comprise feeding said conduit member(s) into the cavity/ies defined by the channel(s) with which either/each of those edges of that pair is formed.

Preferably, the or each conduit member is tubular.

Preferably, the or each conduit member is cylindrical.

Preferably, the conduit member(s) is/are configured such that the or each conduit is tubular.

Preferably, the conduit member(s) is/are configured such that the or each conduit is cylindrical.

Preferably, the conduit member(s) is/are arranged such that the or each conduit forms a close fit within the cavity and/or forms a casing against an interior face of the cavity.

The conduit members may comprise at least one pair of conduit members which are arranged side-by-side such that laterally opening adjacent sides of the conduit members mate whereby the conduit is defined.

In the method according to a preferred embodiment of the invention, at least one external opening into the, each or at least one said cavity is formed. Preferably, the at least one external opening comprises spaced apart openings.

Preferably, the at least one said external opening comprises an opening defined by an open end of the cavity.

Preferably, the at least one said external opening comprises openings defined by respective open ends of the cavity.

Preferably, the at least one said external opening comprises an opening through a side of the panel.

Preferably, the at least one said external opening comprises spaced apart openings through a side of the panel.

Preferably, the or each opening through a side of the panel is formed by machining. Preferably, the machining comprises drilling.

An eleventh aspect of the present invention provides a panel comprising opposed skins and a core within which extends at least one cavity via which either or each of fluid and power is suppliable through the panel.

Preferably, at least one said cavity extends through an edge of the panel. Preferably, at least one said cavity which extends through an edge of the panel additionally extends through another edge of the panel, the other edge being opposite to said edge.

Preferably, said panel is the panel formed by a method according to the tenth aspect, the or each cavity extending within the core being a said cavity defined by said channel(s).

Preferably, the or each cavity extends axially and/or substantially perpendicular to an axis normal to the panel.

A twelfth aspect of the present invention provides a building services installation method, comprising:

installing at least one service line through at least one said cavity of a panel according to the eleventh aspect or manufactured by the method according to the tenth aspect; and/or installing at least one service line which comprises at least one said cavity of that panel.

Preferably, the panel is in situ.

A thirteenth aspect of the present invention provides a method of constructing a building, comprising installing a wall structure of the building and a ceiling structure, floor structure or other wall structure of the building adjacent to said wall structure, wherein one of said structures comprises a panel according to the eleventh aspect, the method further comprising:

installing at least one service line through at least one said cavity of the panel; and/or installing at least one service line which comprises at least one said cavity of that panel.

Preferably, the method includes accessing, through the other of said structures, said at least one said cavity to install said at least one service line.

Preferably, the method includes forming a connection between the wall structure and the structure adjacent to said wall structure by a method according to the first aspect, whereby the panel which said one of said structures comprises is said panel comprising a substrate and a load-resistant covering over each side of the substrate, and the other of said structures comprises said structural component, such that said connector is secured to the panel which said one of said structures comprises, and to said other of said structures.

In an embodiment of the invention, the structure adjacent to said wall structure is said other wall structure.

In an embodiment of the invention, the structure adjacent to said wall structure is said floor structure.

In an embodiment of the invention, the panel which said one of said structures comprises is said wall panel, and the other of said structures comprises said floor panel, and the method includes forming a connection between the wall structure and the floor structure such said connector is secured to said panel which said one of said structures comprises and to said other of said structures, and the bottom plate defined by the connector secures the wall structure to the floor structure.

In a preferred embodiment of the invention, the structure adjacent to said wall structure is said ceiling structure. Preferably, the method includes forming a connection between the wall structure and the ceiling structure, forming of the connection comprising securing a connector between the wall structure and ceiling structure.

Preferably, the panel which said one of said structures comprises is said wall panel, and the other of said structures comprises said ceiling panel, whereby said connector is secured to said panel which said one of said structures comprises and to said other of said structures.

Preferably, said at least one said cavity is accessed through said connector secured between the wall structure and ceiling structure, and/or is accessed through said ceiling structure, to install the service line(s).

Preferably, at least one opening is formed through said connector and/or through said ceiling structure, and the access to said at least one said cavity is through at least one said opening.

At least one opening through said connector and/or at least one said opening through said ceiling structure may be preformed. Alternatively, the forming of at least one opening through said connector may be after the securing of the connector between the wall structure and ceiling structure, or after the securing of the connector to either or each of the wall structure and ceiling structure.

In a preferred embodiment of the invention, the wall structure comprises said wall panel and the ceiling structure comprises said ceiling panel, whereby the top plate defined by the connector secures the wall structure to the ceiling structure.

Preferably, said one of said structures is said wall structure.

Preferably, the other of said structures comprises a panel. Preferably, that panel has a core and opposed skins.

Preferably, the method further comprises, subsequent to the installation of said service line(s), installing a roof structure of the building over the ceiling structure.

Preferably, the method includes forming a connection between the wall structure and the roof structure. Preferably, the connection between the wall structure and the roof structure is formed by a method according to the first aspect, the wall structure comprising said wall panel and the roof structure comprising said roof panel.

The method according to a preferred embodiment of the invention includes forming a connection between the ceiling structure and the roof structure, forming of the connection comprising securing a connector between the ceiling structure and the roof structure. Preferably, the forming of the connection between the ceiling structure and the roof structure comprises securing the connector to the ceiling structure and thereafter securing the connector to the roof structure, and, after the securing of the connector to the ceiling structure and before the securing the connector to the roof structure, said at least one said cavity is accessed through said connector, and/or through said ceiling structure, to install the service line(s).

Preferably, at least one opening is formed through said connector, and/or is formed through said ceiling structure, and the access to said at least one said cavity is through at least one said opening.

In a preferred embodiment of the invention, at least one said skin of at least one said panel is, or is to be, exterior and visibly exposed in the building/assembly, and the exposed surface of that skin provides a "rendered" and/or "cladded" and/or "coated" appearance. Preferably, that exposed surface is grainy or sandpaper-like, providing said rendered appearance. Alternatively, it may, for example, appear as timber, providing said cladded appearance. For example, the panel of which that skin forms a part may define or forms part of an exterior wall of the building/assembly, or define or form part of a roof of the building/assembly, or define or form part of a floor of the building/assembly.

In a preferred embodiment of the invention, at least one said skin of at least one said panel is, or is to be, interior and visibly exposed in the building/assembly, and the exposed surface of that skin provides a "plastered" and/or "coated" and/or "cladded" appearance. Preferably, the exposed surface resembles plaster. For example, the panel of which that skin forms a part defines or forms part of a wall (interior or exterior) of the building/assembly which bounds (at either or each side thereof) an occupiable interior space or living area, or defines or forms part of a ceiling of the building/assembly.

The at least one opening may be preformed.

The at least one opening may be formed after the securing of the connector to the ceiling structure.

Preferably, the wall structure comprises said wall panel and the roof structure comprises said roof panel.

Preferably, the wall structure and structure adjacent thereto are installed such that a space bounded by those structures and defining an interior space in the building is sheltered and/or isolated from the elements during installation of the roof structure.

Preferably, the wall structure and structure adjacent thereto are installed such that the wall structure bounds a space at a side thereof and the ceiling structure, floor structure or other wall structure bounds the space at a top, bottom or other side, respectively, thereof, said space defining an interior space in the building.

Preferably, the wall structure and structure adjacent thereto are installed such that the wall structure/assembly which bounds (at either or each side thereof) an occupiable interior space or living area, or defines or forms part of a ceiling of the building/assembly.

Preferably, the wall structure and structure adjacent thereto are installed such that the space or interior space is sheltered and/or isolated from the elements.

Preferably, the method includes attaining lock-up in respect of said space, interior space or building prior to installation of the services.

Preferably, installing of the service line(s) comprises installation of either or each of:

at least one electrical wire or cable; and at least one gas or liquid conduit, whereby the at least one line comprises said cable(s) and/or said conduit may comprise, for example, hose or pipe.

Preferably, installation of the service line(s) comprises drawing, training and/or feeding at least one said line along the cavity.

Preferably, installation of the service line(s) comprises connecting a line and/or fitting to either or each of opposed ends of at least one said cavity.

Preferably, at least one said service line is for delivering power to and/or from said interior space and/or at least one said service line is for delivering liquid and/or gas to and/or from said interior space.

Preferably, at least one said service line is to deliver power to and/or from said interior space, and/or at least one said service line is to deliver liquid and/or gas to and/or from said interior space.

Preferably, at least one external opening into the, each or at least one said cavity is formed, and the installing of the, each or at least one said service line is such that a service to be provided thereby is provided through at least one said opening into the cavity.

Preferably, at least one external opening into the, each or at least one said cavity is formed, and said installing comprises installing, at least one said opening into a said cavity through which a said service is to be provided, a component for utilisation of the service.

A said component may comprise, for example, any one or more of: a switch; a socket; a controller or adjustor; a tap; a fitting; a plug; a vent; and a connector.

Preferably, installing of the, each or at least one said service line is such that that service line passes through a said opening.

Preferably, the at least one external opening into the, each or at least one said cavity comprises spaced apart openings.

Preferably, the at least one external opening into the, each or at least one said cavity comprises an opening defined by an open end of the cavity.

Preferably, the at least one said external opening into the, each or at least one said cavity comprises openings defined by respective open ends of the cavity.

Preferably, the at least one said external opening into the, each or at least one said cavity comprises an opening through a side of the panel.

The at least one said external opening into the, each or at least one said cavity may comprise spaced apart openings, each being through a side of the panel. Those spaced apart openings may comprise openings through the same side of the panel. Alternatively or additionally, those spaced apart openings may comprise at least one opening through one side of the panel and at least one opening through the opposite side of the panel.

Preferably, the, each or at least one said opening through a side of the panel is machined through that side.

Preferably, the, each or at least one said opening which is machined through said side is drilled through that side.

A fourteenth aspect of the present invention provides a building constructed, and/or in which said service(s) is/are installed, by a method according to the twelfth or thirteenth aspect.

A fifteenth aspect of the present invention provides a prefabricated panel, for formation of a building panel configured with at least one penetration, the prefabricated panel being configured with at least one cutout defining one or more portions of the prefabricated panel which is/are removable such that one or more penetration(s) is/are formed.

Preferably, the cutout(s) is/are such that the/each removable portion is removable by exertion of a force thereagainst. Preferably, the or each removable portion is a pop-out portion.

Preferably, the prefabricated panel is a said panel as defined above or is such that said building panel configured with at least one penetration is a said panel as defined above.

Preferably, the cutout(s) is/are formed such that the or each portion is interconnected with the building panel via at least one bridging portion which is any one or more of frangible, breakable, cuttable and penetrable such that the removal of that removable portion is permitted. Alternatively or additionally, the cutout(s) may be formed such that friction and/or an interference fit between said panel configured with at least one penetration and the, each or at least one said removable portion holds the latter to the former.

In a preferred embodiment of the invention, the cutout(s) is/are such that the one or more penetrations are any one or more of:

a door penetration;

a window penetration; and a fitting penetration.

A preferred aspect of the present invention provides a method of constructing a building, comprising installing:

a wall structure of the building, the wall structure comprising a panel having opposed skins and a core within which extends at least one cavity; and a ceiling structure of the building, such that the ceiling structure is adjacent the wall structure, and the wall structure bounds a space at a side of the space and the ceiling structure bounds the space at a top of the space, and such that:

the space is sheltered and/or isolated from the elements; and/or lock-up is attained in respect of said space, the method further comprising:

thereafter installing at least one service line through at least one said cavity of said panel and/or installing at least one service line which comprises at least one said cavity of that panel; and thereafter installing a roof structure of the building over the ceiling structure, wherein a connector is secured between the wall structure and the ceiling structure to form therebetween a connection which is such that the connector engages both the ceiling structure and at least one of the skins so as to direct, to the skin(s) engaged thereby, loading exerted by the ceiling structure, and wherein said at least one said cavity is accessed through said connector and/or through said ceiling structure, to install the service line(s).

The invention can be defined by any one of the following numbered statements:

1. A method of forming a connection between a structural component and a panel, the panel comprising a substrate and a load-resistant covering over either or each side of the substrate, the method comprising securing a connector to or between the component and panel such that the connector engages at least one said covering and the component so as to direct, to the covering(s) engaged thereby, loading exerted by the component.

2. A method according to statement 1, wherein the connector comprises respective portions arranged to engage the panel and the component, and securing the connector to or between the component and panel comprises effecting load-transmissive engagement between each of the panel and the component and the respective portion(s) arranged to engage it.

3. A method according to statement 2, wherein the portion(s) arranged to engage the panel comprise/s at least one portion arranged so as to engage at least one said covering.

4. A method according to statement 2 or 3, wherein the portion(s) arranged to engage the panel comprise/s at least one portion arranged to engage the substrate, whereby the loading directed to the covering(s) comprises loading exerted on the substrate by the component and transferred by the connector to the covering(s) engaged by said portion(s) arranged so as to engage the substrate.

5. A method according to statement 3 or statement 4 as appended thereto, wherein effecting the engagement between at least one said covering and the respective portion(s) arranged to engage it/them comprises bringing the covering into abutment with the connector, such that that engagement is transmissive to loading tending to increase pressure of the abutment.

6. A method according to statement 5, wherein said abutment comprises abutment effected through contact between the covering and the respective portion(s).

7. A method according to statement 5 or 6, wherein said abutment comprises indirect abutment.

8. A method according to any one of statements 5 to 7, wherein said abutment comprises abutment between an end face or edge of the covering and at least one said respective portion.

9. A method according to statements 3 and 8, wherein the connector comprises a plate or strip section one side of which is arranged to engage an end face of the panel comprising a surface defined by the substrate and the covering end face/edge(s), thus defining the portions arranged to engage the substrate and to abut the covering end face/edge(s), and the other side of which defines the portion(s) arranged to engage the component.

10. A method according to statement 9, wherein the plate or strip section is defined by a web portion of the connector.

11. A method according to statement 9 or 10, wherein effecting the load-transmissive engagement between the panel and portion(s) arranged to engage it comprises bonding said one side to said end face or said surface defined by said substrate, such that that engagement is transmissive to loading which subjects the bond(s) to tension and/or shear.

12. A method according to statement 11, wherein said bonding comprises applying adhesive between said one side and said end face or said surface defined by said substrate.

13. A method according to statement 12, wherein said one side is configured with a protuberance defining a said portion arranged to abut the covering end face/edge, such that defined between said one side and the substrate surface is a void, and wherein applying the adhesive is such that the adhesive occupies the void so as to be retained between that side and the substrate surface.

14. A method according to statement 13, wherein said protuberance extends throughout a length of the connector.

15. A method according to any one of statements 9 to 14, wherein said panel is a ceiling or roof panel and said component is a wall panel.

16. A method according to any one of statements 9 to 14, wherein said panel is a wall panel and said component is a ceiling or roof panel.

17. A method according to any one of statements 9 to 16, being such that the connection defines a mitre joint between the panel and component.

18. A method according to any one of statements 5 to 17, wherein said abutment comprises abutment between a side face of the covering and at least one said respective portion.

19. A method according to any one of statements 2 to 18, wherein effecting the load-transmissive engagement between either or each of the panel and the component and the respective portion(s) arranged to engage it comprises bonding it to the respective portion(s), such that that engagement is transmissive to loading which subjects the bond(s) to tension and/or shear.

20. A method according to statement 19 wherein the bonding of either or each of the panel and component to the respective portion(s) comprises applying adhesive between panel/component and the respective portion(s).

21. A method according to statement 19 or 20, wherein the bonding of either or each of the panel and component to the respective portion(s) comprises fusing the panel/component and the respective portion(s) together.

22. A method according to statement 21, wherein fusing the panel/component and the respective portion(s) together is effected by heat and/or chemical fusion.

23. A method according to statement 3 and any one of statements 19 to 22, wherein at least one said covering and the portion(s) arranged to engage it are bonded together.

24. A method according to statement 4 or any one of statements 5 to 23 as dependent therefrom, wherein at least one said portion arranged to engage the substrate comprises a surface which is arranged to engage a corresponding surface defined by the substrate, and effecting the engagement between that portion and the substrate comprises bringing said surface of said portion into engagement with said corresponding surface.

25. A method according to statement 24, wherein bringing said surface of said portion into engagement with said corresponding surface comprises bringing the former into abutment with the latter, such that the engagement effected thereby transmissive to loading tending to increase pressure of that abutment.

26. A method according to statement 24 or 25, wherein bringing said surface of said portion into engagement with said corresponding surface comprises bonding said surface of said portion to said corresponding surface, such that the engagement effected thereby is transmissive to loading which subjects the bond(s) thus created to tension and/or shear.

27. A method according to statement 26, wherein the bonding of said surface of said portion to the said corresponding surface comprises applying adhesive between the former and the latter.

28. A method according to statement 26 or 27, wherein the bonding of said surface of said portion to said corresponding surface comprises fusing said surface of said portion and said corresponding surface together.

29. A method according to statement 28, wherein fusing said surface of said portion and said corresponding surface together is effected by heat and/or chemical fusion.

30. A method according to any one of the preceding statements, wherein the connector comprises at least one cover portion arranged so as to overlie at least one face of the panel and/or component, whereby securing of the connector effects concealment of the face(s) by the cover portion(s).

31. A method according to statement 30, wherein the or each cover portion is arranged so as to extend throughout an entirety of a length of the face it is arranged to overlie.

32. A method according to either one of statements 30 and 31, wherein the or each cover portion is arranged so as to extend throughout an entirety of a width of the face it is arranged to overlie.

33. A method according to any one of statements 30 to 32, wherein the at least one cover portion comprises a cover portion arranged to overlie an end face of the panel whereby the securing of the connector to the panel effects concealment of the end face of the panel.

34. A method according to statement 33, wherein the end face comprises a face defined by the substrate.

35. A method according to any one of statements 30 to 34, wherein the at least one cover portion comprises a cover portion arranged to overlie an end face of the component whereby the securing of the connector to the component effects concealment of the end face of the component.

36. A method according to any one of statements 30 to 35, wherein the at least one cover portion comprises a cover portion arranged to overlie a face defined by a portion of a side surface of the panel whereby the securing of the connector to the panel effects concealment of that face.

37. A method according to any one of statements 30 to 36, wherein the at least one cover portion comprises a cover portion arranged to overlie a face defined by a portion of a side surface of the component whereby the securing of the connector to the component effects concealment of that face.

38. A method according to any one of statements 30 to 37, wherein the at least one cover portion is configured to define capping over the face(s) it overlies in the connection.

39. A method according to any one of statements 30 to 38, wherein the at least one cover portion is configured to define a fascia over the face(s) it overlies in the connection.

40. A method according to statement 2 and any one of statements 30 to 39, wherein securing of the connector comprises securing at least one said cover portion against and/or to the face it is arranged to overlie, that cover portion thus defining a respective one of said respective portions.

41. A method according to statement 3 or any one of statements 4 to 40 as dependent therefrom, wherein the connector comprises at least one flange portion, the or each flange portion defining a said portion of the connector arranged to engage a respective said covering and being arranged so as to extend parallel to that covering, wherein effecting the engagement between that portion of the connector and the covering comprises securing a side face of the flange portion against a side face of the covering parallel to which it extends.

42. A method according to statement 41, wherein the connector comprises a web portion from which the or each flange portion extends, the web portion being arranged so as to overlie an end face of the panel.

43. A method according to statements 4 and 42, wherein the web portion defines a said portion arranged to engage the substrate, the method including effecting the load-transmissive engagement between the web portion and the substrate.

44. A method according to statement 43, wherein the end face comprises a surface defined by said substrate.

45. A method according to statements 24 and 44, wherein said load-transmissive engagement between the web portion and the substrate is effected by bonding a face of the web portion to said surface defined by said substrate, the web portion and said face thereof thus respectively defining a said portion arranged to engage the substrate and a said surface of that portion, and said surface defined by said substrate is a said corresponding surface, whereby said engagement between the web portion and the substrate is transmissive to loading which subjects the bond(s) thus formed to tension and/or shear resulting from any one or more of bending, tensile, torsional and shear loading between the substrate and web portion.

46. A method according to statement 45, wherein bonding of said face of the web portion to the end face comprises applying adhesive between said face of the web portion and the end face.

47. A method according to statement 45 or 46, wherein bonding of said face of the web portion to the end face comprises fusing them together.

48. A method according to statement 47, wherein fusing said face of the web portion and the end face together is effected by heat and/or chemical fusion.

49. A method according to any one of statements 42 to 48, wherein the web portion is arranged to cover fully and/or conceal the end face.

50. A method according to any one of statements 42 to 49, wherein the end face is defined by an edge of the panel whereby said connection is between the structural component and said edge.

51. A method according to statements 3 and 8 and any one of statements 42 to 50, wherein one side of the web portion defines said portions arranged to engage the substrate and the covering end face/edge(s) and the other side of the web defines said portion(s) arranged to engage the component.

52. A method according to any one of statements 41 to 51 wherein at least one said flange portion is arranged such that the said side face thereof is an outer side face thereof and the side face of the covering parallel to which that flange portion extends is an inner side face of that covering.

53. A method according to statement 52, wherein the or each flange portion the side face of which is a said outer side face is received in a slot between a surface defined by the substrate and the inner side face of the covering against which it is secured, the slot opening through the/an end face of the panel.

54. A method according any one of statements 41 to 53, wherein at least one said flange portion is arranged such that said side face thereof is an inner side face thereof and the side face of the covering parallel to which that flange portion extends is an outer side face of that covering.

55. A method according to any one of statements 41 to 54, wherein the panel comprises a pair of said coverings each of which is over a respective one of said sides of the substrate, and wherein the connector comprises a pair of said flange portions arranged to as to lie adjacent and/or against the respective covering parallel to which it extends.

56. A method according to statements 42 and 55 wherein the flange portions extend in the same direction from the web portion.

57. A method according to any one of statements 41 to 56, wherein the or each said flange portion is inclined to a degree to which said panel is to be inclined when said connection has been formed.

58. A method according to any one of statements 41 to 56, wherein said panel and the or each said flange portion are arranged to extend horizontally.

59. A method according to any one of statements 41 to 58, wherein the connector includes at least one further flange portion arranged so as to overlie an end of the component to preclude ingress, to or towards the component, of water which runs down a said covering engaged by a said flange portion.

60. A method according to statement 59, wherein the connector comprises at least one flange, the or each flange defining respective said flange and further flange portions.

61. A method according to statement 59 or 60, wherein at least one said further flange portion defines a said cover portion.

62. A method according to any one of statements 41 to 61 wherein the connector comprises at least one additional flange or web portion, defining a said portion arranged to engage the component, and wherein securing the connector to the component comprises securing a side face of a said additional flange or web portion to or against a side face of the component.

63. A method according to statement 62, wherein said panel is a wall or ceiling panel, the component is a roof panel, and said side face of the component defines an underside of the roof panel.

64. A method according to statement 62 or 63, wherein at least one said additional flange portion is inclined relative to said flange portion(s), to an extent that the component is to be inclined when said connection is formed.

65. A method according to statement 64, wherein the connector comprises a bracing portion between a said flange portion and a said additional flange portion to transmit loading therebetween.

66. A method according to statement 65, wherein the bracing portion is defined by a web portion of the connector.

67. A method according to statement 62, wherein the panel comprises a roof panel and the component comprises a soffit connection bracket.

68. A method according to any one of statements 62 to 67, wherein the connector comprises a pair of said additional flange portions arranged to receive said component therebetween and defining respective ones of said portions arranged to engage said component.

69. A method according to any one of statements 62 to 68, wherein securing of the connector to the component comprises securing a face of at least one of the additional flange portions to the component.

70. A method according to statement 20 or any one of statements 21 to 69 as dependent therefrom, wherein at least one of said respective portions is configured with a spacer positioned to abut the panel or component which that portion is arranged to engage such that defined between that portion and the panel/component is a void, and wherein applying the adhesive is such that the adhesive occupies the void so as to be retained between that portion and the panel/component.

71. A method according to statement 70, wherein the or each portion configured with a spacer is configured with a further spacer positioned to abut the panel or component which that portion is arranged to engage, the spacers with which that portion is configured being laterally spaced such that the void is bounded thereby.

72. A method according to statement 70 or 71, wherein the or each spacer is defined by a protuberance.

73. A method according to any one of statements 70 to 72, wherein the or each spacer extends throughout a length of the connector.

74. A method according to any one of the preceding statements, wherein the panel comprises a said covering over each side of the substrate, whereby the substrate defines a core of the panel.

75. A method according to any one of the preceding statements, wherein the connector is formed from metal.

76. A method according to statement 75, wherein the metal comprises aluminium.

77. A method according to any one of the preceding statements, wherein the connector is plastically formed.

78. A method according to any one of the preceding statements, wherein the connector is cold formed.

79. A method according to any one of the preceding statements, wherein the connector is rolled.

80. A method according to any one of statements 1 to 74, wherein the connector is polymeric.

81. A method according to statement 80, wherein the connector comprises a thermoplastic.

82. A method according to statement 80 or 81, wherein the connector is made of fibre-reinforced glass or fibreglass.

83. A method according to statement 82, wherein the connector is thermoformed.

84. A method according to any one of statements 80 to 83, wherein the connector is pultruded.

85. A method according to any one of statements 75, 76 and 80 to 83, wherein the connector is moulded.

86. A method according to any one of statements 75, 76, and 80 to 83, wherein the connector is extruded.

87. A method according to any one of the preceding statements, wherein the connector is of unitary construction.

88. A method according to any one of statements 1 to 86, wherein the connector comprises connector pieces.

89. A method according to statement 88 wherein the securing of the connector to the component and panel comprises interconnecting said pieces.

90. A method according to statements 42 and 89, wherein said pieces comprise two pieces defining respective portions of said web portion and interconnecting said pieces comprises interconnecting said portions to form said web portion.

91. A method according to statement 89 or 90, wherein said pieces comprise interengageable connector portions and interconnecting said pieces comprises effecting interengagement of the connector portions.

92. A method according to statement 91, wherein the connector portions extend throughout a length of the connector.

93. A method according to statement 91 or 92, wherein the connector portions comprise tongue-and-groove connector portions.

94. A method according to any one of the preceding statements, wherein the connector is defined by a joiner.

95. A method according to any one of the preceding statements, wherein the connector is defined by a bracket.

96. A method according to any one of the preceding statements, wherein the connector is of substantially uniform cross-section along a longitudinal axis thereof.

97. A method according to any one of the preceding statements, including applying a self-expanding compound within an empty gap between the panel and component, the compound thereafter expanding so as to occupy the gap in the connection.

98. A method according to statement 97, wherein the compound comprises a foaming compound.

99. A method according to statement 97 or 98, wherein the compound comprises self-expanding polyurethane foam.

100. A method according to any one of statements 97 to 99, wherein the gap is between ends or edges of the panel and component which are interconnected by the connection.

101. A method according to statement 2 and any one of statements 97 to 100, wherein the empty gap is a portion of a gap between the panel and component which is occupied by at least one said portion arranged to engage the panel and the component.

102. A method according to any on of statements 97 to 101, wherein the compound is one which when expanded bonds the panel and component.

103. A method according to any one of statements 97 to 102, wherein the compound is one which when expanded affords the connection strength.

104. A method according to any one of statements 97 to 103, wherein the compound is one which when expanded affords the connection acoustic and/or thermal insulation.

105. A method according to any one of statements 97 to 104, wherein the compound is one which when expanded affords the connection resistance to liquid/moisture ingress.

106. A method according to any one of the preceding statements, wherein one of the panel and the component is a wall panel and the other of the panel and the component is a roof and/or ceiling panel, and wherein the connector defines a top plate securing the wall panel to the roof and/or ceiling panel.

107. A method according to one of statements 1 to 105, wherein one of the panel and the component is a wall panel and the other of the panel and the component is a floor panel, and wherein the connector defines a bottom plate securing the wall panel to the floor panel.

108. A method according to statement 2 or any one of statements 3 to 107 as dependent therefrom, wherein effecting the load-transmissive engagement between either or each of the panel and the component and the respective portion(s) arranged to engage it comprises interconnecting it and the portion(s) with at least one fastener, such that that engagement is transmissive to loading which subjects the fastener(s) to tension and/or shear.

109. A method according to statement 2 or any one of statements 3 to 106 as dependent therefrom, wherein effecting the load-transmissive engagement between the component and the respective portion(s) arranged to engage it comprises interconnecting it and the portion(s) with at least one fastener, such that that engagement is transmissive to loading which subjects the fastener(s) to tension and/or shear.

110. A method according to any one of statements 1 to 105, wherein the panel is a wall panel and the component is a floor, slab or foundation structure arranged to support the wall panel thereover, whereby the connection is between a lower end of the panel and the floor, slab or foundation structure.

111. A method according to statement 110, wherein the connector defines a bottom plate securing the wall panel to the floor, slab or foundation structure.

112. A method according to statement 108 or 109, or either one of statements 110 and 111 as appended thereto, wherein the or each fastener comprises a through-fastener.

113. A method according to statement 112, wherein the or each through-fastener comprises a threaded fastener.

114. A method according to statement 113, wherein the or each threaded fastener comprises a screw or bolt.

115. A method according to statement 4, statement 42 and either one of statements 108 and 109, or any one of statements to 111 to 114 as dependent therefrom, wherein the web portion defines a said portion arranged to engage the substrate.

116. A method according to any one of the preceding statements, wherein the other component comprises a hinge.

117. A method according to any one of statements 1 to 115, wherein the component comprises another panel.

118. A method according to statement 117, wherein the other panel comprises a window panel.

119. A method according to statement 117, wherein the other panel comprises a substrate and a load-resistant covering over either or each side of the substrate, wherein securing of the connector to the other panel is such that the connector engages at least one said covering of said other panel, whereby said loading exerted by the component comprises loading exerted through the covering(s) of the other panel engaged by the connector.

120. A method according to statements 2 and 119, wherein the portion(s) arranged to engage the other panel comprise/s at least one portion arranged so as to engage at least one said covering of the other panel.

121. A method according either to statements 2 and 119 or to statement 120, wherein the portion(s) arranged to engage the other panel comprise/s at least one portion arranged to engage the substrate of the other panel, whereby the loading exerted by the other panel comprises loading exerted by the substrate of the other panel.

122. A method according to statement 120 or 121, wherein effecting the engagement between at least one said covering of the other panel and the respective portion(s) arranged to engage it/them comprises bringing that/those covering/s into abutment with the connector, such that that engagement is transmissive to loading tending to increase pressure of that abutment.

123. A method according to statement 122, wherein said abutment comprises abutment effected through contact between the covering of the other panel and the respective portion(s).

124. A method according to statement 122 or 123, wherein said abutment between the covering of the other panel and the respective portion(s) comprises indirect abutment.

125. A method according to any one of statements 122 to 124, wherein said abutment comprises abutment between an end face or edge of the covering of the other panel and at least one said respective portion.

126. A method according to statements 120 and 125, wherein the connector comprises a plate or strip section one side of which defines the portion(s) arranged to engage said panel and the other side of which is arranged to engage an end face of the other panel, comprising a surface defined by the substrate of the other panel and the covering end face/edge(s) of the other panel, thus defining the portions arranged to engage the substrate of the other panel and to abut the other panel covering end face/edge(s).

127. A method according to statement 126, wherein the plate or strip section is defined by a web portion of the connector.

128. A method according to statement 126 or 127, wherein effecting the load-transmissive engagement between the other panel and portion(s) arranged to engage it comprises bonding said other side to said end face or said surface defined by said substrate of the other panel, such that that engagement is transmissive to loading which subjects the bond(s) to tension and/or shear.

129. A method according to statement 128, wherein said bonding comprises applying adhesive between said other side and said end face or said surface defined by said substrate of the other panel.

130. A method according to any one of statements 126 to 129, wherein one of said panel and said other panel is a ceiling or roof panel and the other of said panel and said other panel is a wall panel.

131. A method according to any one of statements 126 to 130, being such that the connection defines a mitre joint between the panel and component.

132. A method according to statement 19 and any one of statements 119 to 131, wherein effecting the load-transmissive engagement between the other panel and the portion(s) arranged to engage it comprises the bonding of the other panel to the portion(s).

133. A method according to statements 20 and 132, wherein the bonding of the other panel to the portion(s) comprises the applying of the adhesive between the other panel and the portion(s).

134. A method according to statement 21 and either of statements 132 and 133, wherein the bonding of the other panel to the portion(s) comprises the fusing of the other panel and the portion(s) together.

135. A method according to statements 22 and 134, wherein fusing the other panel and the portion(s) together is effected by said heat and/or chemical fusion.

136. A method according to statement 120 or any one of statements 121 to 135 as dependent therefrom, wherein securing of the connector to the other panel comprises bonding together at least one said covering of the other panel and the portion(s) arranged to engage it.

137. A method according to statement 121 or any one of statements 122 to 136 as dependent therefrom, wherein at least one said portion arranged to engage the substrate of the other panel comprises a surface which is arranged to engage a corresponding surface defined by the substrate of the other panel, and effecting the engagement between that portion and the substrate of the other panel comprises bringing said surface of said portion into engagement with said corresponding surface defined by the substrate of the other panel.

138. A method according to statement 137, wherein bringing said surface of said portion into engagement with said corresponding surface defined by the substrate of the other panel comprises bringing the former into abutment with the latter, such that the engagement effected thereby transmissive to loading tending to increase pressure of that abutment.

139. A method according to statement 137 or 138, wherein bringing said surface of said portion into engagement with said corresponding surface defined by the substrate of the other panel comprises bonding said surface of said portion to that corresponding surface, such that the engagement effected thereby is transmissive to loading which subjects the bond(s) thus created to tension and/or shear.

140. A method according to statement 139, wherein the bonding of said surface of said portion to the said corresponding surface defined by the substrate of the other panel comprises applying adhesive between the former and the latter.

141. A method according to statement 138 or 139, wherein the bonding of said surface of said portion to said corresponding surface defined by the substrate of the other panel comprises fusing the former and latter surfaces together.

142. A method according to statement 141, wherein fusing said surface of said portion and said corresponding surface defined by the substrate of the other panel together is effected by heat and/or chemical fusion.

143. A method according to both any one of statements 30 to 40 and any one of statements 117 to 142, wherein at least one said cover portion is arranged so as to overlie at least one said face of the other panel, whereby securing of the connector effects concealment of the face(s) of the other panel by the cover portion(s) arranged to overlie said face(s).

144. A method according to statement 143, wherein at least one said cover portion arranged so as to overlie at least one said face of the other panel comprises a cover portion arranged to overlie an end face of the other panel whereby the securing of the connector to the other panel effects concealment of the end face of the other panel.

145. A method according to statement 144, wherein the end face of the other panel comprises a face defined by the substrate of the other panel.

146. A method according to statement 144 or 145, wherein at least one said cover portion arranged so as to overlie at least one said face of the other panel comprises a cover portion arranged to overlie a face defined by a portion of a side surface of the other panel whereby the securing of the connector to the other panel effects concealment of that face.

147. A method according to any one of statements 143 to 146, wherein securing of the connector comprises securing at least one said cover portion arranged to overlie at least one said face of the other panel against and/or to that face, that cover portion thus defining a respective one of said portions of the connector.

148. A method according to any one of statements 117 to 147, wherein the connector comprises at least one flange portion defining a portion of the connector arranged to engage a side-facing surface of the other panel ("other flange portion") and being arranged so as to extend parallel to that side-facing surface, and wherein securing the connector to the other panel comprises securing a side face of the or each other flange portion against the side-facing surface which it is arranged to engage.

149. A method according to statement 148, wherein the connector comprises a web portion from which the or each other flange portion extends, the web portion being arranged so as to overlie an end face of the other panel.

150. A method according to statements 121 and 149, wherein the web portion defines a said portion arranged to engage the substrate of the other panel.

151. A method according to statement 150, wherein the end face of the other panel comprises a surface defined by the substrate of the other panel.

152. A method according to statements 137 and 151, wherein securing of the connector to the other panel comprises bonding a face of the web portion to said surface defined by said substrate of said other panel, the web portion and said face thereof thus respectively defining a said portion arranged to engage the substrate of the other panel and a said surface of that portion, and said surface defined by the substrate of the other panel is a said corresponding surface, whereby said engagement between the web portion and the substrate of the other panel is transmissive to loading which subjects the bond(s) thus formed to tension and/or shear resulting from any one or more of bending, tensile, torsional and shear loading between the substrate of the other panel and the web portion.

153. A method according to statement 152, wherein bonding of said face of the web portion to the end face of the other panel comprises applying adhesive between said face of the web portion and the end face of the other panel.

154. A method according to statement 152 or 153, wherein bonding of said face of the web portion to the end face of the other panel comprises fusing together said face of the web portion and the end face of the other panel.

155. A method according to statement 154, wherein the fusing together of said face of the web portion and the end face of the other panel is effected by heat and/or chemical fusion.

156. A method according to any one of statements 149 to 155, wherein the web portion is arranged to cover fully and/or conceal the end face of the other panel.

157. A method according to any one of statements 149 to 156, wherein the end face of the other panel is defined by an edge of the other panel whereby said connection is between said panel and said edge of the other panel.

158. A method according to statement 120 or 127 and any one of statements 149 to 157, wherein a side of the web portion defines the portions arranged to engage the other panel substrate and other panel covering end face/edge(s).

159. A method according to statement 119 and any one of statements 148 to 158 wherein the or each side-facing surface is a side face of a said covering of the other panel.

160. A method according to statement 159, wherein at least one said other flange portion is arranged such that the said side face thereof is an outer side face thereof and the side face of the covering is an inner side face of that covering.

161. A method according to statement 160, wherein the or each other flange portion the side face of which is a said outer side face is received in a slot between a surface defined by the substrate of the other panel and the inner side face of the covering of the other panel against which covering it is secured, the slot opening through the/an end face of the other panel.

162. A method according any one of statements 148 to 161, wherein at least one said other flange portion is arranged such that said side face thereof is an inner side face thereof and the side-facing surface of the other panel which it is arranged to engage is an outer side face of the other panel.

163. A method according to statement 162 as appended to any one of statements 159 to 161, wherein said outer side face of said other panel is an outer side face of a said covering of said other panel.

164. A method according to any one of statements 159 to 161, statement 162 as appended thereto, or statement 163, wherein the other panel comprises a pair of said coverings each of which is over a respective one of said sides of the substrate of the other panel, and wherein the connector comprises a pair of said other flange portions arranged to as to lie adjacent and/or against the respective covering side face parallel to which it extends.

165. A method according to any one of statements 148 to 163, wherein the connector comprises a pair of said other flange portions arranged to as to lie adjacent and/or against the respective side-facing surface parallel to which it extends.

166. A method according to statement 149 and either one of statements 164 and 165 wherein the other flange portions extend in the same direction from the web portion.

167. A method according to any one of statements 119 to 142 or any one of statements 143 to 149 as dependent therefrom, or according to any one of statements 150 to 155 or any one of statements 156 to 166 as dependent therefrom, wherein the other panel comprises a said covering over each side of the substrate thereof, whereby that substrate defines a core of the other panel.

168. A method according to any one of statements 119 to 142 or any one of statements 143 to 149 as dependent therefrom, or according to any one of statements 150 to 155 or any one of statements 156 to 166 as dependent therefrom, or according to statement 167, wherein the or each covering defines a skin of the other panel.

169. A method according to statement 56 and any one of statements 149 to 157, or any one of statements 158 to 168 as appended thereto, wherein the web portion from which the or each flange portion extends is the web portion from which the or each other flange portion extends.

170. A method according to statement 56 and any one of statements 149 to 157, to any one of statements 158 to 168 as appended thereto, or to statement 169, wherein the panels are arranged such that the end faces thereof are in opposed relation and the flange and other flange portions project bilaterally from the web portion(s) so as to engage the covering(s) of said panel and side-facing surface(s) of the other panel respectively.

171. A method according to statement 170, wherein the flange and other flange portions consist of the flange portion and the other flange portion.

172. A method according to statement 42 or 43, statement 164 and statement 170, wherein the flange and other flange portions comprise one of said flange portions and one of said other flange portions extending bilaterally—each from one end or edge of the web portion/respective web portion, and the other of said flange portions and the other of said other flange portions extending bilaterally—each from the other end or edge of the web portion/respective web portion.

173. A method according to statement 171 or 172, wherein the flange and other flange portions project in opposite directions whereby sides of the panel and other panel between which the connection is formed are parallel.

174. A method according to statement 171 or 172, wherein the or each said flange portion and the respective said other flange portion project such that there is an included angle therebetween.

175. A method according to statement 174, wherein the flange and other flange portions comprise a said flange portion and a said other flange portion projecting from an upper end of the web portion/respective web portion.

176. A method according to statement 175, wherein the flange portion and other flange portion projecting from said upper end are downwardly divergent, and wherein the panels are roof panels defining a ridge, whereby the downwardly divergent flange portions define a ridge cap of the roof.

177. A method according to statement 175, wherein the flange portion and other flange portion projecting from said upper end are upwardly divergent, and wherein the panels are roof panels defining a valley, whereby the downwardly divergent flange portions define a valley gutter of the roof.

178. A method according to statement 173, 174 or 175, wherein the panels define side-by-side ceiling, roof or floor panels.

179. A method according to statement 173, 174 or 175, wherein the panels define a lower panel and upper panel.

180. A method according to statement 179, wherein the lower panel defines a wall panel.

181. A method according to statement 179 or 180, wherein the upper panel defines a gable panel.

182. A method according to any one of the preceding statements, wherein the or each covering of the, either or each panel defines a skin.

183. A method according to any one of the preceding statements, wherein the substrate of the, either or each panel is porous and/or includes interstices distributed throughout.

184. A method according to any one of the preceding statements, wherein the substrate of the, either or each panel is of aerated form.

185. A method according to any one of the preceding statements, wherein the substrate of the, either or each panel comprises a foam.

186. A method according to any one of the preceding statements, wherein the substrate of the, either or each panel comprises a rigid foam.

187. A method according to any one of the preceding statements, wherein the substrate of the, either or each panel comprises polystyrene.

188. A method according to statement 187 or 188, wherein the polystyrene comprises extruded polystyrene.

189. A method according to any one of the preceding statements, wherein the substrate of the, either or each panel is defined by a honeycomb structure.

190. A method according to any one of the preceding statements, wherein the or each covering of the, either or each panel is polymeric.

191. A method according to any one of the preceding statements, wherein the or each covering of the, either or each panel comprises polymeric material.

192. A method according to any one of the preceding statements, wherein the or each covering of the, either or each panel comprises thermoset polymer material.

193. A method according to any one of the preceding statements, wherein the or each covering of the, either or each panel comprises resin.

194. A method according to any one of the preceding statements, wherein the or each covering of the, either or each panel is reinforced.

195. A method according to statement 194, wherein at least one said covering of the, either or each panel is fibre-reinforced.

196. A method according to statement 195, wherein at least one said covering of the, either or each panel includes woven fibre reinforcement.

197. A method according to any one of statements 194 to 196, wherein at least one said covering of the, either or each panel includes reinforcing fabric.

198. A method according to any one of statements 194 to 197, wherein the or each covering of the, either or each panel is fibre-reinforced glass or fibreglass.

199. A method according to any one of the preceding statements, wherein the, either or each panel is a fibre-composite panel.

200. A connector for use in forming a connection between a structural component and a panel, the panel comprising a substrate and a load-resistant covering over either or each side of the substrate, the connector being securable to the component and panel such that it engages at least one said covering and the component so as to direct, to the covering(s) engaged thereby, loading exerted by the component.

201. A connector according to statement 200, being the connector for use in a method according to any one of statements 1 to 199.

202. The connection formed by a method according to any one of statements 1 to 199.

203. A panel comprising a substrate and a load-resistant covering over either or each side of the substrate, being for use as the panel in a method according to any one of statements 1 to 199.

204. An assembly comprising the connector of statement 200 or 201 and said panel, wherein the connector is secured to the panel and securable to said component such that said connection can be formed.

205. An assembly comprising the connector of statement 200 or 201 and said component, wherein the connector is securable to said panel such that said connection can be formed.

206. An assembly comprising the connector of statement 200 or 201, said panel and said component, wherein the connector is secured to the panel and component.

207. A method of manufacturing a panel, the method comprising arranging substrate sections end-to-end whereby an edge of one section and an edge of another are in abutting relation, either or each of the edges, in a thus formed pair of abutting edges, being configured with a channel which opens laterally outwardly and extends therealong, such that a cavity is defined by the channel(s), the method including securing opposite sides of each substrate section to a respective sheet section, whereby the panel comprises opposed skins, each comprising a respective one of the sheet sections, and a core, comprising the end-to-end arranged substrate sections, and either of each of fluid and power is suppliable through the panel via the or each cavity.

208. A method according to statement 207, being such that the panel defines said panel in the method of statement 74 or any one of statements 75 to 199 as appended thereto, each skin defining a respective one of said load-resistant coverings and the core defining said substrate.

209. A method according to statement 207 or 208, wherein securing of the opposite sides of each section or the substrate to the respective sheet section comprises bonding/and or fusing the opposite sides to that sheet section.

210. A method according to any one of statements 207 to 209, wherein arranging the substrate sections end-to-end comprises laying each of them over one sheet section, and wherein the other sheet section is thereafter laid over the laid substrate sections, and wherein each of said laid substrate sections is secured to said one sheet and to the other sheet section laid thereover.

211. A method according to statement 210, including applying bonding agent to said one sheet section, such that one side of the substrate contacts the bonding agent upon the substrate being laid over said one sheet section, and applying bonding agent to the other side of the substrate such that said other sheet section contacts that bonding agent upon being laid over the laid substrate, securing of the sheet sections to the substrate comprising bonding via the bonding agent applied to said one sheet and the bonding agent applied to said other side of the substrate.

212. A method according to statement 211, wherein the bonding agent comprises adhesive.

213. A method according to statement 211 or 212, wherein the bonding agent comprises resin.

214. A method according to any one of statements 210 to 213, wherein said one sheet section lies substantially flat while the substrate is laid thereover.

215. A method according to any one of statements 210 to 214, wherein said laid substrate lies substantially flat while said other sheet section is laid thereover.

216. A method according to any one of statements 207 to 215, wherein said one sheet is supported on a press while the substrate is laid thereover and while said other sheet section is laid over the laid substrate, wherein securing of the opposite sides of the substrate to the sheet sections comprises operating the press to clamp each sheet section against the substrate.

217. A method according to any one of statements 207 to 216, wherein either or each side of the substrate and/or a side of the respective sheet section which is received against that side is configured with grooves such that excess bonding agent flows into and along at least one of the grooves.

218. A method according to statement 217, wherein each groove extends to an edge of the substrate the side of which is configured therewith, such that excess bonding agent escapes from between the sheet sections.

219. A method according to statement 217 as appended to statement 216, or to statement 218 as appended thereto, wherein said press is a vacuum press and operation of the press includes applying a vacuum to the clamped sheet sections to draw excess bonding agent along each of ones of the grooves to the edge to which it extends.

220. A method according to any one of the preceding statements, wherein the number of substrate sections exceeds two, whereby there are plural said pairs of abutting edges and the end-to-end arranged sections comprise laterally outer sections and at least one intermediate section therebetween, laterally outer edges of the intermediate section(s) and respective laterally inner edges of the laterally outer sections being in abutting relation.

221. A method according to statement 220, wherein the number of substrate sections is three, whereby there are two said pairs of abutting edges and the end-to-end arranged sections comprise laterally outer sections and one said intermediate section therebetween, laterally outer edges of the intermediate section and respective laterally inner edges of the laterally outer sections being in abutting relation.

222. A method according to statement 220, wherein the number of substrate sections is four, whereby there are three said pairs of abutting edges and the end-to-end arranged sections comprise laterally outer sections and two said intermediate sections therebetween, laterally inner edges of the intermediate section being in abutting relation.

223. A method according to any one statements 207 to 222, wherein each of the edges is configured with a said channel 224. A method according to any one of statements 207 to 223, wherein the or each channel is concave in cross-section.

225. A method according to any one statements 207 to 224, wherein the or each channel is semi-circular in cross-section.

226. A method according to any one statements 207 to 225, further comprising forming the or each channel in a face defined by the edge to be configured therewith.

227. A method according to statement 226, wherein forming the or each channel comprises machining the edge.

228. A method according to statement 227, wherein machining the edge comprises routing the edge.

229. A method according to statement 226, 227 or 228, wherein forming the or each channel comprises thermoforming the channel in the edge.

230. A method according to statement 229, wherein forming the or each channel comprises thermopressing the edge.

231. A method according to statement 229 or 230, wherein forming the or each channel comprises pressing a hot object against the edge so as to cause melting and/or softening of the material at the edge, thereby impressing the channel into the edge.

232. A method according to statement 231, wherein the hot object is elongate and arranged to extend along the edge when pressed thereagainst.

233. A method according to statement 232, wherein the hot object is maintained axially stationary relative to the edge when pressed thereagainst.

234. A method according to statement 232 or 233, wherein the hot object is a rod.

235. A method according to any one of statements 226 to 234, including separating a substrate sheet into said sections.

236. A method according to any one of statements 226 to 235, including cutting a substrate sheet to form said sections.

237. A method according to any one of statements 226 to 236, including arranging at least one conduit member between the edges of at least one said pair such that extending along the cavity defined by the channel(s) with which either/each of those edges is formed is a conduit through which the fluid and/or power is suppliable.

238. A method according to statement 237, wherein the or each conduit member arranged between the edges which are to form at least one said pair is so arranged prior to the end-to-end arranging of the substrate sections defining the pair.

239. A method according to statement 237 or 238, wherein arranging the or each conduit member between the edges of at least one said pair comprises feeding said conduit member(s) into the cavity/ies defined by the channel(s) with which either/each of those edges of that pair is formed.

240. A method according to any one of statements 237 to 239, wherein the or each conduit member is tubular.

241. A method according to statement 240, wherein the or each conduit member is cylindrical.

242. A method according to any one of statements 237 to 241, wherein the conduit member(s) is/are configured such that the or each conduit is tubular.

243. A method according to statement 237, wherein the conduit member(s) is/are configured such that the or each conduit is cylindrical.

244. A method according to statement any one of statements 237 to 243, wherein the conduit member(s) is/are arranged such that the or each conduit forms a close fit within the cavity and/or forms a casing against an interior face of the cavity.

245. A method according to any one of statements 237 to 244, wherein the conduit members comprise at least one pair of conduit members which are arranged side-by-side such that laterally opening adjacent sides of the conduit members mate whereby the conduit is defined.

246. A method according to any one of statements 207 to 245, wherein at least one external opening into the, each or at least one said cavity is formed.

247. A method according to statement 246, wherein the at least one external opening comprises spaced apart openings.

248. A method according to statement 246 or 247, wherein the at least one said external opening comprises an opening defined by an open end of the cavity.

249. A method according to statement 246 or 247, wherein the at least one said external opening comprises openings defined by respective open ends of the cavity.

250. A method according to any one of statements 246 to 249, wherein the at least one said external opening comprises an opening through a side of the panel.

251. A method according to any one of statements 246 to 249, wherein the at least one said external opening comprises spaced apart openings through a side of the panel.

252. A method according to statement 250 or 251, wherein the or each opening through a side of the panel is formed by machining.

253. A method according to statement 252, wherein the machining comprises drilling.

254. A panel comprising opposed skins and a core within which extends at least one cavity via which either or each of fluid and power is suppliable through the panel.

255. A panel according to statement 254, wherein at least one said cavity extends through an edge of the panel.

256. A panel according to statement 255, wherein at least one said cavity which extends through an edge of the panel additionally extends through an opposite edge of the panel.

257. A panel according to any one of statements 254 to 256, being the panel formed by a method according to any one of statements 207 to 245, wherein the or each cavity extending within the core is a said cavity defined by said channel(s).

258. A panel according to any one of statements 254 to 257, wherein the or each cavity extends axially and/or substantially perpendicular to an axis normal to the panel.

259. A building services installation method, comprising:

installing at least one service line through at least one said cavity of a panel according to any one of statements 254 to 258 or manufactured by the method according to any one of statements 207 to 253; and/or installing at least one service line which comprises at least one said cavity of that panel.

260. A building services installation method according to statement 259, wherein the panel is in situ.

261. A method of constructing a building, comprising installing a wall structure of the building and a ceiling structure, floor structure or other wall structure of the building adjacent to said wall structure, wherein one of said structures comprises a panel according to any one of statements 254 to 258 or manufactured by the method according to any one of statements 207 to 253, the method further comprising:

installing at least one service line through at least one said cavity of the panel; and/or installing at least one service line which comprises at least one said cavity of that panel.

262. A method according to statement 261, the method comprising accessing, through the other of said structures, said at least one said cavity to install said at least one service line.

263 A method according to statements 261 or 262, including forming a connection between the wall structure and the structure adjacent to said wall structure by a method according to any one of statements 1 to 199, wherein the panel which said one of said structures comprises is said panel comprising a substrate and a load-resistant covering over each side of the substrate, and the other of said structures comprises said structural component, whereby said connector is secured to the panel which said one of said structures comprises, and to said other of said structures.

264. A method according to statement 261 or 262, wherein the structure adjacent to said wall structure is said other wall structure.

265. A method according to statement 261 or 262, wherein the structure adjacent to said wall structure is said floor structure.

266. A method according to statement 265, including forming a connection between the wall structure and the floor structure by a method according to statement 107 or any one of statements 108 to 199 as appended thereto, wherein the panel which said one of said structures comprises is said wall panel, and the other of said structures comprises said floor panel, whereby said connector is secured to said panel which said one of said structures comprises and to said other of said structures, and the bottom plate defined by the connector secures the wall structure to the floor structure.

267. A method according to statement 261 or 262, wherein the structure adjacent to said wall structure is said ceiling structure.

268. A method according to statement 267, including forming a connection between the wall structure and the ceiling structure, forming of the connection comprising securing a connector between the wall structure and ceiling structure.

269. A method according to statement 268, wherein said connection between the wall structure and the ceiling structure is formed by a method according to statement 16 or any one of statements 17 to 199 as appended thereto, the panel which said one of said structures comprises being said wall panel, and the other of said structures comprising said ceiling panel, whereby said connector is secured to said panel which said one of said structures comprises and to said other of said structures.

270. A method according to statement 268 or 269, wherein said at least one said cavity is accessed through said connector secured between the wall structure and ceiling structure, and or is accessed through said ceiling structure, to install the service line(s).

271. A method according to statement 270, wherein at least one opening is formed through said connector, and/or is formed through said ceiling structure, and the access to said at least one said cavity is through at least one said opening.

272. A method according to statement 271, wherein the at least one opening is preformed.

273. A method according to statement 271, comprising forming the at least one opening through said connector after the securing of the connector between the wall structure and ceiling structure, or after the securing of the connector to either or each of the wall structure and ceiling structure.

274. A method according to any one of statements 268 to 273, wherein the connection between the wall structure and the ceiling structure is formed by a method according to statement 106 or any one of statements 108 to 199 as dependent therefrom, the wall structure comprising said wall panel and the ceiling structure comprising said ceiling panel, whereby the top plate defined by the connector secures the wall structure to the ceiling structure.

275. A method according to any one of statements 261 to 274, wherein the one of said structures is said wall structure.

276. A method according to any of statements 261 to 275, wherein the other of said structures comprises a panel.

277. A method according to statement 276, wherein the panel which the other of said structures comprises has a core and opposed skins.

278. A method according to any one of statements 267 to 274, or any one of statements 275 to 277 as dependent therefrom, further comprising, subsequent to the installation of said service line(s), installing a roof structure of the building over the ceiling structure.

279. A method according to statement 278, including forming a connection between the wall structure and the roof structure.

280. A method according to statement 279, wherein the connection between the wall structure and the roof structure is formed by a method according to statement 63 or any one of statements 64 to 199 as dependent therefrom, the wall structure comprising said wall panel and the roof structure comprising said roof panel.

281. A method according to any one of statements 278 to 280, including forming a connection between the ceiling structure and the roof structure, forming of the connection comprising securing a connector between the ceiling structure and the roof structure.

282. A method according to statement 281, wherein the forming of the connection between the ceiling structure and the roof structure comprises securing the connector to the ceiling structure and thereafter securing the connector to the roof structure, and wherein, after the securing of the connector to the ceiling structure and before the securing the connector to the roof structure, said at least one said cavity is accessed through said connector, and/or is accessed through said ceiling structure, to install the service line(s).

283. A method according to statement 282, wherein at least one opening is formed through said connector, and/or is formed through said ceiling structure, and the access to said at least one said cavity is through at least one said opening.

284. A method according to statement 283, wherein the at least one opening is preformed.

285. A method according to statement 283, comprising forming the at least one opening through said connector after the securing of the connector to the ceiling structure.

286. A method according to any one of statements 282 to 285, wherein the connection between the ceiling structure and the roof structure is formed by a method according to statement 63 or any one of statements 64 to 199 as dependent therefrom, the wall structure comprising said wall panel and the roof structure comprising said roof panel.

287. A method according to any one of statements 278 to 286, wherein the wall structure and structure adjacent thereto are installed such that a space bounded by those structures and defining an interior space in the building is sheltered and/or isolated from the elements during installation of the roof structure.

288. A method according to any one of statements 261 to 287, wherein the wall structure and structure adjacent thereto are installed such that the wall structure bounds a space at a side thereof and the ceiling structure, floor structure or other wall structure bounds the space at a top, bottom or other side, respectively, thereof, said space defining an interior space in the building.

289. A method according to statement 288, wherein the wall structure and structure adjacent thereto are installed such that the space or interior space is sheltered and/or isolated from the elements.

290. A method according to any one of statements 287 to 289, including attaining lock-up in respect of said space, interior space or building prior to installation of the services.

291. A method according to any one of statements 261 to 290, wherein installing of the service line(s) comprises installation of either or each of:

at least one electrical wire or cable; and at least one gas or liquid conduit, whereby the at least one line comprises said cable(s) and/or said conduit.

292. A method according to any one of statements 261 to 291, wherein installation of the service line(s) comprises drawing, training and/or feeding at least one said line along the cavity.

293. A method according to any one of statements 261 to 292, wherein installation of the service line(s) comprises connecting a line and/or fitting to either or each of opposed ends of at least one said cavity.

294. A method according to any one of statements 287 to 290 or any one of statements 291 to 293 as dependent therefrom, wherein:

at least one said service line is to deliver power to and/or from said interior space; and/or at least one said service line is to deliver liquid and/or gas to and/or from said interior space.

295. A method according to any one of statements 259 to 294, wherein at least one external opening into the, each or at least one said cavity is formed, and wherein the installing of the, each or at least one said service line is such that a service to be provided thereby is provided through at least one said opening into the cavity.

296. A method according to any one of statements 259 to 294, wherein at least one external opening into the, each or at least one said cavity is formed, and said installing comprises installing, at at least one said opening into a said cavity through which a said service is to be provided, a component for utilisation of the service.

297. A method according to statement 296, wherein a said component comprises any one or more of:

a switch;

a socket;

a controller or adjustor;

a tap;

a fitting;

a plug;

a vent; and a connector.

298. A method according to any one of statements 295 to 297, wherein the installing of the, each or at least one said service line is such that that service line passes through a said opening.

299. A method according to any one of statements 295 to 298, wherein the at least one external opening into the, each or at least one said cavity comprises spaced apart openings.

300. A method according to any one of statements 295 to 299, wherein the at least one external opening into the, each or at least one said cavity comprises an opening defined by an open end of the cavity.

301. A method according to statement 299 or 300, wherein the at least one said external opening into the, each or at least one said cavity comprises openings defined by respective open ends of the cavity.

302. A method according to any one of statements 299 to 301, wherein the at least one said external opening into the, each or at least one said cavity comprises an opening through a side of the panel.

303. A method according to any one of statements 299 to 301, wherein the at least one said external opening into the, each or at least one said cavity comprises spaced apart openings, each being through a side of the panel.

304. A method according to statement 303, wherein the spaced apart openings comprise openings through the same side of the panel.

305. A method according to statement 303 or 304, wherein the spaced apart openings comprise at least one opening through one side of the panel and at least one opening through the opposite side of the panel.

306. A method according to any one of statements 302 to 305, wherein the, each or at least one said opening through a side of the panel is machined through that side.

307. A method according to statement 306, wherein the, each or at least one said opening which is machined through said side is drilled through that side.

308. A building constructed, and/or in which said service(s) is/are installed, by a method according to any one of statements 259 to 307.

309. A prefabricated panel, for formation of a building panel configured with at least one penetration, the prefabricated panel being configured with at least one cutout defining one or more portions of the prefabricated panel which is/are removable such that one or more penetration(s) is/are formed.

310. A prefabricated panel according to statement 309, wherein the cutout(s) is/are such that the/each removable portion is removable by exertion of a force thereagainst.

311. A prefabricated panel according to statement 309 or 310, wherein the cutout(s) is/are such that the/each removable portion is pop-out.

312. A prefabricated panel according to any one of statements 309 to 311, wherein the cutout(s) is/are formed such that the or each portion is interconnected with the building panel via at least one bridging portion which is any one or more of frangible, breakable, cuttable and penetrable such that the removal of that removable portion is permitted.

313. A prefabricated panel according to any one of statements 309 to 312, wherein the cutout(s) is/are formed such that friction and/or an interference fit between said panel configured with at least one penetration and the, each or at least one said removable portion holds the latter to the former.

314. A prefabricated panel according to any one of statements 309 to 313, wherein the cutout(s) is/are such that the one or more penetrations are any one or more of:

a door penetration;

a window penetration; and a fitting penetration.

315. A prefabricated panel according to any one of statements 309 to 313, being:

the panel of statement 203 and/or any one of statements 254 to 258; or such that said building panel configured with at least one penetration is the panel of statement 203 and/or any one of statements 254 to 258.

The entire content each of Australian provisional patent application nos. 2018900439, 2018900958 and 2018903334 and international patent application no. PCT/AU2019/050109 is incorporated herein by reference.

BRIEF DESCRIPTION OF THE DRAWINGS

Preferred embodiments of the invention will now be described, by way of non-limiting example only, with reference to the accompanying drawings, in which.

DETAILED DESCRIPTION

Figure 1:
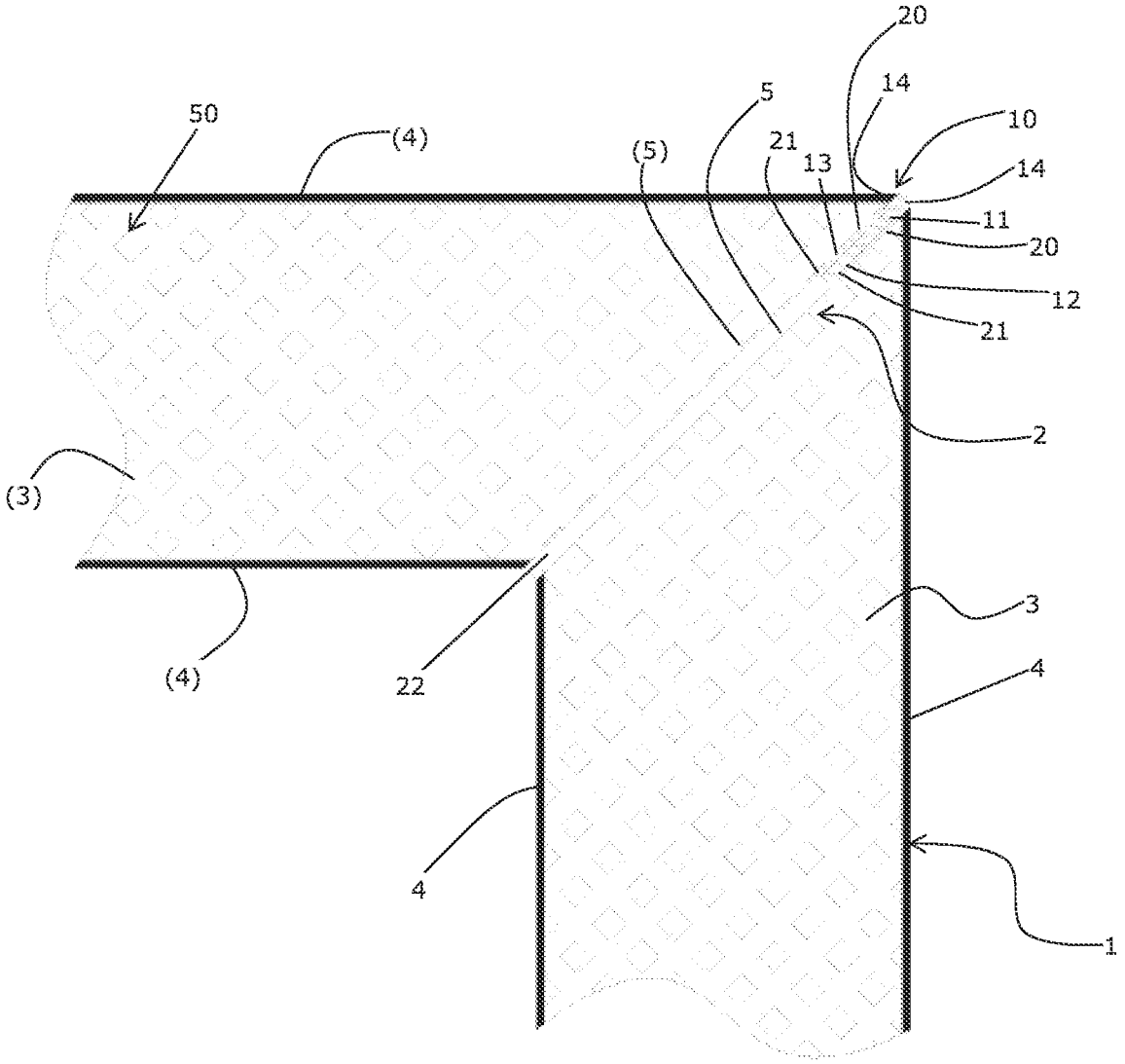
FIG. 1 is a schematic cross-sectional view of a connector and a connection between two panels which includes that connector, according to embodiments of the invention.

Shown in situ in FIG. 1 is a connector 1 according to a preferred embodiment of the present invention. The connector 1 is used to connect a composite panel 1, along an edge 3 thereof, to another member 50. In the example shown, the other member 50 is a like panel, and it is to a (like) edge of that panel that the edge 3 is connected, more particularly at a mitre joint between the edges. In this particular example, the panel 1 is upright, and may constitute a wall panel (interior or exterior) of a building, and the other panel 50 extends transverse (in this case perpendicular) to the panel 1, and may be a roof or ceiling panel of the building. The composite panel 1 comprises a rigid substrate 3 and a covering 4 to each side of, and secured (e.g. bonded or fused) to, the substrate 3, each covering 4 defining a "skin" of the panel 1, in the sense that it has a thickness which is small compared to the thickness of the substrate 3. Each skin 4 is made of a polymer material, which in the example described and illustrated is a fibre-reinforced material (i.e. the skin is additionally made of reinforcing fibre). The exterior faces of the covers 4 are smooth and bondable to objects by adhesive. Further details of the skins 4 are provided later herein.

In the example shown, the connector 10 is received between an end face 5 of the edge 2 and the component 50; more particularly, it is received between the end face 5 of the panel 1, defined by the edge 5 thereof, and a like end face defined by the edge of the like panel, and secured against those faces to interconnect the panel 1 and component 50. The connector 10 comprises a strip section 11 defining a first face 12 which is arranged so as to be adjacent the end face 5, and a second face 13 which is opposite to the first face 12 and arranged so as to be adjacent the end face of the edge of the other panel 50. The faces 12 and 13 are secured, via the adhesive 20, to the end face 5 of the panel 1 and the end face 5 of the component 50 respectively.

In the present example, as well as each of the other examples, described and illustrated herein, the adhesive is a silyl-modified polyether ("MS polymer") adhesive, which bonds reliably to the (indirectly) abutting end faces 5, each of those end faces comprising a surface of the substrate, which is relatively rough given the interstices distributed throughout the foam material, and end faces of the skins 4 to either side of that substrate. This adhesive, advantageously, also provides a seal between each connector face and the respective panel/substrate end face which it bonds together. In the present example, it is the surfaces defined by the substrate that are bonded to the connector 10 (though, as indicated above, the material from which the skins 4 are formed is of itself bondable by the adhesive).

Other types of adhesive/sealant, such as (for example), silyl-modified polyurethanes ("SPUR polymers"), are possible without departure from the invention, as will be appreciated by a person skilled in the art.

The connector 10 is configured with an enlarged portion, defining an outer edge of the connector 10 and defining also opposed spacer portions 14, each of which (like the portion 11) extends the length of the connector (and indeed also the lengths of the edges 2) and is receivable directly against a lateral extremity of the respective end face 5 (in this particular case the outer lateral extremity), including the end face of the outer/exterior covering 4 thereof the panel 1 and panel 50. Owing to each spacer 14, the connector face adjacent to it (on the side of the connector on which that spacer is arranged) is spaced slightly from the end face 5 adjacent thereto, whereby to each side of the connector 10 there is defined a void 21, between the connector face at that side and the end face 5 adjacent to/facing it. Advantageously, there is thus an ensured evenness of spread of the adhesive between the first and second faces of the connector and the end faces to which they are bonded; in particular, adhesive is not forced out from between the connector and end faces (and thereby rendered useless) as it would tend to be in the absence of the spacers 14 (so that wastage of adhesive is reduced considerably). The protuberances 14 could, without departure from the invention, be intermittent along the length of the connector (e.g. be defined by discrete, spaced apart, projections each having, for example, the cross-sectional configuration as illustrated), though an advantage of their being continuous along that length is that the outer edge of the connector defines a trim, affording the outer edge of the joint a uniform, smooth appearance, contributing to aesthetics.

The outer edge of the connector 10 serves an important further role (which is enhanced by the spacers 14 at that edge being continuous), namely to engage (and more particularly to abut) an end face of a skin 4 of the panel 1 (the exterior skin 4 in this particular example) so as to transfer, to that skin, loading (including through the connector 10) exerted on the substrate 3 of the panel 1 by the panel 50, the skin 4/skin material, braced against distortion/buckling by the substrate 3, being stronger than the substrate 3/substrate material and thus, unlike to the substrate 3/substrate material, being apt to bear that loading—be it compressive, tensile or shear (translation or torsional) loading. The connector 10 also engages (and more particularly to abuts) an end face of a skin 4 of the like panel 50 (the exterior skin 4 in this particular example) so as to transfer, to that skin, loading (including through the connector 10) exerted on the substrate 3 of the panel 50 by the panel 1 (as a result of the latter panel supporting the former panel), the skin 4/skin material of the panel 50 likewise being braced against distortion/buckling by the substrate 3 of the panel 50.

The protuberances 14 additionally facilitate alignment of the connector faces with the respective end faces to which they are bonded.

The portion of the gap 22 between the panel end face 5 and the other component 50, which is not occupied by the connector 10, can, if appropriate, be supplied with a compound which expands to fill that portion of the gap, such as self-expanding foam, e.g. self-expanding polyurethane foam (PU), which the inventors have found, advantageously, bonds well to the faces defined by substrate 3, affording the connection additional strength and/or additional acoustic and/or thermal insulation and/or resistance to liquid/moisture ingress.

The connection between the panels 1, defined by the connector 10 and adhesive 20, is, advantageously, resistant to shear (translation or torsional) in a plane parallel to either of the bonded connector faces, tension in a direction perpendicular to those faces (which faces are parallel to/in alignment with the edge faces) and moment loads about the longitudinal (length) axis of the connector, including in particular loading that would tend to pry open the mitre joint about the outer edge thereof.

The connector 10, particularly advantageously, transfers to the covering 4 to which it extends and with which it is engaged, loads exerted on the substrate 3 of the panel 1 by the component 50, including loads transmitted through the connection/connector itself, which loads would otherwise be born by the substrate 3. In transferring loads to a lateral side of the panel, defined by the skin/covering 4, the connection/connector functions in the nature of a lintel.

Figure 2:
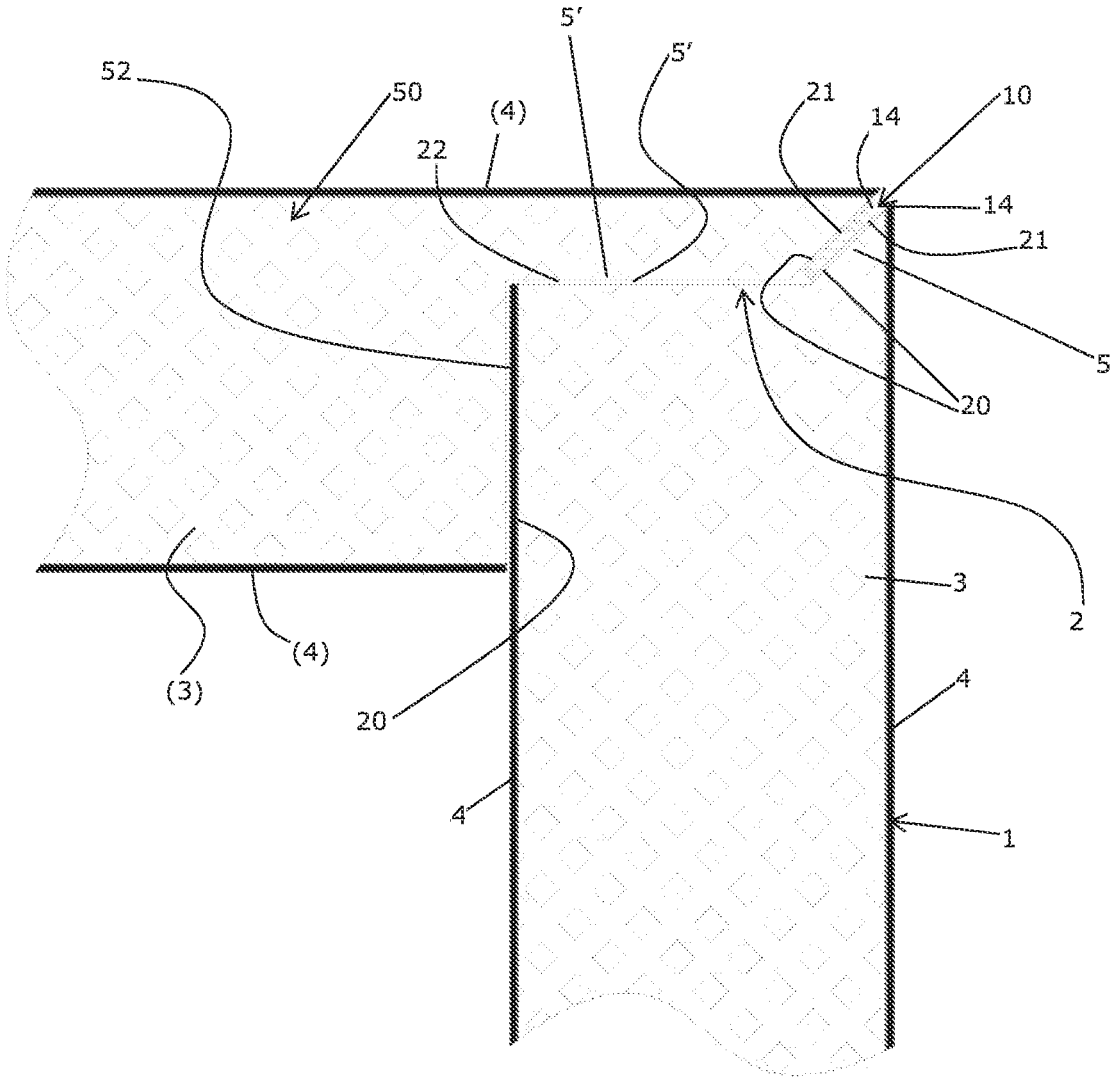
FIG. 2 is a schematic cross-sectional view of a connector and a connection between two panels which includes that connector, according to further embodiments of the invention.

Shown in FIG. 2 is an alternative connection, including the connector 10, in accordance with a preferred embodiment of the invention. The connection is the same as that shown in FIG. 1 except for the configuration of the junction between the panel 1 and component 50 (again, a like panel) which the connector 10 does not occupy. In this example, the edge 2 of the panel 1 has, in addition to tapered end face 5, a square end face 5', and the component 50 has a corresponding face 51 parallel and adjacent to the face 5'. The void 22 between those faces can be filled with the self-compound so as to be afforded characteristics as described in respect of compound in relation to FIG. 1. The edge of the further component 50 is further configured with a square face 52 arranged to be parallel and adjacent to the covering 4 on the inner lateral side of the panel 1. Adhesive 20 is applied so as to occupy a void between the outer face of that cover 4 and the face 52, affording the joint additional strength and sealing.

In each of the assemblies shown in FIGS. 1 and 2, the horizontal panel and vertical panel can, conversely, be considered the relevant "panel" and "component" respectively, since the connector 10/connection also transfers, to skin 4 of the horizontal panel (owing to its engagement with that skin) loads exerted on the substrate 3 of that panel by the vertical panel, which loads would otherwise be borne by that substrate.

Figure 3:
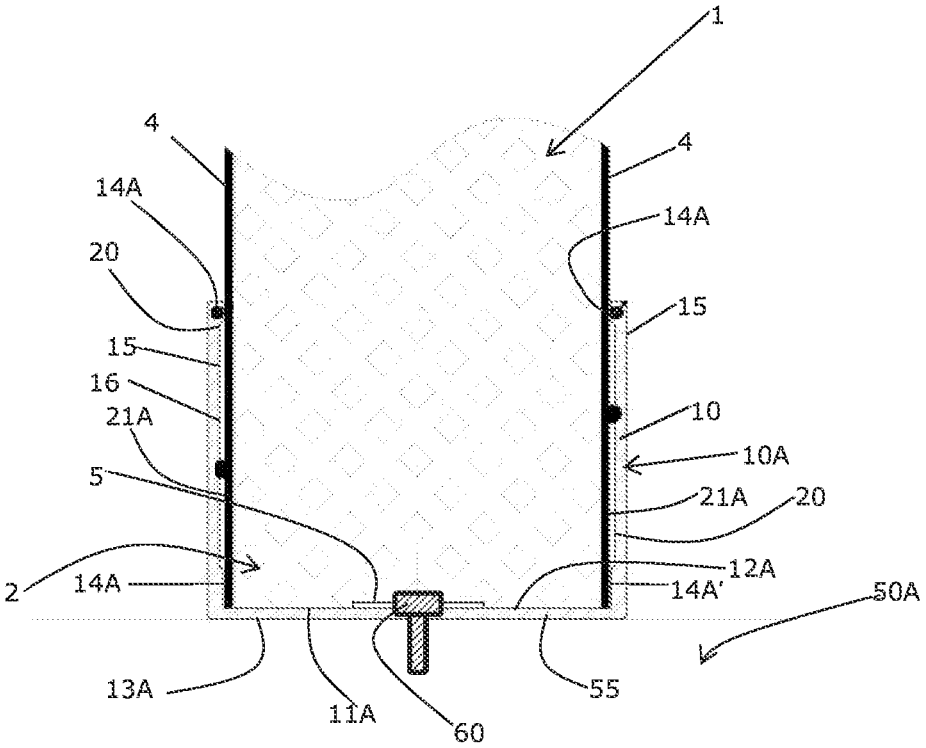
FIG. 3 is a schematic cross-sectional view of a connector and a connection between a panel and a slab which includes that connector, according to further embodiments of the invention.

Shown in FIG. 3 is another connection, which includes an alternative connector 10A, in accordance with a preferred embodiment of the invention. In this example, the connection is between edge 2 of panel 1 and a concrete slab 50A, the latter defining in this example the structural component to which the former (at its lower edge in this example) is connected via the connector 10A.

The connector 10A is configured in the form of a parallel flange channel, comprising a web portion 11A, opposed portions of which define a first face 12A and second face 13A and a pair of parallel flange portions 15 each extending upwardly from a respective lateral end or edge of the web portion 11A.

The web portion 11A and flange portions 15 define an open-ended cavity into which the panel edge 2 is closely received, whereby one of the flanges 15 extends parallel and adjacent to the outer surface of one of the coverings 4, and the other flange 15 extends parallel and adjacent to the outer face of the other covering 4. Each flange is configured, at a distal end thereof, with a respective protuberance, defining a laterally inwardly projecting spacer 14A and configured at a proximal end thereof, with a respective protuberance defining a laterally inwardly extending spacer 14A. The spacers 14A and 14A' abut the outer faces of the respective skins 4 such that laterally inner faces 16 of the flanges 15, which faces are between the spacers 14A and 14A, are spaced slightly from the respective skin outer surfaces adjacent thereto, such that voids 21A are defined between the adjacent faces. The adhesive 20 is applied so as to occupy each void 21A, whereby it is reliably retained between the opposing faces which it bonds (in this case the flange face 16 and cover outer face between which that void is defined) the voids 21A thus conferring advantages consistent with those conferred by voids 21 as described above.

The spacers 14A, like spacers 14, extend the entire length of the respective flange portions 15, though could instead be intermittent along the length without departure from the invention. Likewise, the spacers 14A', like spacers 14, extend the entire length of the respective flange portions 15, though could instead be intermittent along the length without departure from the invention.

In the example shown in FIG. 3, the panel 1 is a wall panel (internal or external) of the building and the connector 10A defines a bottom plate securing the panel 1 at its lower end to the slab 50A so as to form a tie-down. Effecting the relevant engagement between the web portion 11A and the slab 50A comprises connecting the web 11A to the slab 50A via through fasteners, received through the web 11A at spaced positions therealong and into the slab 50A, the fasteners comprising sleeve anchors such as those referenced by the proprietary name DynaBolt. The fasteners are applied such that the load-bearing faces thereof which abut the upper face of the web portion 11A (which load-bearing faces may be defined by heads of the fasteners and/or load-distributing elements such as washers between the heads and the web portion 11A) are in direct contact with the upper surface of the web 11A. Uplift forces and/or other upward forces in the panel 1 are transferred from the skins 4 to the flanges 15, via the adhesive bonding the former to the latter, and thence from the flanges 15 to the slab 50A, via the web 11A and fasteners 60 therethrough.

In an alternative arrangement embodying the invention, the structural component to which the assembly comprising the panel 1 and connector 10A is tied down can be something other than a slab—for example, a floor frame, which frame may be timber, in which case it may be appropriate that the fasteners 60 take the form of screws or bolts, or which may be metal, in which case it may be appropriate that the fasteners 60 take the form of bolts. In either scenario in which the fasteners 60 comprise bolts, it will often be appropriate that the shank of the bolt in each fastener extend through the frame member and the fastener include a nut, possibly together with a washer at the distal end of the shank to abut the bottom face of the frame member, so that uplift forces and/or other upward forces in the panel 1 are transferred through that face. It is also possible that the tension-resistant engagement can be instead effected, or enhanced, by bonding and/or fusing the lower face of the web portion 11A to the upper surface of the component 50A against which it is received. In one example, in which the component and web portion are made of fusible material, the binding/fusion may be effected by heat and/or chemical fusion and/or welding together of the abutting faces of the web portion 11A and component—either intermittently continuously along the length of the web portion 11A.

In any case, the downward (anchoring) loading exerted by the slab, floor frame or other underlying structure defining the "component" on the lower end of the panel is directed, by the connector 10A/connection, to the skins 4. In this case, the loading so directed does not comprise any loading transferred, as such, from the substrate to the skins, since the connector eliminates any need for tensile loading on the connection, resulting from upward loading on the panel 1, to be borne through the lower end face of the substrate 3.

Figure 4:
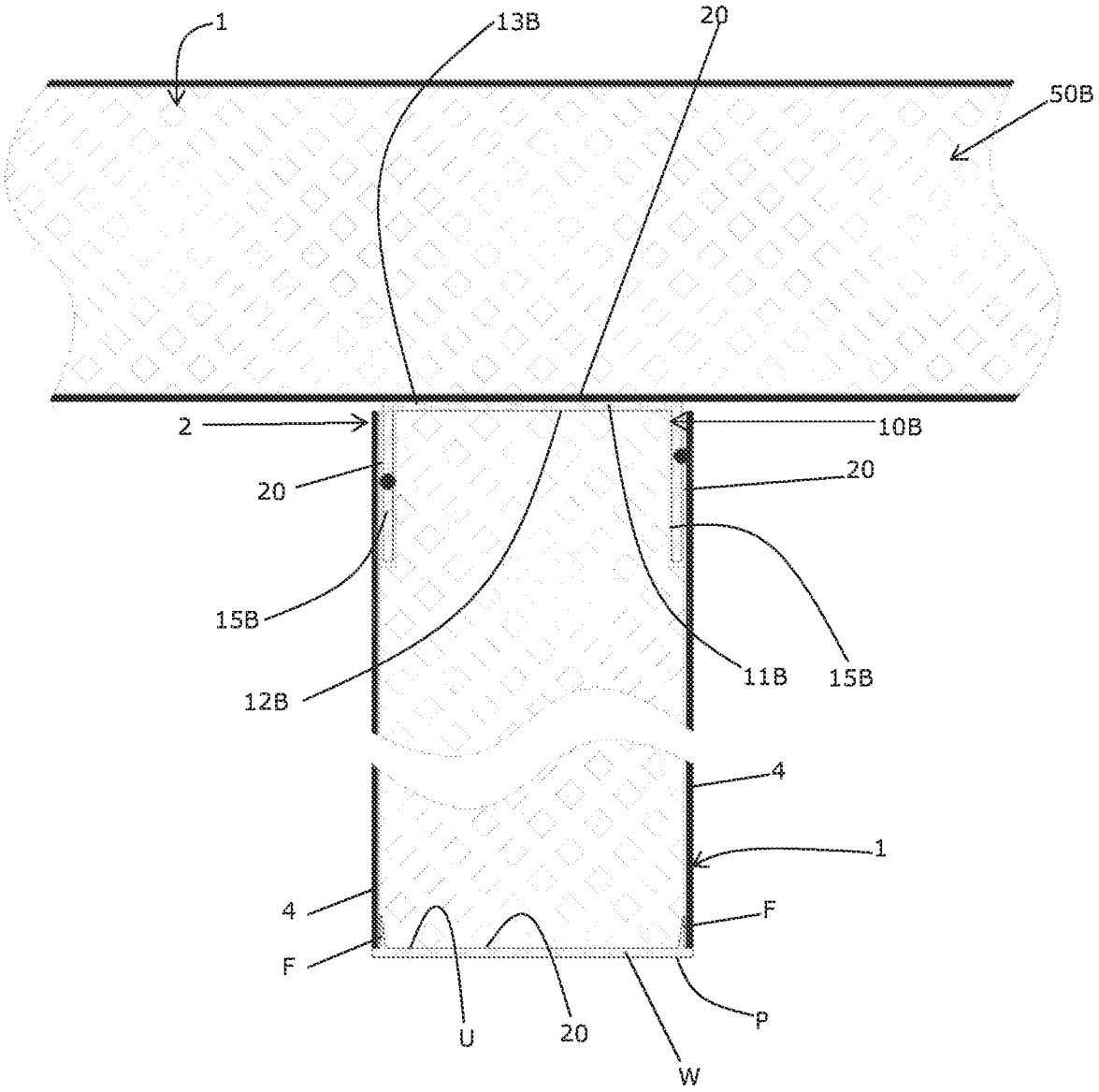
FIG. 4 is a schematic cross-sectional view of a connector and a connection between a roof or ceiling panel and a wall which includes that connector, according to further embodiments of the invention.

Shown in FIG. 4 is another connection, which includes a connector 10B, in accordance with a preferred embodiment of the invention. The connector 10B is configured in the form of a parallel flange channel, comprising a web portion 11B, opposed portions of which define a first face 12B and second face 13B, and a pair of parallel flange portions 15B each extending from a respective lateral end or edge of the web portion 11B.

The web portion 11B and flange portions 15B define a downwardly opening cavity into which the substrate 3 at the upper edge/end of the panel 1 is closely received, whereby one of the flanges 15B extends parallel and adjacent to the inner surface of one of the coverings 4, and the other flange 15B extends parallel and adjacent to the inner surface of the other covering 4. More particularly, each flange is received in a respective slot machined (e.g. routed) into a laterally outer portion of the substrate material, whereby laterally inner faces of the flange portions 15B are received against/ adjacent to, and in alignment with, respective laterally outward faces of the substrate formed by the machining and defining laterally inner faces of the respective slots, and the laterally outer face of each flange is received adjacent to/against, and extends in alignment with, the laterally inner face of the respective skin 4 which is exposed as a result of the machining and defines a laterally outer face of the respective slot. Adhesive 20 is received in each of the slots 20 to bond the laterally outer face of the flange portion 15B therein to the laterally inner face of that slot defined by the exposed laterally inner face of the skin 4. Adhesive 20 is also applied between the web face 13B and lower face of the structural component 50B arranged atop the panel 1, that component in this particular example being a like panel (1) extending perpendicular to and supported on the panel 1, to bond the lower face of the component 50B to the web portion 11B. In this particular example, the upright panel 1 may be that of an internal wall in a building and the panel 50B a ceiling and/or roof panel of the building, the connector 10B thus defining a top plate.

The adhesive 20 received in the slots may additionally comprise adhesive 20 which bonds the flange inner lateral faces to the outer lateral faces of the substrate.

In this example, the connector 10B/connection directs, to the upright panel skins 4, downward loads, and any temporary upward loads, exerted on the upright panel 1 by the component 50B.

Applied to the lower end of the panel 1 is an end plate P, having a web W an upper face of which is secured to an end face of the substrate 3 at the lower end by adhesive 20, and parallel upwardly extending flanges F which are received in slots, likewise machined into the substrate material, in a manner such that laterally and outwardly projecting end portions of the web W receive thereagainst lower ends of the respective skins 4. The end plate P, advantageously, ensures satisfactory directing, to the skins 4, of upward loading exerted on the panel by the support structure as a result of the lower end of the panel resting against that support structure.

The connector 10B may, without departure from the invention, be configured with protuberances, the kind previously described, at the distal ends of the flanges and on the side(s) thereof which are bonded within the respective slot, and/or at/adjacent lateral edges of the web portion 13B, defining adhesive-holding voids conferring advantages as described above.

Figure 5:
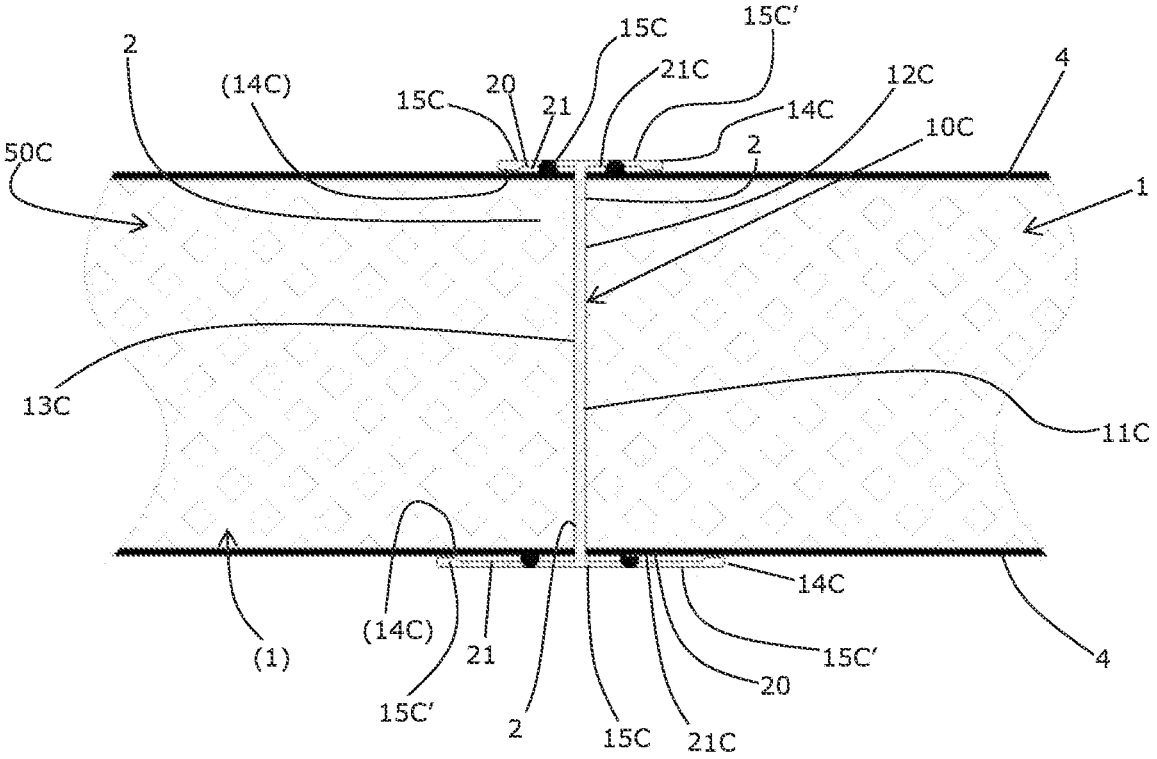
FIG. 5 is a schematic cross-sectional view of a connector and a connection between roof or ceiling panels which includes that connector, according to further embodiments of the invention.

Shown in FIG. 5 is another connection, which includes an alternative connector 10C, in accordance with a preferred embodiment of the invention. In this example, the connection is between panel 1 and a like panel (1) which defines the component 50C to which panel 1 is connected. The two panels, which in this particular example are aligned and coplanar, may be roof or ceiling panels, and are connected via the connector 10C at adjacent edges to thereof. The connector 10C is configured in the form of an I-beam comprising a web portion 11C, opposed portions of which define a first face 12C and a second face 13C, and parallel flanges 15C each connected to a respective end of the web 12C and being perpendicular to that web, each flange 15C having opposed flange portions 15C', the web portion face 12C and the two flange portions 15C' which project in the direction in which that face faces defining a cavity into which the edge 2 of the panel 1 is closely received. Correspondingly, web portion face 13C and the flange portions 15C' which project in the direction in which that face faces, define a cavity into which the edge 2 of the panel 50C is closely received. In the particular example shown, the connector 10C/connection is one capable of transferring, to the panel 1, loading in the panel 50C and to direct that loading to the skins 4 of the panel 1. The flange portions 15C' between which the edge of panel 1 is received are configured at their distal ends with protuberances defining spacer portions 14C which abut the outer faces of the respective skins so that adhesive-retaining voids 21C are defined between adjacent surface portions of the flanges and skins bonded by the adhesive 20. The distal ends of the other flange portions 15C' are likewise configured with spacers 14C such that corresponding adhesive-retaining voids are defined between those flanges and the skin faces of the panel 50C bonded by that adhesive (though, again, the spacers 14C/voids 21 could be omitted without departure from the invention).

In the particular example shown, the connector 10C/connection transfers loads in the panel 50C to the panel 1 and directs them to the skins 4 of the panel 1, particularly tensile loads in the direction away from and perpendicular to web face 13C (which loads are transmitted from the panel 50C to the flange portions 15C' between which that panel is received, by the adhesive 20 bonding that panel to those flange portions. The loading also includes compressive loading in the panel 50C in the direction towards and perpendicular to the face 13C, which loading is transferred by compression of the web 12C and the abutment between the face 12C thereof and the end faces/edges of the skins 4 received thereagainst. The tensile/compressive loading may instead be created by moment loading, about an axis extending parallel to the panel edge, in which case the compressive load transfer path just described will be through one end of the web 11C and the tension load transfer path just described will be through the flange 15C at the opposite end of the web. Typically, the bending loading in question will comprise downward loading in the end of the panel 50C, resulting from the weight of the panel 50C, so that the compressive load transfer is effected through the top flange 15C and the tension load transfer is effected by the bottom flange 15C. The loading transferred from the panel 50C to the skins of the panel 1 may additionally comprise shear loading parallel to the web faces 12C and 13C. That shear loading may result from torsion about an axis perpendicular to those faces and/or horizontal/vertical loading.

Advantageously, the upper flange 15C, which extends throughout the lengths of the panel edges forms a cap which conceals the ends of the panels, contributing to aesthetics. Also, the adhesive which bonds that flange to the upper skins 4 of the panels provides a seal against 2 ingress of water into the connection.

In particular embodiments of the invention comprising connection of panel edges via a connector, it is not necessary that the connector engage both skins of the panel 1, as is the case with the example shown in FIGS. 1 and 2, and also the case with examples shown in FIGS. 6 and 7 which will now be described.

Figure 6:
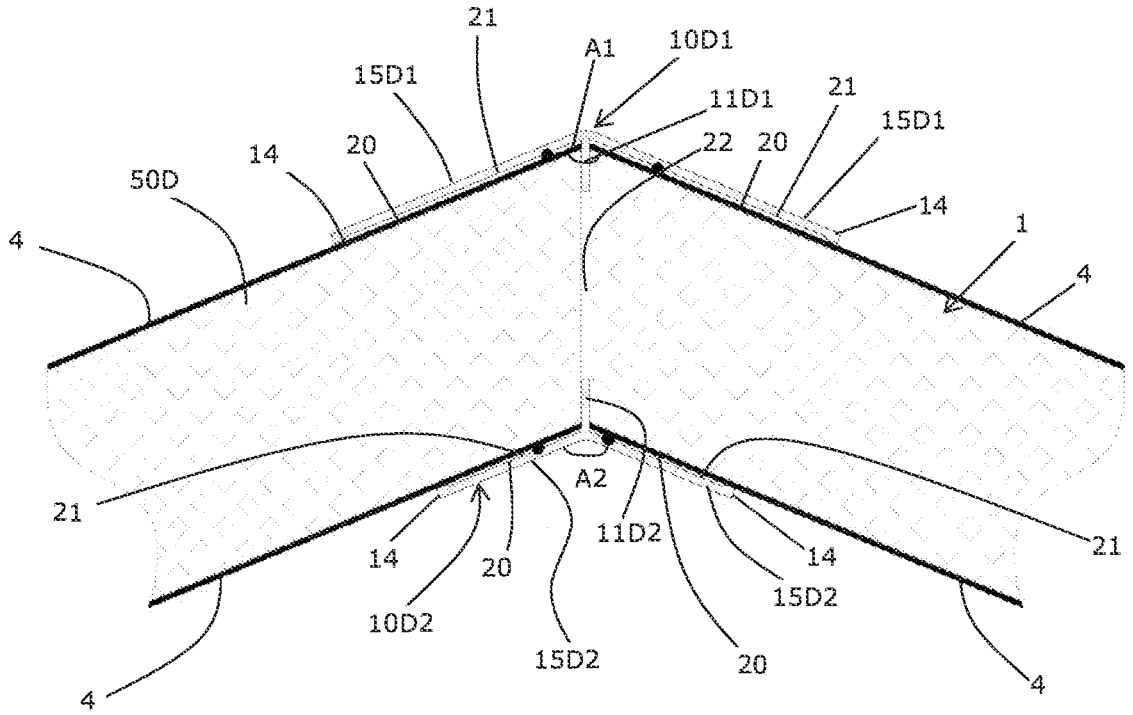
FIG. 6 is a schematic cross-sectional view of connectors and respective connections between roof panels which include those connectors, according to further embodiments of the invention.

The arrangement shown in FIG. 6 is similar to that shown in FIG. 5 except that the panel 1 and like panel, defining the component 50D to which it is connected, are not coplanar but instead inclined so as to be upwardly convergent, and the interconnection between the panel 1 and like panel is via a pair of connections, one being an upper connection including a connector 10D1, and the other being a lower connection including a connector 10D2. The panels 1 and 50D may, for example, be roof panels of the building, defining a ridge of the building roof.

The connector 10D1 comprises a web 11D1 and opposed flange portions 15D which project divergently from a proximal end/edge of web 11D1 so as to extend parallel to, and be received against, respective ones of the upper/exterior skins 4 of the panel 1 and panel 50D. Each flange is configured, at a distal end/edge thereof, with a spacer 14 of the kind previously described, whereby a respective void 21 is defined between a face of the flange and adjacent face of the skin 4 of the respective skin to which it is to be bonded, adhesive 20 being applied within the void.

The connector 10D1 not only directs, to the upper skin 4 of panel 1, loads exerted by the panel 50D (particularly loads through an outer lateral side portion of the panel 50D, but also, advantageously, defines a ridge cap, the adhesive 20 bonding the flanges of that ridge cap to the outer skins 4 providing a seal against ingress into the upper connection. A compressive load exerted on the web 11D1 by the upper lateral portion of panel 50D will be directed by the web 11D1 both to the end face of the upper skin 4 of panel 1 abutting that web and to outer side face of that skin via the flange portion 15D1 and the adhesive bonding it. Tension forces exerted by that portion will be transmitted to the upper portion skin 4 of panel 1 by the interconnection between that skin and the flange 15D1 bonded to it by the adhesive 20. The included angle, A1, between the flange portions 15D1 is on the side of the flanges from which the web 11D1 projects.

The connector 10D2 comprises a web 11D2 and flange portions 15D2 which diverge from a proximal end of the web 11D2, so as to extend parallel to respective ones of the lower/interior skins 4 of the panels 1 and 50D. The included angle, A2, between the flange portions 15D2 is on a side of those flanges which is opposite to that from which the web 11D2 projects.

The flanges 15D2 are also configured at their distal ends/edges with spacers 14 arranged to abut the external surfaces of the lower skins 4, whereby there are defined between a face of that flange and the respective skin surface adjacent to it respective voids 21 which retain adhesive 20 applied therein and bonding the flange and skin. Compressive loading exerted through a lower/inner lateral side portion of the panel 50D will be taken through the side face of the web 11D2 abutting that portion and directed by that web to the lower skin 4 of the panel 1 and transferred into that lower skin by abutment of the web between the end face of that skin as well as by the bond between the outer surface of that skin and the flange received against that skin. Other loads through that lower portion will be transferred to the panel 1 and directed to the lower skin thereof in the same manner as the loads in the upper lateral portion of the panel 50D are transferred to the upper skin of the panel 1 by the upper connection.

Figure 7:
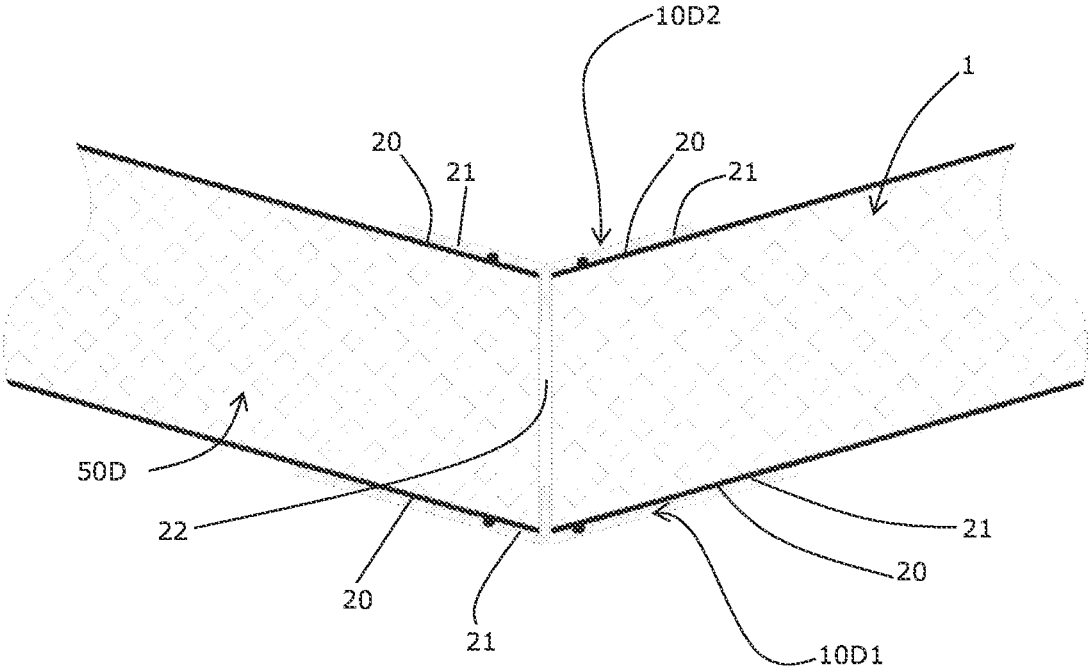
FIG. 7 is a schematic cross-sectional view of connectors and respective connections between roof panels which include those connectors, according to eighth and ninth embodiments of the invention.

The example shown in FIG. 7 is similar to that shown in FIG. 6 except that the panel 1 and like panel 50D converge downwardly, rather than upwardly, so that it is an upper/outer connection between the panel 1 and 50D that comprises connector 10D2, and a lower/exterior connection between those panels that comprises connector 10D1. The panels 1 and 50D in this particular example also may be roof panels, in which case the arrangement shown in FIG. 7 may define a valley of the roof. In that case, the connector 10D2, which extends the length of the panel edges/laterally outer side portions which it interconnects, defines a valley gutter, and the adhesive bonding the flanges of that connector to the upper/outer skins 4 provides a seal against water ingress into the upper/outer connection.

In each of the assemblies shown in FIGS. 6 and 7, expanding foam as previously described may be installed in the gap between panel 1 and said components which is not occupied by either of webs 11D1 and 11D2.

Figure 8:
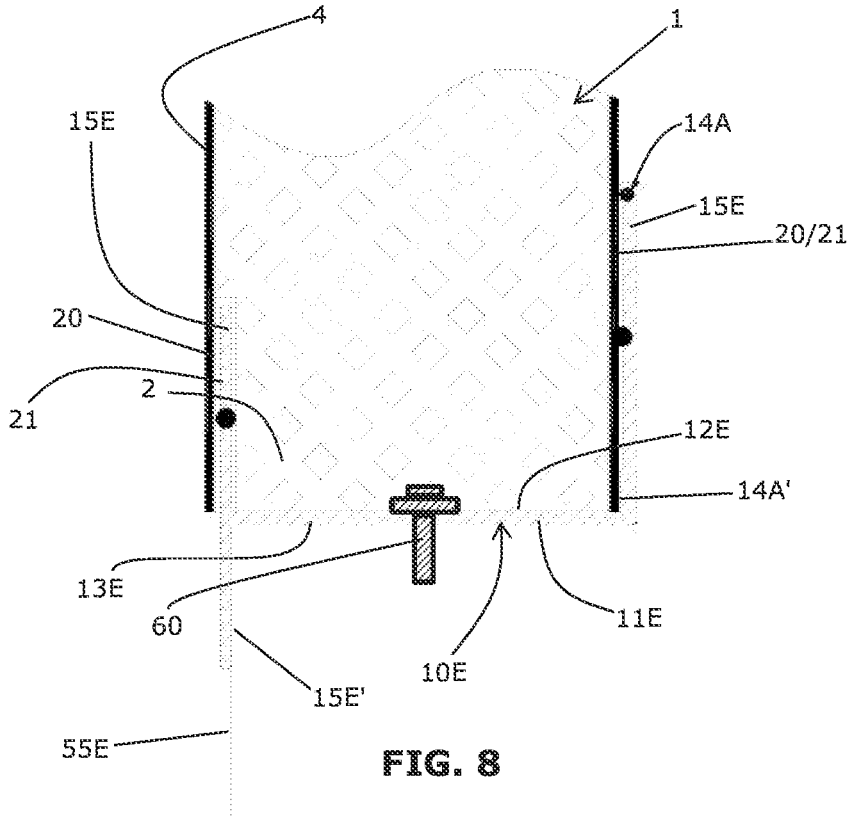
FIG. 8 is a schematic cross-sectional view of a connector and a connection between a wall panel and slab edge which includes that connector, according to further embodiments of the invention.

Shown in FIG. 8 is another connection, which includes an alternative connector 10E, in accordance with a preferred embodiment of the invention. In this example, the connection is similar to that of FIG. 3, in that it is between lower edge 2 of panel 1 and concrete slab 50A and the latter defines the structural component to which the former is connected. However, in the example shown in FIG. 8, the panel is an exterior wall panel of the building, and received against a perimeter section of the slab 50A, whereas in the example shown in FIG. 3, the panel 1 is an internal wall panel of the building, secured through the slab 50A inward from its perimeter. The connector 10E comprises a web portion 11E arranged between the panel lower end and the perimeter portion of the slab 50A (or indeed any component alternative thereto as described previously in relation to FIG. 3). Opposed portions of the web 11A define a lower face 13E of the web and an upper face 12E of the web.

The connector 10E includes parallel flange portions 15E each extending upwardly from a respective lateral end or edge of the web portion 11E whereby the flange portions 15E and web portion 11E define an open-ended cavity which closely receives the panel lower edge 2.

The laterally inner flange 15E is configured in the same form as the right-hand flange 15 in the arrangement shown in FIG. 3 and secures to the skin 4 adjacent to it in the same manner as the flange 15 (i.e. via the adhesive 20 in the void 21). The laterally outer flange 15E, on the other hand, is received in a slot formed in the panel edge and opened through the end face thereof, the slot being the same as either of the slots in the upper end of the upright panel 1 in the arrangement shown in FIG. 4 (apart from those being formed in the panel lower end in this example). The laterally outer flange 15E is also secured in the slot, via adhesive 20, in the same way as that flange 15B. The connector 15E comprises a further flange portion 15E which projects downwardly from the lateral outer end/edge of the web 11E so as to be received against an upright side face of the slab 50A or, as the case may be, the alternative to it as mentioned above. The laterally outer flange portion 15E and additional flange portion 15E' are defined by a single flange connected to the laterally outer end/edge of the web 11E and arranged perpendicular to that web. The flange 15E' functions as a drip or drainage line or bridge in that water running down the outer face of the panel Twill, upon reaching the bottom end thereof, be precluded from ingressing laterally inwardly by the flange 15E'.

Advantageously, owing to the receipt of the laterally outer flange 15E into the slot, it is concealed by the external skin 4 and the junction between that flange and the outer skin 4 faces downwardly so that water/moisture ingress into that junction may be avoided.

Figure 9:
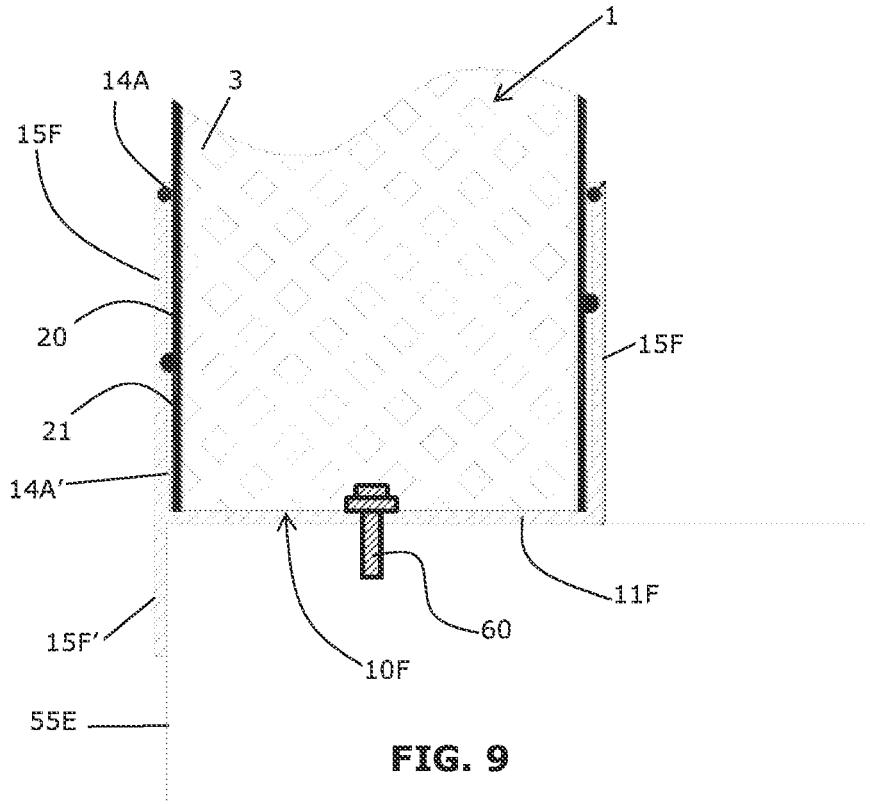
FIG. 9 is a schematic cross-sectional view of a connector and a connection between a wall panel and slab edge which includes that connector, according to further embodiments of the invention.

Shown in FIG. 9 is another connection, which includes an alternative connector 10F, in accordance with a preferred embodiment of the invention. The connector 10F and the connection in which it is included are very similar to the connector 10E and connection including it, as described above with reference to FIG. 8. In particular, the laterally inner flange portion 15F of the connector 10F is configured and bonded to the laterally inner skin 4, in an identical manner to the laterally inner flange 15E. Also, the web 11F is arranged between the lower end face of the substrate 3 and upper face of the other component 50A, and secured against the latter, in the same manner as the web 11E, except that no slot is formed into the lower edge of the panel and the web 11F extends beneath the outer skin 4, so as to be abutted by the lower end face thereof. The laterally outer flange 15F of the connector 10F is configured in the same form as the left-hand flange 15 of the connector 10A as shown in FIG. 3 and secured against adjacent skin 4 in the same manner as that flange, via adhesive 20 in void 21. The connector 10F includes an additional flange portion 15F' which is received against the side face 55E in identical manner to the flange portion 15E'. The laterally outer flange portion 15F and additional flange portion 15F' are likewise defined by a single flange perpendicular to the web 11F.

The connector 10F/connection shown in FIG. 9 is, advantageously, such that the laterally outer flange 15F defines a fascia or covering which conceals the outer skin 4 at a lower end thereof, contributing to aesthetics, and the adhesive securing it to that skin serves as a barrier against water ingress into the connection. Another advantage of the connection shown in FIG. 9 is that the engagement between the laterally outer flange and laterally outer skin can be effected quickly and easily given the absence, in the FIG. 9 connection, of the slot as employed in the FIG. 8 connection.

The additional flange portion 15F', like the flange portion 15E', functions as a drip or drainage line/bridge in the same manner as flange portion 15E'.

Figure 10:
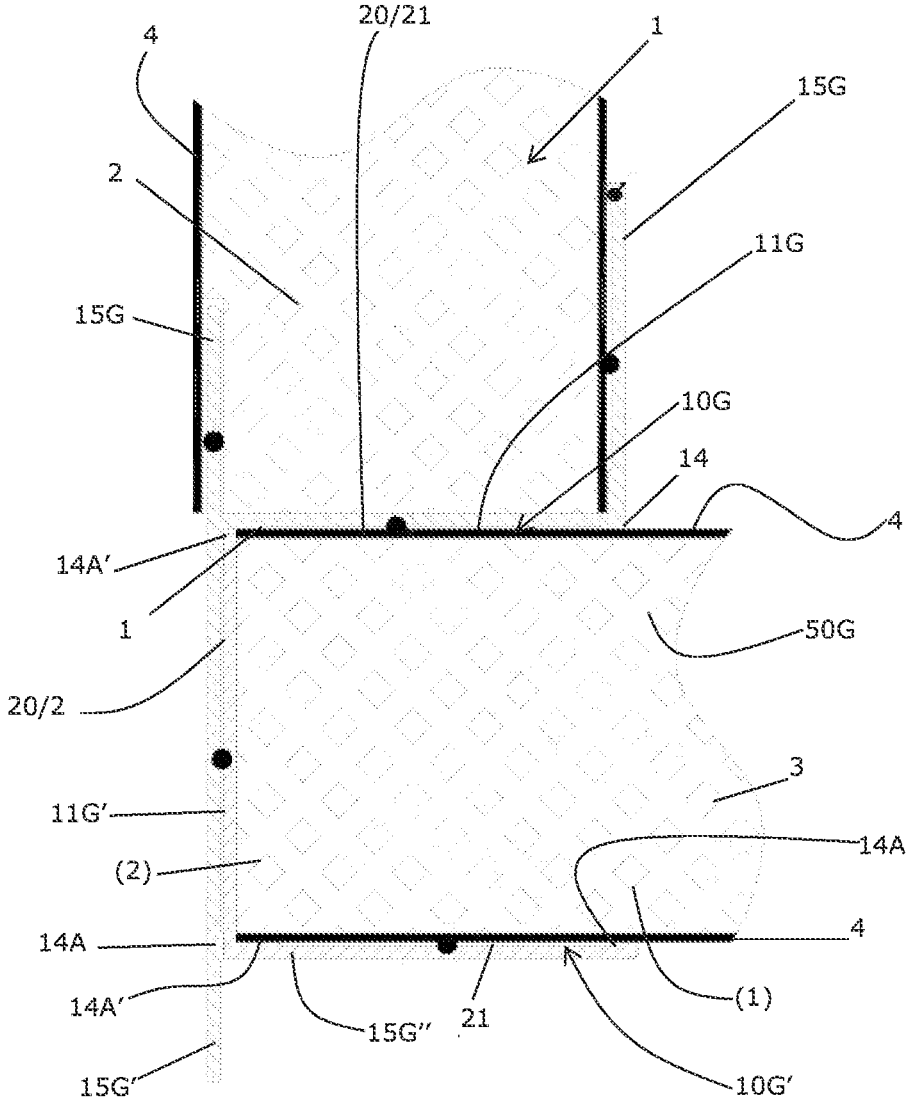
FIG. 10 is a schematic cross-sectional view of connectors and a connection between a wall panel and a floor panel which includes those connectors, according to further embodiments of the invention.

Shown in FIG. 10 is another connection, which includes an alternative connector 10G, in accordance with a preferred embodiment of the invention. In this connection, the panel 1 is upright and the lower edge 2 is secured to edge 2 of a like panel 1 defining the component, 50G, to which the upright panel 1 is connected. The horizontal panel may be a floor panel and the upright panel 1 a wall panel. The connector 10G comprises a web portion 11G, received between the upright panel lower end and the upper skin 4 of the horizontal panel 50G, laterally inner flange portion 15G configured, and secured to the laterally inner skin 4 of the upright panel 1, in the same manner as the laterally inner flange portion 15E or 15F. The connector 10G further comprises a laterally outer flange portion 15G which is configured, and secured to the laterally outer skin 4 of the upright panel, in the same manner as the laterally outer flange 15E shown in FIG. 8. The web 11G is configured with laterally opposed downwardly projecting spacers 14 received against the upper skin 4, whereby a void 21 is defined between the web lower face and upper skin upper face, those faces being bonded by adhesive 20 received in that void 21. Similarly, the further flange portion is configured at a proximal end thereof with a spacer 14A' at a distal end thereof with a spacer 14A such that a cavity is defined between the laterally inner face of flange portion 15G' and laterally outer face of web 11G' which it faces are bonded by adhesive 20 applied in the void 21 thus defined.

The connector 10G comprises an additional flange portion 15G' which projects downwardly from the laterally outer end/edge of the web 11G so as to overlap the end 2 of the horizontal panel 50G. The additional flange portion 15G' can function as a drip or drainage line/bridge in a manner consistent with the additional flange portion 15E in the connection shown in FIG. 8.

The connection shown in FIG. 10 includes an additional connector 10G' which comprises an upright web 11G' received against the end surface of the substrate 3 of the horizontal panel 50G, so as to lie between that surface and the flange 15G' overlapping the end of the horizontal panel 50G. The further connector 10G' additionally comprises a flange 15G" which projects from lower end/edge of the web 11G', perpendicular to that web, so as to be received against the lower skin 4 of panel 50G. The flange 15G" is configured at the distal end/edge thereof with a spacer 14A, and at a proximal end/edge thereof with a spacer 14A, such that there is defined a void 21 between an upper face of flange 15G" and lower face of lower skin 4, those faces being bonded by adhesive 20 applied in that void.

In the arrangement shown in FIG. 10, the horizontal panel can be considered a panel "1", in that it directs to the skins 4 thereof loading exerted on that panel by the upright panel. More particularly, compressive sideways loading exerted by additional flange portion 15G' on an upper side portion of the horizontal panel (through distal end of the web 11G') is transferred into the end face of the upper skin 4 by that web at its distal end and into the upper/outer side face of that skin by the web portion 11G and adhesive which bonds it. Laterally outward loading, exerted by the upright panel through the additional flange portion 15G' (via the bond between that flange portion 15G' and the web 11G', is transferred to the lower flange 15G" and thus, by shear through the adhesive bonding that flange to the lower skin 4, into the lower skin 4.

Figure 11:
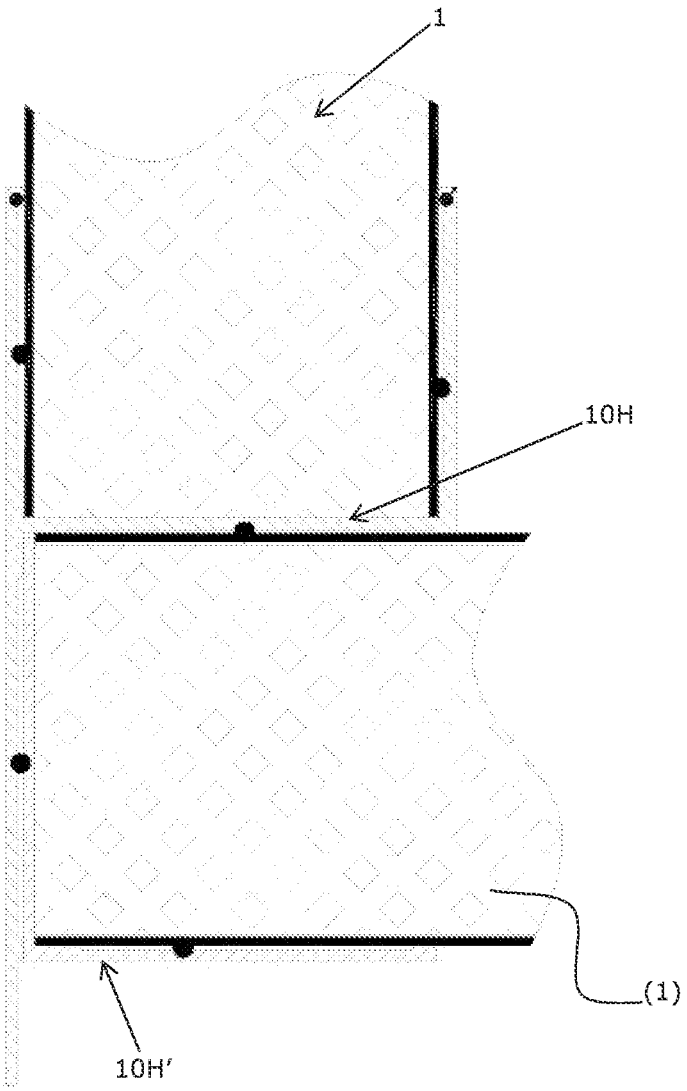
FIG. 11 is a schematic cross-sectional view of connectors and a connection between a wall panel and a floor panel which includes those connectors, according to further embodiments of the invention.

Shown in FIG. 11 is another connection, which includes an alternative connector 10H, in accordance with a preferred embodiment of the invention. The connector 10H and the connection of which it forms a part are similar to the connector 10G and connection of which that connector forms a part, the former differing from the latter in the same way that the connector/connection shown in FIG. 9 differs from the connector/connection shown in FIG. 8. The additional connector, 10H', is configured, functions, and connects to the end of the horizontal panel 1, in exactly the same manner as the connector 10G'.

Figure 12:
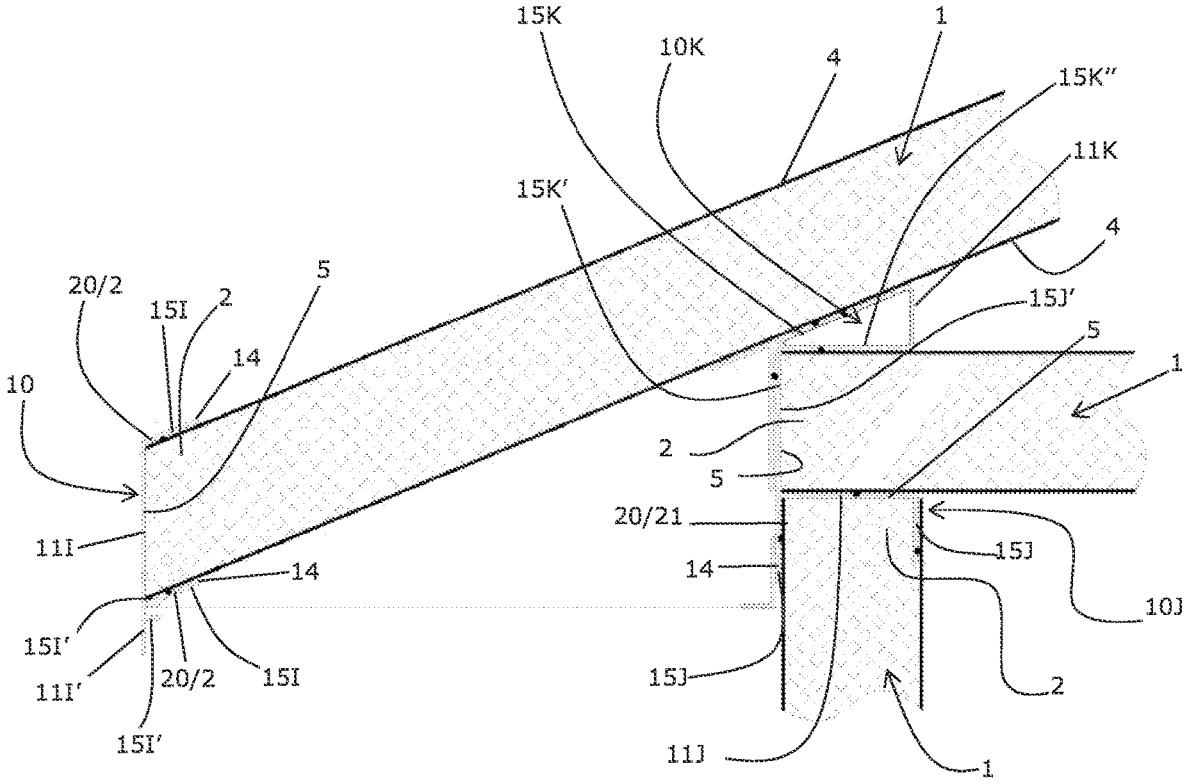
FIG. 12 is a schematic cross-sectional view of an assembly comprising a roof panel, ceiling panel, wall panel and soffit connection bracket, and respective connections between each of those components and another of those components, the connections including respective connectors, according to further embodiments of the invention.

Shown in FIG. 12 are other connections, each of which includes a respective alternative connector, according to preferred embodiments of the invention, as described below.

One of the connectors shown in FIG. 12 comprises connector 10I, which forms part of a connection between end 2 of a diagonal panel 1 and a bracket 50I defining a component loads from which are transferred to skins 4 of panel 1 by the connection. The bracket 50I will be described in further detail shortly.

The diagonal panel 1 (to the outer end of which the connector 10I is secured) is a roof panel a portion of which cantilevers (as illustrated) to define an eave. The connector 10I comprises a web 11I a laterally inner face of which is received against the end face of the inclined panel 1 at the edge 2, and opposed upper and lower flange portions 15I projecting from upper and lower ends, respectively of the web 11I to be received against upper and lower skins 4 of the inclined panel 1. The flange portions 15I are angled with respect to the (upright) web 11I to the same extent that the outer surfaces of the skins 4 are angled with respect to the (upright) end face 5 of the panel 1. The flange portions 15I' are configured at distal ends thereof with spacers 14, resulting in a void 21 to receive the adhesive 20 bonding the flange portions 15I to the upper and lower skins 4.

The connector 10I comprises, in addition to web portion 11I, an additional web portion 11I' the web portions 11I and 11I' a being defined by a single web of the connector 10I. The web portion 11I' projects downwardly from the lower end of the web portion 11I and defines a drip or drainage line/bridge along which water running down the laterally outer face of the connector, defined by the web, is precluded from ingressing into the connection.

The connector 10I further comprises additional flange portions 15I' which project laterally inwardly from, and perpendicular to, the web, the additional flange portions 15I' being arranged below the lower flange portion 15I. The flange portion 15I' and that portion of the web from which they project define a laterally inwardly opening cavity which receives a laterally outer end of the soffit connection bracket 50I. The faces of the cavity defined by the flange portions 15I' can, if appropriate, be bonded to upper and lower faces of the bracket 50I. Loading exerted horizontally against the web 11I by the soffit connection bracket 50I (whether laterally outward or laterally inward) will be transferred by the connector 10I to the inclined panel 1 and directed to the skins thereof via the web and flange portions 15I.

The connector 10I, advantageously, defines a cap received over the panel edge and concealing the end face 5, contributing to aesthetics.

Another of the connectors shown in FIG. 12 comprises connector 10J, which forms part of a connection between an upper end of an upright outer wall panel 1 and a laterally outer end/edge of a ceiling panel 1 atop that upper end/edge. In the example shown, the wall panel 1 is engaged with the laterally inner end of the bracket 50I, that bracket transferring loads laterally between the upper end of wall panel 1 and the overhanging end of the roof panel 1 atop that wall panel. The connector 10J comprises a web portion 11J received between the wall panel upper end and the lower side of the ceiling panel end, and flange portions 15J projecting perpendicular to and downwardly from laterally outer edges/ends of the web portion 11J. The laterally inner flange portion 15J connects with the upright panel 1 in the same manner as the right-hand flange 15B in the arrangement shown in FIG. 4, and is of the same form as that flange portion 15B, being bonded within a slot as described previously. The laterally outer flange portion 15J is received against a laterally outer face of the outer skin of upright panel 1 and bonded thereto by adhesive 20 in void 21. The connector 10J further comprises additional flange portion 15J' which projects upwardly from the laterally outer end of the web 11J and overlaps end face 5 at the edge of the horizontal panel 1. The connector 10J includes laterally inner and outer spacers 14 at opposite edges of the web portion 11J, whereby there is defined a cavity 21 which receives adhesive 20 bonding the upper face of the web 11J to the face of the lower skin 4 of horizontal panel 1.

Weight loading exerted by the horizontal panel 1 on the upper end of upright panel 1 is directed, via the web 11J, to the flanges 15.1 and thence to the skins 4 of the upright panel 1 through the bonds between those flanges and skins, as well as to the laterally outer skin 4 of the upright panel by abutment between the web 11J and upper end face of that outer skin. Uplift loading exerted (via the ceiling panel 1) by the roof on the wall panel 1 is directed to the flanges 15J and thence to the skins 4 of the upright panel 1 through the bonds between those flanges and skins.

Another of the connectors shown in FIG. 12 comprises connector 10K, which forms part of a connection between the roof panel 1 and the ceiling panel 1. The connector 10K comprises an inclined upper flange 15K an upper face of which is received against and bonded to the face of the lower skin 4 of the inclined panel 1, via adhesive 20 received in a void 21 defined between the bonded faces owing to spacers 14 of the connector 10K arranged at lateral ends/edges of the inclined flange 15K. The connector 10K additionally comprises a further flange 15K' arranged between the laterally inner and outer ends/edges of flange 15K and projecting downwardly from that flange so as to overlap the end of the horizontal panel 1 (and the flange portion 15J' received against the end face 5 of that horizontal panel). Spacers 14 are arranged at proximal and distal ends of the flange 15K' whereby defined between adjacent faces of the flange 15K' is a void 21 which contains adhesive 20 bonding those faces together. The connector 10K additionally comprises a further flange portion 15K" which projects laterally inwardly from the upper end/edge of flange portion 15K' so as to be received against the upper skin 4 of the horizontal panel. The flange portion 15K" is configured at laterally inner and outer ends/edges thereof with spacers 14 whereby defined between the lower face of the flange portion 15K' and the upper face of the horizontal panel upper skin 4 is a void 21 which contains adhesive bonding those faces together. The connector 10K also comprises a brace via which the upper/laterally inner distal end/edge of inclined flange 15K is supported by the flange portion 15K" and thus the horizontal panel 1 against which that flange portion is received. In this particular example, the brace is defined by a web portion 11K extending between the laterally inner end of flange portion 15K" and the laterally inner/upper end/edge of flange portion 15K. The web portion 11K, flange 15K and flange portion 15K" define a wedge complementary to the convergent void defined by the roof panel lower face and ceiling panel upper face, which wedge is hollow and thus, advantageously, made of less material than if it were solid.

Figure 13:
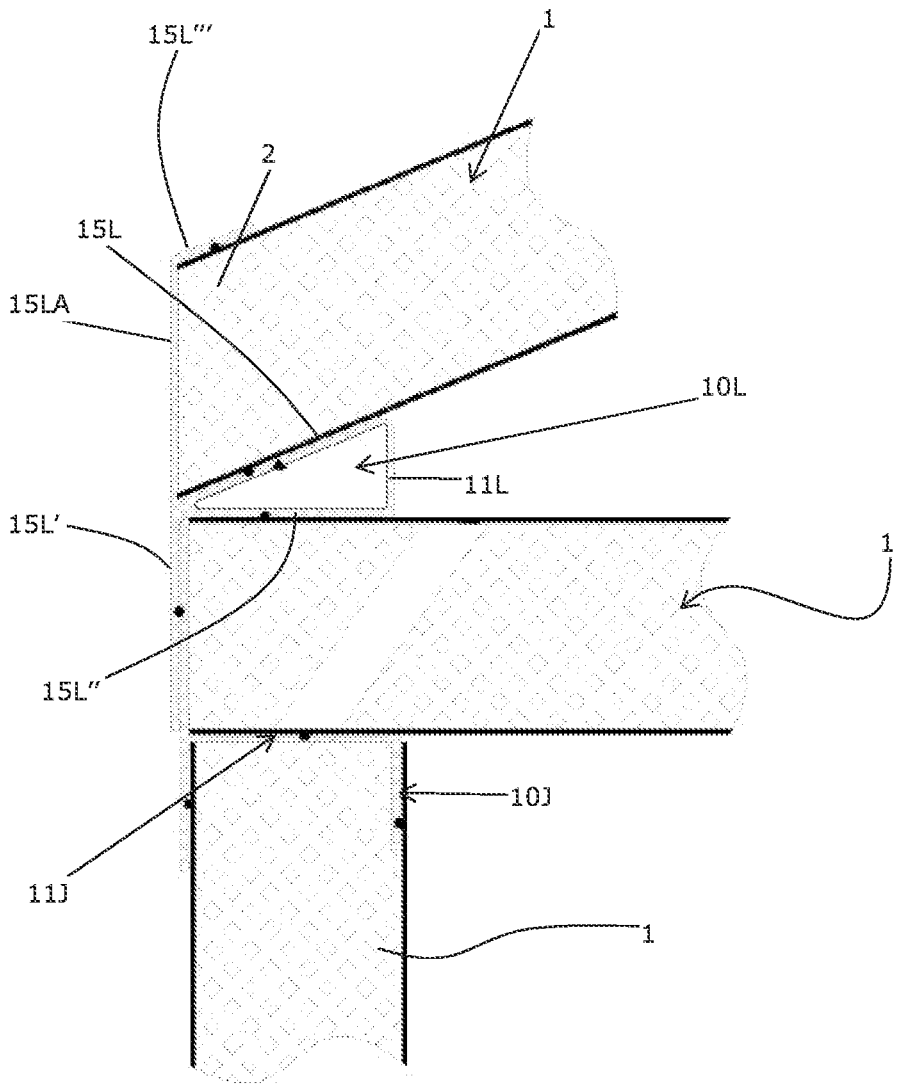
FIG. 13 is a schematic cross-sectional view of an assembly comprising a roof panel, ceiling panel and wall panel and connections therebetween, which include connectors, according to further embodiments of the invention.

Shown in FIG. 13 is an assembly which likewise comprises wall, ceiling and roof panels 1 but in which the end of the roof panel 1 does not project laterally outwardly/downwardly to define an eave. The assembly includes connector 10L, according to another embodiment of the invention, which interconnects the wall and ceiling panels 1 in exactly the same way as the connector 10K but which connects to roof panel 1 in a manner consistent with the connector 10I. More particularly, the connector 10L comprises a web portion 11L, corresponding to the web portion 11K, a flange 15L, which corresponds to the portion of the flange 15K projecting laterally inward from the upper end of flange portion 15K', a flange 15L', which corresponds to the flange 15K', a flange portion 15L', which corresponds to the flange portion 15K', a flange portion 15L', which corresponds to the flange portion 15K", a web portion 15LA, which corresponds to the web portion 11I, and an upper flange portion 15L'", which corresponds to the upper flange portion 15I.

The assembly shown in FIG. 13 includes connector 10J, which interconnects the wall and ceiling panels 1 in exactly the same manner as in the assembly of FIG. 12 and engages the connector 10L in exactly the same manner as it engages the connector 10K.

Figure 14:
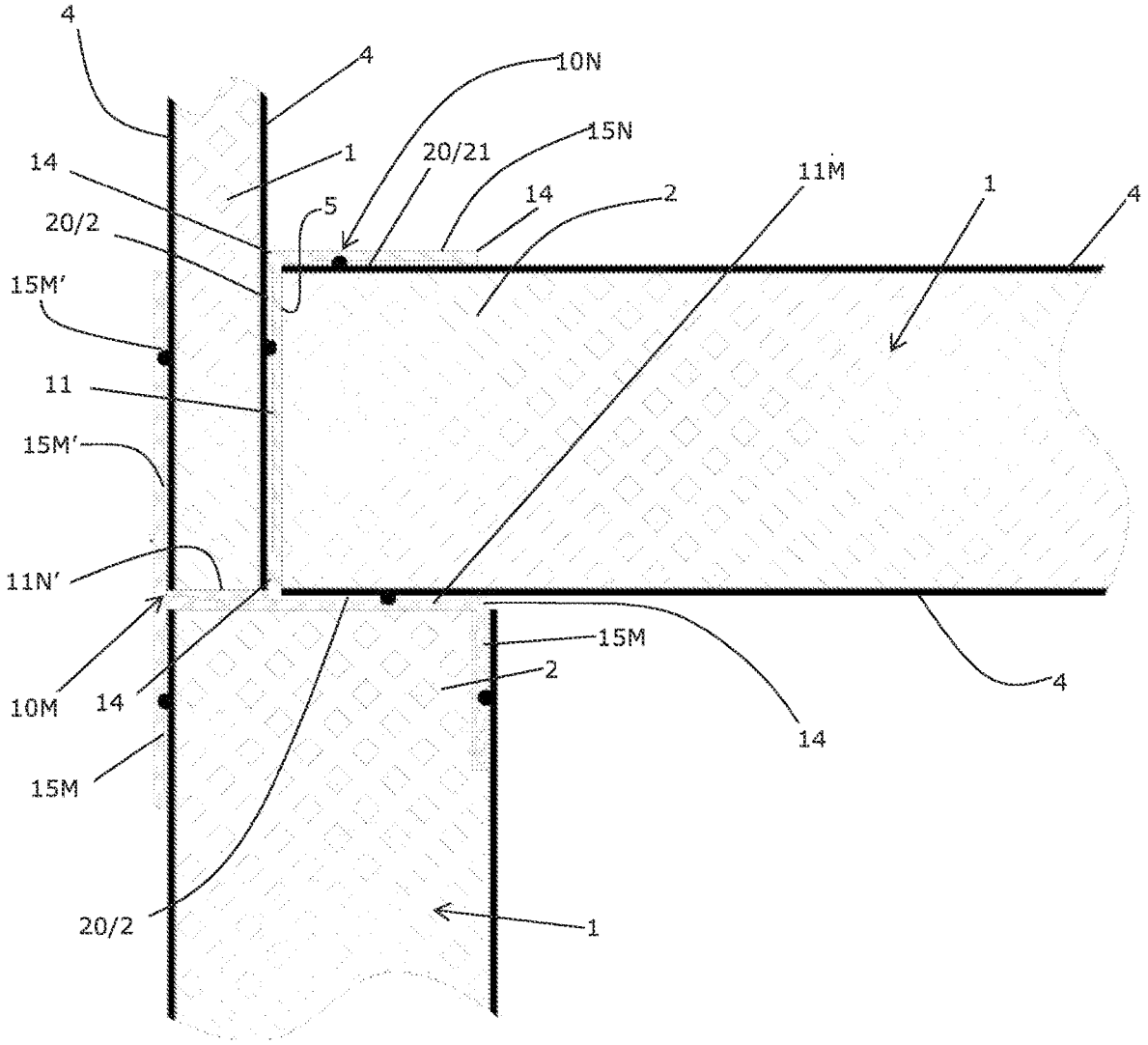
FIG. 14 is a schematic cross-sectional view of an assembly comprising a gable roof plate or panel, wall panel and gable panel and connections therebetween, which include connectors, according to further embodiments of the invention.

Shown in FIG. 14 is an assembly including alternative connectors and connections in accordance with preferred embodiments of the invention, the assembly comprising upright wall panel 1, a horizontal roof or ceiling panel 1, an edge/end of which is supported atop the upright wall panel 1, and a gable panel 1, also supported atop the wall panel 1, a lower end of which gable panel overlaps the end of the horizontal panel 1.

One of the connectors in the assembly of FIG. 14 is connector 10M, which interconnects the upper end of upright panel 1 to the lower skin 4 of the horizontal panel and to the outer skin 4 of the gable panel 1. The connector 10M comprises a web portion 11M and flange portions 15M, which are configured, and connect to the wall panel upper end, in the same manner as the web portion 11J and flange portions 15J, respectively. The connector 10M additionally comprises a further flange portion 15M', configured in the same form as the flange portion 15F as shown in FIG. 9 and secured to the laterally outer skin of the gable panel 1 in the same way as the flange portion 15F is secured to the laterally outer skin shown in FIG. 9. The web portion 11M is configured at opposite lateral ends thereof with spacers 14 owing to the laterally inner one of which there is defined between opposed faces of the web portion 11M and horizontal panel lower skin 4 a void 21 containing adhesive 20 bonding those faces together. The connector 10M in this particular example is identical in form to the connector 10J.

The other of the connectors in the assembly of FIG. 14 is connector 10N, which comprises a web portion 11N received against the end face 5 of horizontal panel 1 and a flange portion 10N extending laterally inwardly from an upper end of that web portion. The web portion 11N is configured at opposite lateral ends thereof with spacers 14 whereby there is defined between opposed faces of the web portion 11N and the gable panel laterally inner skin 4 a void 21 containing adhesive 20 bonding those faces together. The flange portion 10N is configured at its proximal and distal ends with spacers 14 whereby there is defined between opposed faces of the flange portion 10N and horizontal panel upper skin 4 a void 21 containing adhesive 20 bonding those faces together. The connector 10N further comprises a further web portion 11N', an upper face of which is received against the lower end/edge face of the gable panel 1, in a manner such that it abuts the end faces of the skins 4 of that panel, and a lower face of which is received against web portion 11M of the connector 10M. The laterally outer/distal end/edge of the web portion 11N' is configured with a rebate complementary to the laterally outer spacer 14 of the web portion 11M such that the web portion 11N' and 11M mate together, and together define a two-piece connector embodying the invention.

Figure 15:
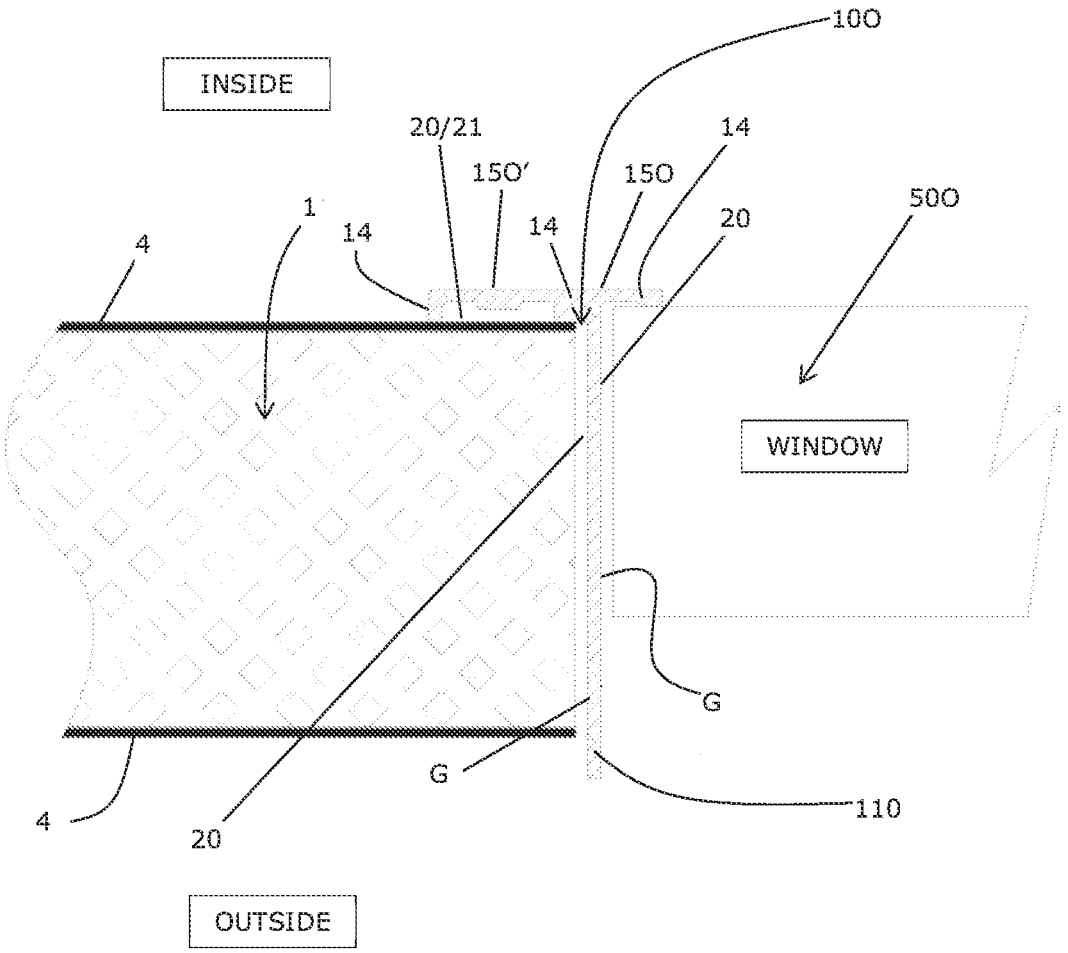
FIG. 15 is a schematic cross-sectional view of a connector and a connection between a wall panel and window pane which includes that connector, according to further embodiments of the invention.

Shown in FIG. 15 is a connection between the end face 5 of upright end/edge 2 of panel 1 and a window pane (specifically an upright edge thereof), defining the structural component, 50O, to which the panel 1 is connected, the connection being effected via a connector 10O, in accordance with another embodiment of the present invention.

In this embodiment, the connector 10O defines a side mount frame, or a side member of a mount frame, for the pane. The connector 10O has a web portion 11O, which is received between the opposed end faces of the edges of the window pane 50O and panel 1, and may be secured to either or each of those faces via adhesive 20 in a respective gap G between it and that face. The connector 10O includes a flange portion 15O projecting from an inner upright edge of the web 10O and perpendicular to that web, the flange portion 15O being configured at its distal end/edge with a spacer 14 received against the inner upright face of the pane 50O, whereby defined between that face and a face of the flange portion 15O opposing it is a void 21 containing adhesive 20 bonding the two faces together (the material from which the window pane is made being bondable by the adhesive 20). The connector 10O further comprises a further flange portion 15O' projecting from inner upright end/edge of web 10O and perpendicular to that web, in a direction opposite to the flange portion 15O, the flange portion 15O' being configured at its distal end/edge with a spacer 14 received against the outer face of the inner skin 4 of the panel 1, whereby defined between the two faces is a void 21 containing adhesive 20 bonding the two faces together.

Figure 16:
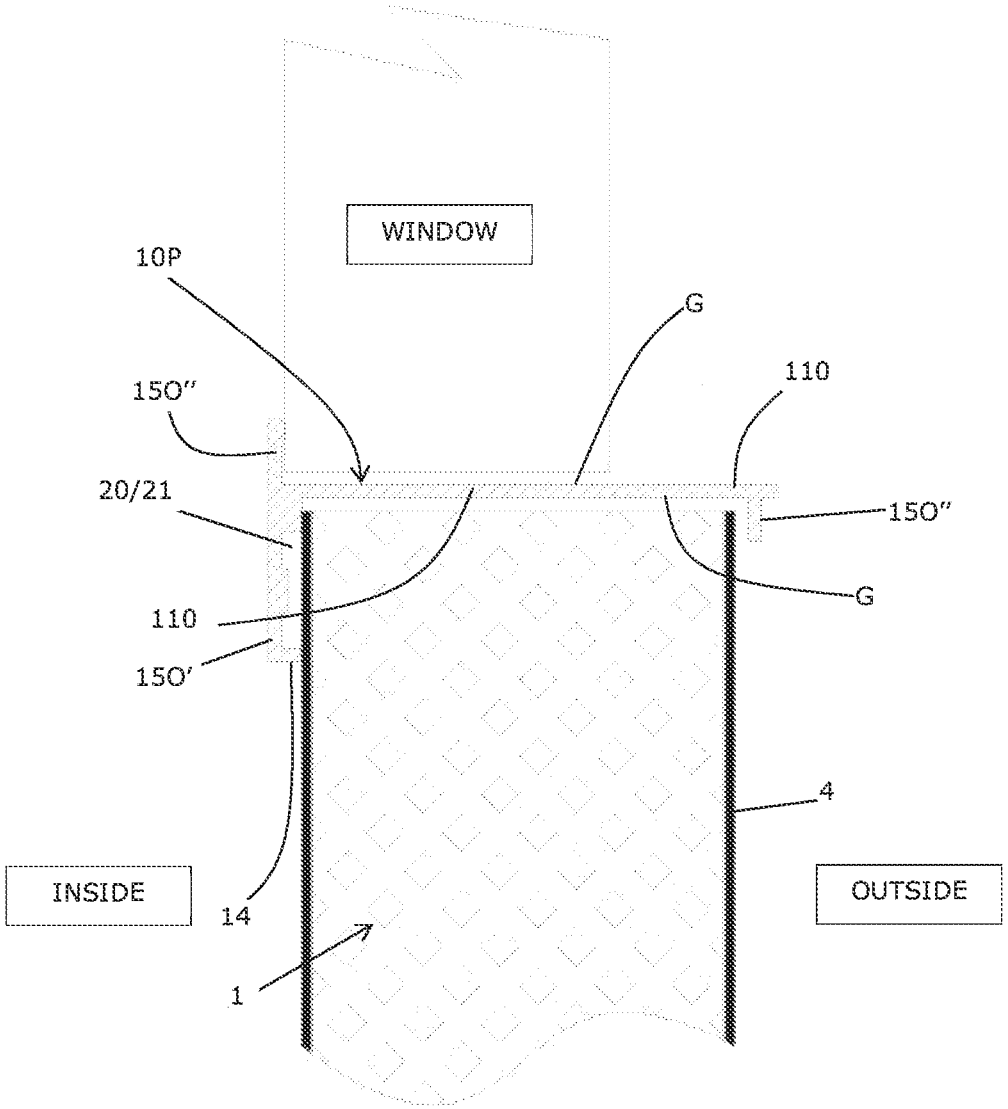
FIG. 16 is a schematic cross-sectional view of a connector and a connection between a wall panel and window pane which includes that connector, according to further embodiments of the invention.

Shown in FIG. 16 is a connection between the end face 5 of a horizontal edge 2 of an upright panel 1 and a lower end/edge of window pane 50O, to which the panel 1 is connected, the connection being effected via a connector 10P, in accordance with an embodiment of the present invention.

The connector 10P defines a bottom mount frame, or a bottom member of a mount frame, for the pane; in the latter case, both that connector and the connector 10O may be interconnected so as to define side and bottom members, respectively of a single said mount frame. The connector 10P is identical in cross-section to connector 10O with the exception that it further includes an additional flange portion 15O" projecting from a distal end portion of web 11O and perpendicular to that web portion, to be received over an upper portion of the outer skin 4 of panel 1, and which may be secured to that portion via adhesive 20 between it and that portion. The web portion 11O of the connector 10P is received between the opposed horizontal end faces of the edges of the window pane and panel, and may be secured to either or each of those face via adhesive 20 in a respective gap G between it and that face. The spacer 14 with which the distal end/edge of flange portion 15O of the connector 10P is configured is received against a lower portion of the inner upright face of the pane 50O, whereby defined between that face and the face of the flange portion 15O opposing it is a void 21 containing adhesive 20 bonding the two faces together. The spacer 14 with which the distal end/edge of flange portion 15O' of the connector 10P is configured is received against an upper portion of the face of inside skin 4 of panel 1, whereby defined between that face and the face of the flange portion 15O' opposing it is a void 21 containing adhesive 20 bonding the two faces together.

Figure 17:
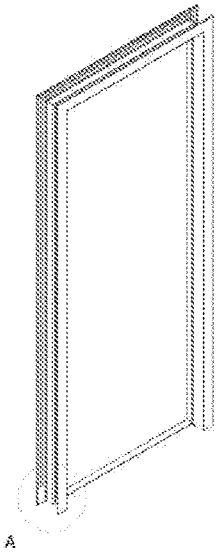
FIG. 17 are perspective views and a schematic cross-sectional view of a two-part connector to form part of a connection between a panel and a door.
Figure 17:
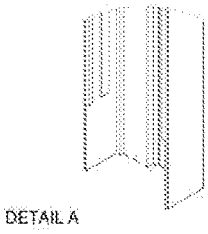
Figure 17:
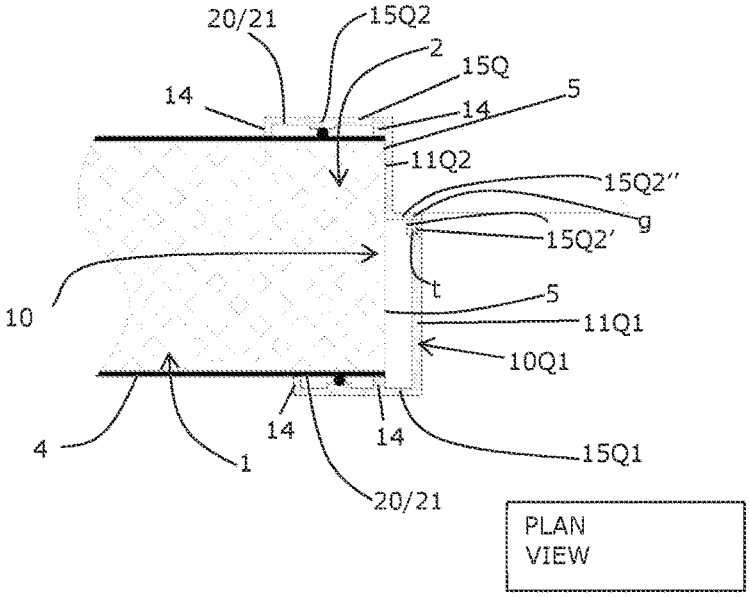

Shown in FIG. 17 is part of a connection, between side edge 2 of upright panel 1 and a structural component, comprising another connector 10Q in accordance with a preferred embodiment of the invention, the structural component in this example being a hinge (not shown) via which a door (also not shown) is supported from connector 10Q. The connector 10Q defines a door jamb 10A/10B and comprises connector pieces 10Q1 and 10Q2 interconnectable via tongue t and groove g sections with which they are configured (i.e. is not of unitary construction). Piece 10Q1 comprises a web portion 11Q1, arranged so as to be received adjacent and extend parallel to the panel end face 5, and a flange portion 15Q1, projecting from a proximal end/edge of the web portion 11Q1 and perpendicular to the web portion 11Q1, and being configured with spacers 14 arranged so as to be received against the outer face of one of the skins 4 of the panel 1, whereby defined between that face and a face of the flange portion 15Q1 is a void 21 containing adhesive 20 bonding the two faces together. The tongue section t is arranged at a distal end/edge of the web portion 11Q1. Piece 10Q2 comprises a web portion 10Q2, received against face 5, and a flange portion 15Q2, projecting therefrom and perpendicular thereto, the flange portion 15Q2 being configured with spacers 14 arranged so as to be received against the outer face of that skin, whereby defined between that face and a face of the flange portion 15Q2 is a void 21 containing adhesive 20 bonding the two faces together. Portion 10Q2 further includes a further flange portion 15Q2' extending from portion 11Q2 from an opposite end thereof to that from which the flange portion 15Q2 extends, and in an opposite direction to that flange portion, and opposed parallel further flange portions 15Q2" extending from a distal end of flange portion 15Q2' and defining the groove g. The tongue t may be secured in the groove g via adhesive 20.

The connector/connection in each preferred embodiment of the invention described herein with reference to the accompanying drawings, advantageously, engages a/each skin of the panel to which it is applied so as to direct, to that skin, loading exerted on the panel by the said component connected to the panel via the connector/connection (the loading including or consisting of loads through the connector itself), the skin 4 being braced against distortion/buckling by the substrate 3 and being made of a material which is stronger than the substrate material and thus, unlike the substrate/substrate material, being apt to bear that loading—be it compressive, tensile or shear (translation or torsional) loading. In transferring loads to at least one lateral side of the panel, the connection/connector may function in the nature of a lintel.

The/each skin 4 in each composite panel described herein with reference to the drawings can be satisfactorily braced against buckling under compressive loading on that panel in any of the various applications to which it is suited. The substrate 3 in each panel affords the panel overall sufficient thickness such that the panel itself will not to buckle under compressive loading on it in applications to which it is suited.

Moreover, the substrate 3 confers to the panel a thickness sufficient to afford the panel a high section modulus and/or second moment of area and corresponding high load-bearing capacity whilst, given its low density as compared with a substrate of the same material if continuous/solid throughout, conferring relatively little weight to the panel. Furthermore, the strong skins defining the outer sides of the panel afford the panel a sufficiently high plastic and/or elastic section modulus for any of the various applications to which the panel is suited. The strength of the skins and thickness of the panel together confer to the panel a relatively high racking load bearing capacity.

The microstructure of the substrate material in the preferred embodiments described and illustrated herein, given its porosity/the distribution of interstices therethroughout, contributes to the thermal insulation properties of the panel, rendering the panel especially suitable to applications in hot or cold climates, particularly such applications in which it forms a barrier between a building interior and exterior, and/or contributes to sound attenuation properties of the panel.

Figure 18A:
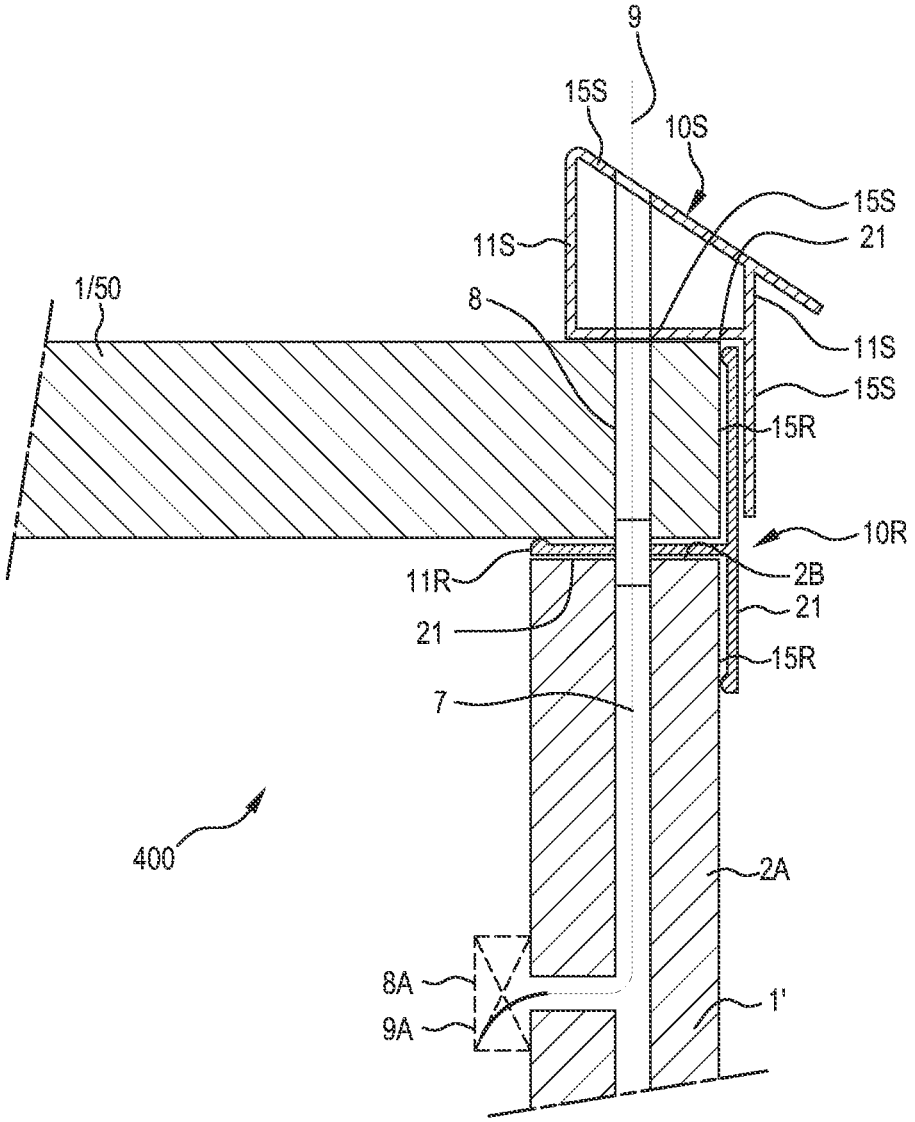
FIG. 18A is a schematic cross-sectional elevational view of an assembly, formed at an intermediate stage in the formation of an assembly similar to that shown in FIG. 12, and provision made for installation of services for the building of which the assembly is to form a part.
Figure 18B:
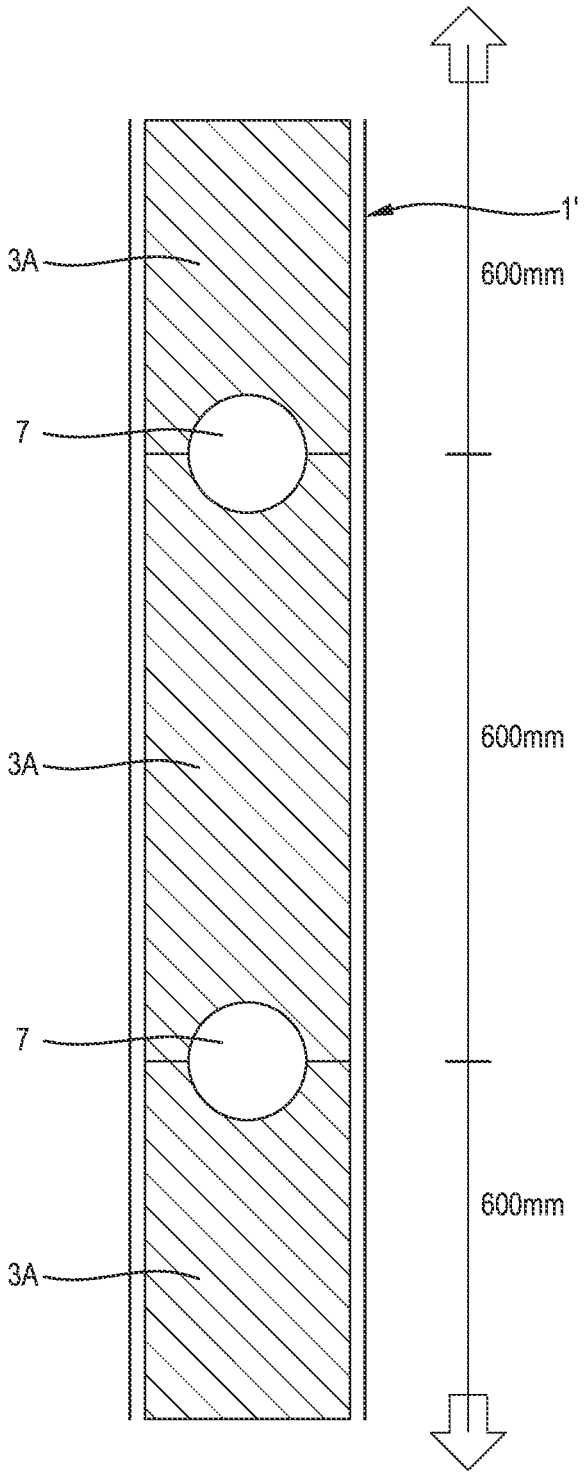
FIG. 18B is a view through Section 1 in FIG. 18A.
Figure 19:
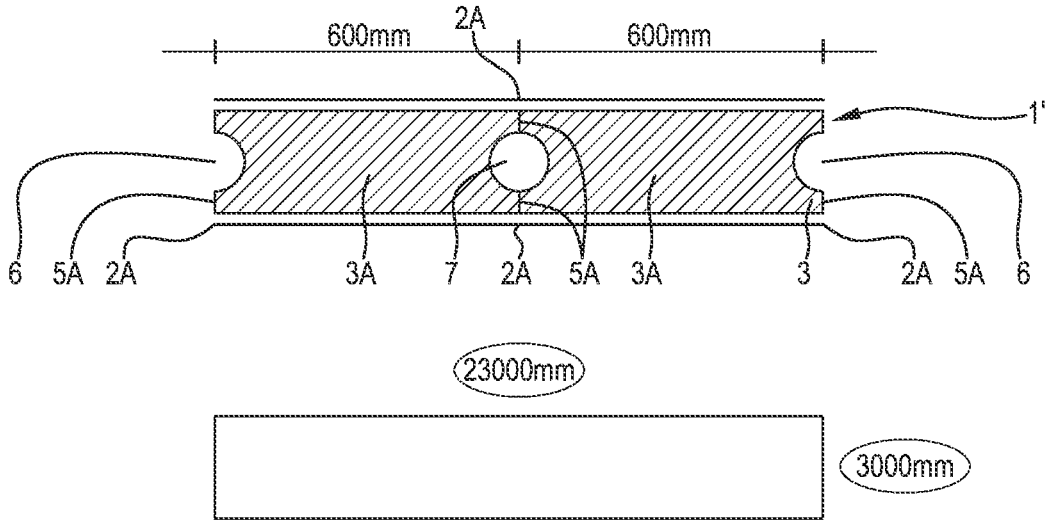
FIG. 19 is an enlarged view of end-to-end arranged panels in the wall shown in FIG. 18B.

Shown in FIGS. 18A, 18B and 19 are details of an assembly comprising a wall panel 1' and roof panel 1, a connector 10R interconnecting them, and a connector 10S via which a roof panel 1 is to be secured to the assembly such that there results an assembly similar to that shown in FIG. 12.

The panel 1', referring to FIG. 19, has the same general composition as the panel 1, comprising rigid substrate 3 and covering 4 (skin) to each side of, and secured (e.g. bonded or fused) to, the substrate 3, each covering 4 being defined by a respective sheet and defining a "skin" of the panel 1', the substrate 3 thus defining a core of the panel 1'. The core 3 comprises core sections 3A arranged end-to-end. The core sections 3A are arranged such that mating end faces 5A at adjacent edges 2A thereof abut. Formed in each edge 2A is a channel 6 which opens laterally outwardly through the face 5A defined by that edge. Each channel 6 opens axially through either or each of the faces 5B defined by respective ones of opposed end edges 2B of the section 3A. The channels 6 in the abutting faces together define a cavity 7 which extends within the core 3 of the panel 1' and opens through at least one of the opposed edges thereof which is transverse to the axis along which the cavity 7 extends. Advantageously, the panel 1' is thus configured for receipt of lines providing services to the building in which the panel 1' is to be used. Preferably, the channels 6 extend the entire length of the end faces 5A in which they are formed, such that the panel 1' can be used in applications requiring that one or more service lines be trained into one of the edges 2B, all the way through the core 3, and out of the other of the edges 2B.

In the method of manufacturing the panel 1' in accordance with the present embodiment of the invention substrate sections 3A are arranged end-to-end whereby an edge 2A of one section and an edge 2A of another are in abutting relation, such that a cavity 7 is defined by the channels 6 with which the edges 2A of the/each pair are configured, and opposite sides of each substrate section 3A are bonded to a respective sheet section 4A, whereby the panel 1' comprises opposed skins 4, each comprising a respective one of the sheets, and a core 3, comprising the end-to-end arranged substrate sections 3A, and either of each of fluid and power is suppliable through the panel via the or each cavity 7.

Figure 20A:
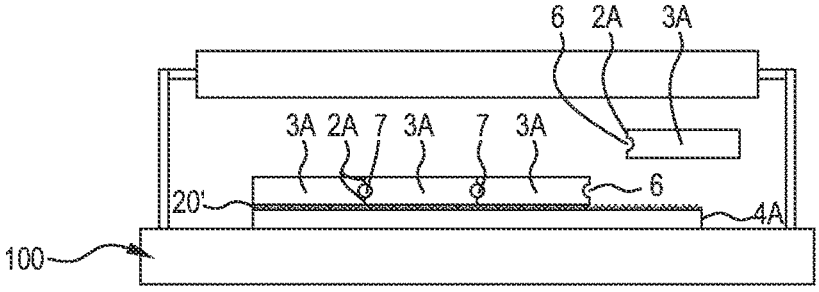
FIGS. 20A to 20D are schematic elevation views showing successive stages of manufacture of a panel according to a preferred embodiment of the present invention.
Figure 20B:
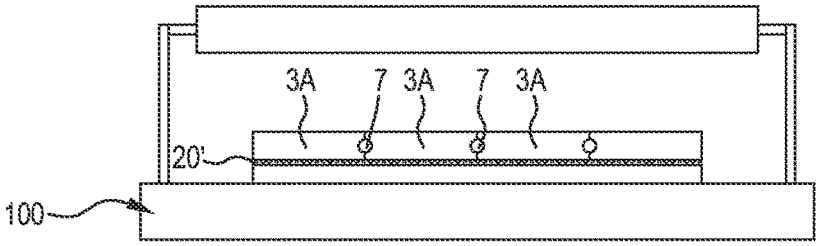
Figure 20C:
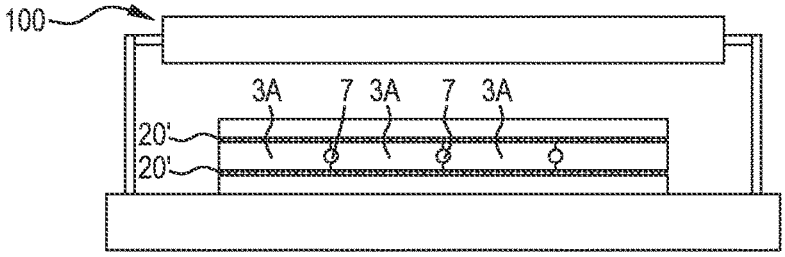

More specifically, referring to FIG. 20A, one of the sheet sections 4A is laid down on a vacuum press 100 and bonding agent 20' (preferably adhesive/glue but possibly, for example, resin) is applied to the exposed surface thereof. Referring also to FIG. 20B, the substrate sections 3A are then laid in end-to-end relation over that surface, whereby the edges 2A abut and the cavities 7 are defined by the channels 6. Referring to FIG. 20C, adhesive is applied to the exposed side surfaces of the sections 3A and/or the other sheet section, and the other sheet section is laid over the substrate sections 3A.

Figure 20D:
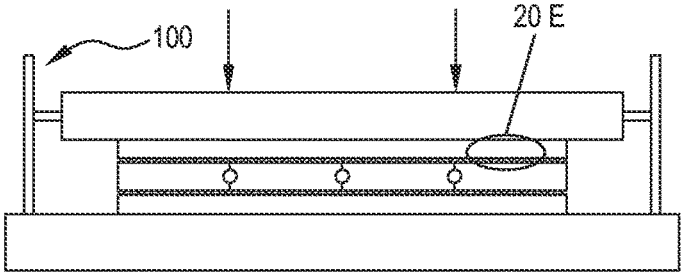
Figure 20E:
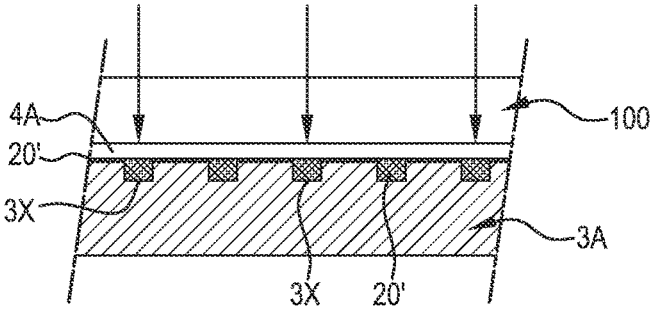
FIG. 20E is a view of Detail E shown in FIG. 20D.

The press 100 is, referring to FIG. 20D, thereafter operated to clamp the sheet sections against the respective sides of the substrate sections 3A/core 3. Referring to FIG. 20E, either or each side of each of the substrate sections 3A and/or a side of the respective sheet section which received is against that side is configured with grooves 3X (not shown), each of which may have a width and depth both of which are 3 mm, such that excess bonding agent 20' flows into and along at least one of the grooves 3X and, should it be present in a sufficient volume, escapes from between the sheet sections, through at least one of the groove ends.

Figure 21A:
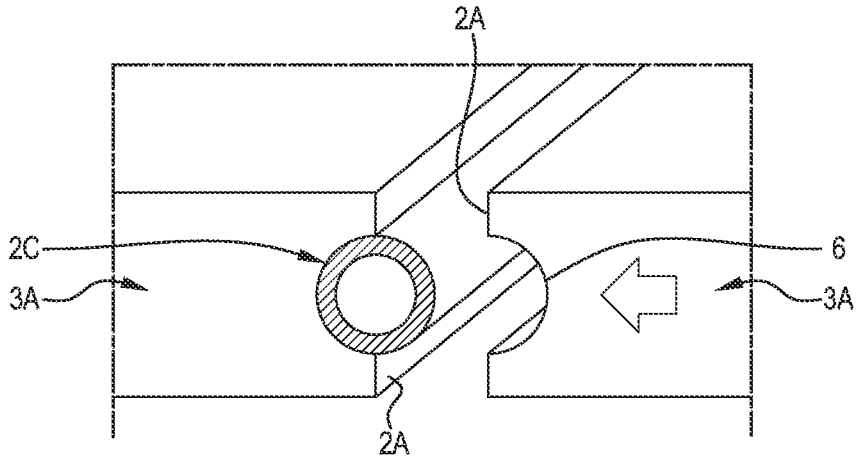
FIGS. 21A and 21B show interposition of a tubular conduit member at/between adjacent edges of end-to-end arranged substrate sections in the manufacture of the panel according to one alternative preferred embodiment of the invention.
Figure 21B:
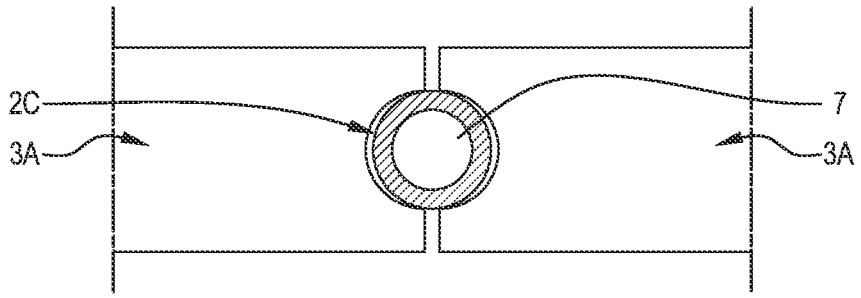
Figure 22A:
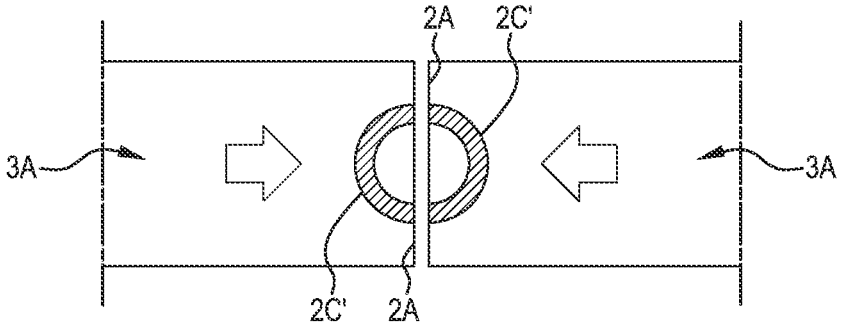
FIGS. 22A and 22B show interposition of mating, laterally outwardly opening, conduit members at/between adjacent edges of end-to-end arranged substrate sections in the manufacture of the panel according to another alternative preferred embodiment of the invention.
Figure 22B:
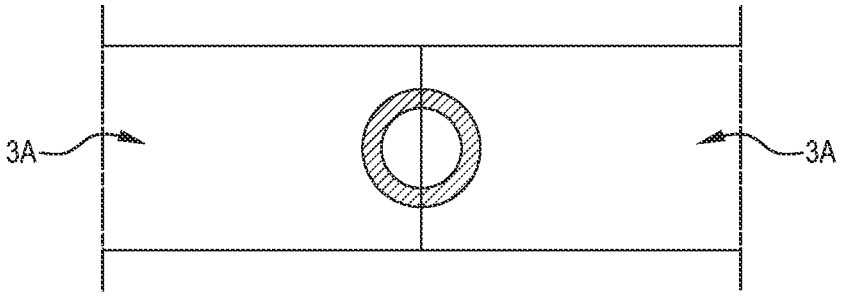
Figure 23:
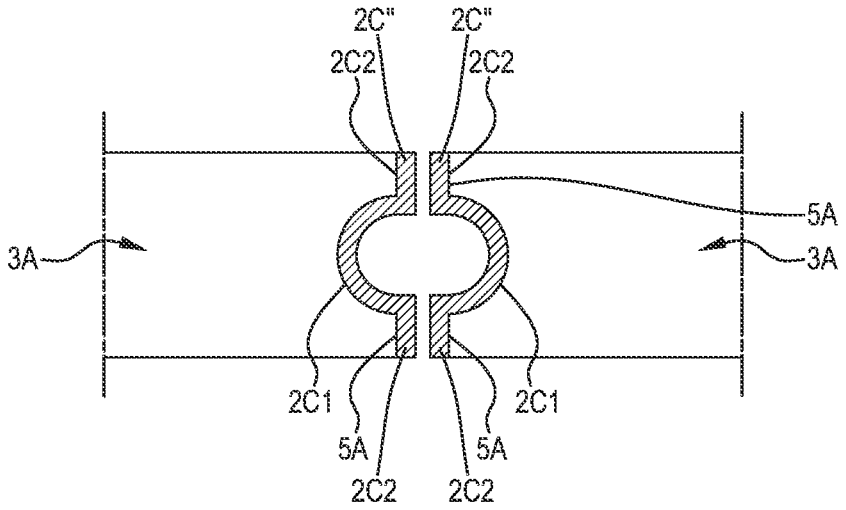
FIG. 23 shows interposition of mating, laterally outwardly opening, conduit members including flange portions at/between adjacent edges of end-to-end arranged substrate sections in the manufacture of the panel according to yet another alternative preferred embodiment of the invention.

Without departure from the invention, referring to FIGS. 21A and 21B, conduit members 2C, such as (preferably cylindrical) tubular members can be interposed between the edges 2A in the/each pair of abutting edges 2A, whereby extending along and forming a close fit within the cavity 7 defined by the channel(s) 6 with which those edges is formed is a conduit through which the fluid/power is suppliable. The conduit members 2C may be so interposed during the end-to-end arranging of the sections 3A, i.e. positioned in the channel 6 at the edge 2A of one section 3A prior to arrangement of a said adjacent section 3A in end-to-end relation therewith, as is shown in FIG. 21A, or instead after arranging of the sections 3A, in which case they will be fed into the respective cavities 7 through ends thereof (each giving rise to an arrangement as shown in FIG. 21B). The conduit members may, referring to FIGS. 22A and 22B, instead of being tubular, be laterally outwardly opening members 2C', such that one can be received against the other whereby the two laterally outwardly opening members mate to define the conduit or a section thereof. In one embodiment, referring to FIG. 23, each of the laterally outwardly opening members 2C" could comprise, in addition to a conduit portion 2C1 which is received in cavity 6, side portions or flanges 22C2 each projecting laterally from a respective one of opposite sides of the conduit portion to be received against a corresponding respective flat side portion of face 5A, thereby locating the laterally outwardly opening member rotationally about the longitudinal axis of the conduit of which that member is to form a part. It will thus be appreciated that the abutment between the edges 2A in a given pair of abutting edges can be indirect, as shown in FIG. 23.

Figure 24:
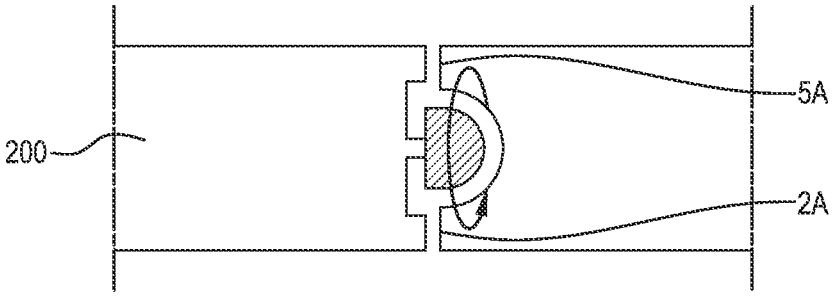
FIG. 24 shows machining an edge of substrate to form a channel therein in the manufacture of a panel/the core thereof according to a preferred embodiment of the invention.
Figure 25A:
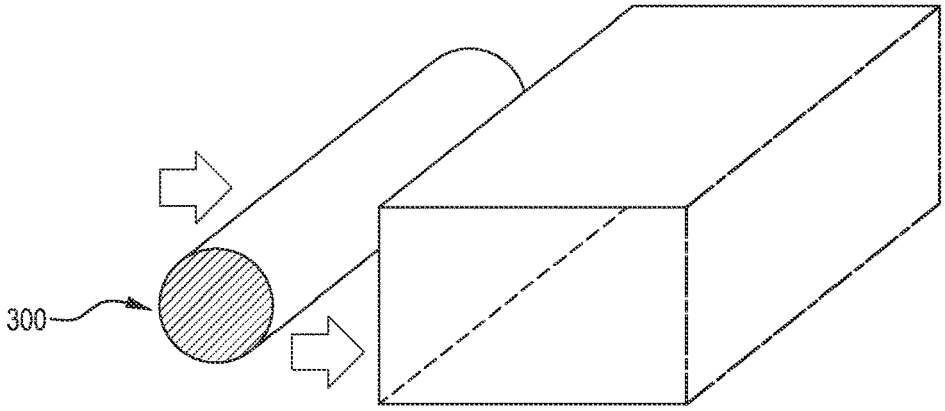
FIGS. 25A to 25C show thermoforming an edge of substrate to form a channel therein in the manufacture of a panel/the core thereof according to another preferred embodiment of the invention.
Figure 25B:
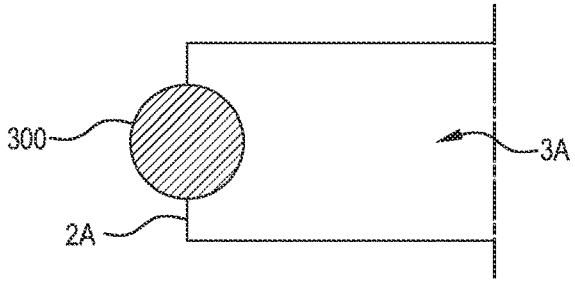
Figure 25C:
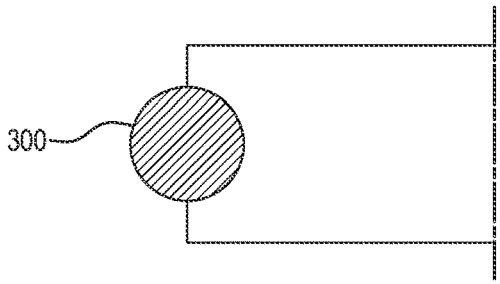

Referring to FIG. 24, each channel 6 can be, for example, milled or routed, using a suitable milling or routing apparatus/router 200, into the respective edge 2A in which it is formed. Alternatively, the channel 6 may be thermoformed. Referring to FIGS. 25A to 25C, it may be impressed or "thermopressed" into the edge 2A by urging a heated elongate member/element, such as a rod or tube 300, arranged parallel to that edge, against the edge, such that the core material at the edge melts and the channel 6 is thus impressed into that edge, the resulting cross-sectional configuration of the channel 6 matching that of the portion of the elongate element received into the core material. Each channel 6 could instead be formed during moulding of the core section 3A.

Figure 26A:
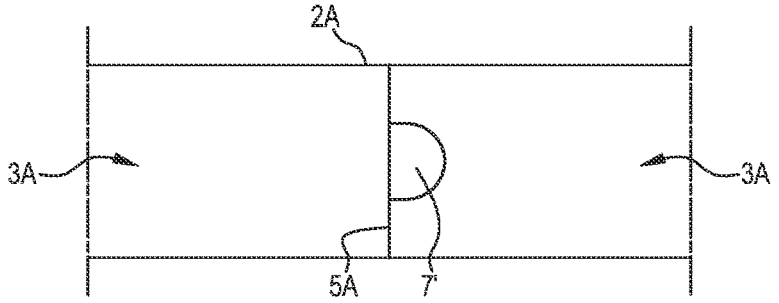
FIGS. 26A to 26D show alternative ways of forming a cavities and conduits at/between adjacent edges of end-to-end arranged substrate sections in the manufacture of the panel according alternative preferred embodiments of the invention.

Also possible without departure from the invention, referring to FIG. 26A, is that only one of the abutting edges 2A in a given pair is configured with a channel 6, in which case the cavity 7' will be bounded at one side thereof by the flat face 5A of the edge 2A not configured with a channel 6.

Figure 26B:
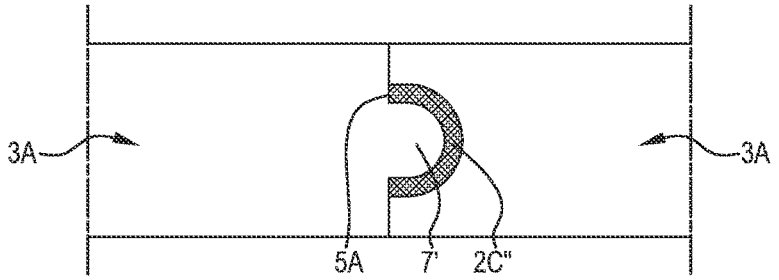

Also possible without departure from the invention, referring to FIG. 26B, is that a laterally outwardly opening member 2C' is received in the channel 6, to abut that face.

Figure 26C:
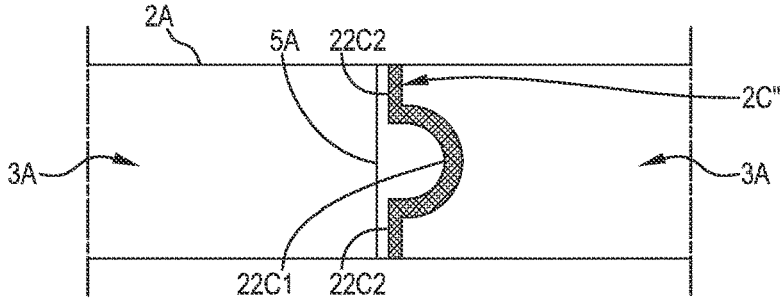

Also possible without departure from the invention, referring to FIG. 26C, is that a laterally outwardly opening member 2C" is received between the edges 2A/substrate sections 3A such that conduit portion 2C1 is received in channel 6, and side portions or flanges 22C2 are received against a corresponding respective flat side portion of face 5A defined by the edge 2A configured with channel 6, thereby locating the laterally outwardly opening member rotationally about the longitudinal axis of the conduit of which that member is to form a part.

Figure 26D:
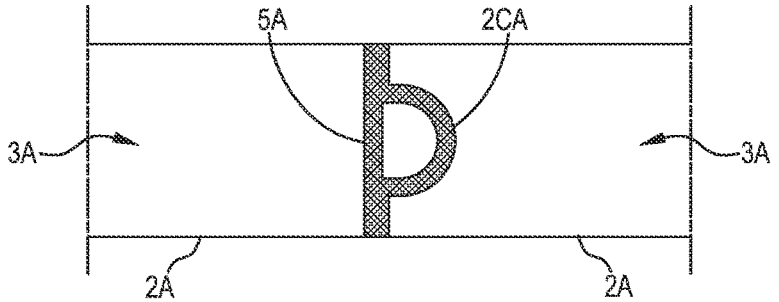

Also possible without departure from the invention, referring to FIG. 26D, is a conduit member 2CA either consisting of a tubular section, having a curved portion of complementary configuration to the channel 6, the same as 2C', and a flat portion integral with that curved portion and arranged to abut the flat face 5A defined by the edge not configured with a channel 6, or comprising that tubular section and side portions or flanges, the same a 22C2, which are received, on one side thereof, against corresponding respective flat side portion of face 5A defined by the edge 2A configured with channel 6, and are received, on the other side thereof, against flat side face 5A defined by the other edge.

The substrate/core 3 of the panel according to each of the embodiments described and illustrated herein is extruded polystyrene foam, such as that which is supplied under the name XPS40 by Lavender CE Pty Ltd in Wacol, Queensland, Australia, details of which are as follows:

| | |
|---|---|
| Product Code | XPS40RTM |
| Colour | Blue |
| Thickness | 95 mm |
| Edge | Square |
| Surface | Planed and grooved |
| Density (minimum) | 40 kg/m$^2$ |
| Compressive Strength | 400 ± 10 kPa |
| Water Absorption | 0.9% |
| Temperature Use Range | −50/+75° C. |
| Fire Classification | B1 (according to GB8624-2012) |
| Thermal Conductivity | 0.025 to 0.030 W/m.K |

The skins/coverings 4 in the panels according to each of the embodiments described and illustrated herein comprises glass-fibre-reinforced plastic, such as that which is supplied under the name LAMILUXplan by the LAMILUX Heinrich Strunz Group in Germany.

Where a given skin 4 is to be exterior and visibly exposed in the building/assembly—e.g., the panel 1 of which it forms a part defines or forms part of an exterior wall of the building/assembly, or defines or forms part of a roof of the building/assembly, or defines or forms part of a floor of the building/assembly—the skin which is visibly exposed and exterior preferably has product details as follows:

| | PRODUCT LAMILUXplan Anti-Slip Polyester Woven Fabric FP Medium (VP ALLG 143/193) smooth/soft sanded backside | |
|---|---|---|
| Property | Typical Value | Test Method |
| | Physical | |
| Thickness of carrier | 2.0 mm | internal: 10-10-012 |
| Total thickness | 2.4 mm | internal: 10-10-012 |
| Weight | 3.1 kg/m$^2$ | internal: 10-10-020 |
| Glass content | 30-34% | internal: 10-10-002 |
| Indentation hardness | 50-60 Barcol | DIN EN 59 |
| | Mechanical | |
| Tensile strength | 85 N/mm$^2$ | DIN EN ISO 527-4/2/2 |
| Tensile elongation | 1.6% | DIN EN ISO 527-4/2/2 |
| Tensile e-modulus | 6.3 kN/mm$^2$ | DIN EN ISO 527-4/2/2 |
| Flexural strength | 90 N/mm$^2$ | DIN EN ISO 14125/WKII |
| Flexural e-modulus | 2.75 kN/mm$^2$ | DIN EN ISO 14125/WKII |
| Impact strength | 45 kJ/m$^2$ | DIN EN ISO 179/2n |

Advantageously, the exposed surface of such skin material is grainy or sandpaper-like, providing (on the/each side of the panel at which this skin material is provided) a (cement) "rendered" appearance and/or, in the case of the skin defining the surface of the floor, affording the floor surface anti-slip characteristics.

Where a given skin 4 is to be interior and visibly exposed in the building/assembly—e.g., the panel 1 of which it forms a part defines or forms part of a wall (interior or exterior) of the building/assembly which bounds (at either or each side thereof) an occupiable interior space or living area, or defines or forms part of a ceiling of the building/assembly—the skin which is exposed and interior preferably has product details as follows:

| | PRODUCT LAMILUXplan Woven Fabric (PMB174-G) smooth/soft sanded backside | |
|---|---|---|
| Property | Typical Value | Test Method |
| | Physical | |
| Thickness | 2.0 mm | internal: 10-10-012 |
| Weight | 2.95 kg/m$^2$ | internal: 10-10-020 |
| Glass content | 30-34% | internal: 10-10-002 |
| Indentation hardness | 50-60 Barcol | DIN EN 59 |
| | Mechanical | |
| Tensile strength | 105 N/mm$^2$ | DIN EN ISO 527-4/2/2 |
| Tensile elongation | 1.5% | DIN EN ISO 527-4/2/2 |
| Tensile e-modulus | 9.3 kN/mm$^2$ | DIN EN ISO 527-4/2/2 |
| Flexural strength | 170 N/mm$^2$ | DIN EN ISO 14125/WKII |
| Flexural e-modulus | 6.65 kN/mm$^2$ | DIN EN ISO 14125/WKII |

Advantageously, the exposed surface of such skin material is matt and relatively smooth, providing (on the/each side of the panel at which this skin material is provided) a "plastered" appearance.

Where a given skin 4 is to be concealed/not visibly exposed in the building/assembly—e.g., the panel 1 of which it forms a part defines or forms part of a roof of the building/assembly, or defines or forms part of a floor of the building/assembly or defines or forms part of a ceiling of the building/assembly—the skin which is concealed/not exposed and (the lower skin in the case of said roof or said floor, and the upper skin in the case of said ceiling), the skin which is concealed/not exposed may have product details as follows:

| | PRODUCT LAMILUXplan HG4000 (MB605/-S) smooth/soft sanded backside | |
|---|---|---|
| Property | Typical Value | Test Method |
| | Physical | |
| Thickness | 2.0 mm | internal: 10-10-012 |
| Weight | 2.8 kg/m$^2$ | internal: 10-10-020 |
| Glass content | 19-23% | internal: 10-10-002 |
| Indentation hardness | 45-55 Barcol | DIN EN 59 |
| | Mechanical | |
| Tensile strength | 65 N/mm$^2$ | DIN EN ISO 527-4/2/2 |
| Tensile elongation | 1.4% | DIN EN ISO 527-4/2/2 |
| Tensile e-modulus | 5.8 kN/mm$^2$ | DIN EN ISO 527-4/2/2 |
| Flexural strength | 110 N/mm$^2$ | DIN EN ISO 14125/WKII |
| Flexural e-modulus | 3.825 kN/mm$^2$ | DIN EN ISO 14125/WKII |
| Impact strength | 36 kJ/m$^2$ | DIN EN ISO 179/2n |

Advantageously, the exposed surface of such skin material is adequate, without affording the panel any particular aesthetic characteristic, such being unnecessary given the skin (on the/each side of the panel at which this skin material is provided) is not seen in the building/assembly.

The adhesive used to secure the skins 4 to the core/substrate 3 is a polyurethane-based adhesive, such as that which is supplied under the name MACROPLAST UK 8101/MACROPLAST UK 5400 by Henkel AG & Co. KGaA in Germany. It will be appreciated the adhesive can vary, and be readily selected by a person according to the materials used for the skin(s) and core/substrate.

Advantageously, the panel can be produced in large sizes. Shown at the bottom of FIG. 19 are suitable maximum height and width dimensions the panel can have in order to be transportable, in a laid-down orientation, by a flatbed truck. A single such panel may, for example, be sized such that a length thereof is up to 23 m and a width/height thereof is up to 3 m. Either or each of the length and width/height dimensions may exceed these values particularly where such transportation is not required.

A particularly advantageous application of the panel 1' is in the arrangement shown in FIG. 18A, which shows an intermediate assembly in the construction of a building, the assembly being configured such that installation of services for the building is facilitated, as described later herein.

The assembly comprises panel 1', to define a wall, or part of a wall, in the building, and a panel 1/50 to define a ceiling, or part of a ceiling, in the building. The panel 1' is connected to the panel 1/50 via a connector 10R, according to a preferred embodiment in the invention, the connector 10R forming part of the connection between the upper end of the upright wall panel 1' and laterally outer end/edge of the ceiling panel 1/50 atop that upper end/edge. The connector 10R comprises a web portion 11R received between the wall panel upper end and lower side of the ceiling panel end, and flange portions 15R projecting in opposite directions from a laterally outer edge/end of the web portion 11R in opposite directions. The lower of the flange portions 15R is received against a laterally outer face of the outer skin of upright panel 1' and bonded thereto by adhesive 20 in a respective void 21, resulting from spacers 14 arranged at proximal and distal ends/edges of the lower flange portion 15R, and the upper of the flange portions 15R overlaps end face 5 at the edge of the horizontal panel 1/50 and is bonded thereto by adhesive 20 in a respective void 21 resulting from spacers 14 arranged at proximal and distal ends/edges of the upper flange portion 15R. The web portion 11J overlaps end face 5A at the upper edge of the panel 1' and is bonded thereto by adhesive 20 in a respective void 21 resulting from spacers 14 arranged at proximal and distal ends/edges of the web portion 11J. The upper face of the web portion 11R is bonded to the lower skin of the ceiling panel 1 by adhesive 20 received in respective void 21 resulting from spacers 14 arranged at proximal and distal ends/edges of the web portion 11R.

Another of the connectors shown in FIG. 18A is connector 105, which is to form part of a connection between a yet-to-be installed sloped roof panel 1 and the ceiling panel 1/50. The connector 10S comprises an inclined upper flange or web 15S an upper face of which is to be received against and bonded to the face of the lower skin 4 of the inclined panel 1, via adhesive 20 received in a void 21 defined between the bonded faces owing to spacers 14 of the connector 10S arranged at lateral ends/edges of the inclined flange 15S. The connector 10S additionally comprises a further flange 15S' projecting downwardly so as to overlap the end of the horizontal panel 1 (and the flange portion 15R received against the end face 5 of that horizontal panel). Spacers 14 are arranged at proximal and distal ends of the flange 15S' whereby defined between adjacent faces of the flange 15S' and upper flange portion 15R is a void 21 which contains adhesive 20 bonding those faces together. The connector 10S additionally comprises a further flange portion 15S" which projects laterally inwardly from an upper end/edge of flange portion 15S' so as to be received against the upper skin 4 of the horizontal panel. The flange portion 15S" is configured at laterally inner and outer ends/edges thereof with spacers 14 whereby defined between the lower face of the flange portion 15S' and the upper face of the horizontal panel upper skin 4 is a void 21 which contains adhesive bonding those faces together. The connector 10S also comprises a brace portion via which the upper/laterally inner distal end/edge of inclined flange 15S is supported by the flange portion 15S" and thus the horizontal panel 1 against which that flange portion is received. In this particular example, the brace is defined by a web portion 11S extending between the laterally inner end of flange portion 15S" and the laterally inner/upper end/edge of flange portion 15S. The connector 10S includes a further web portion 11S' extending downwardly from the laterally outer end/edge of flange 15S to the laterally outer end/edge of portion 15S". The web portions 11S and 11S' and flange/web portions 15S and 15S" define a wedge complementary to the convergent void defined by the roof panel lower face and ceiling panel upper face, which wedge is hollow and thus, advantageously, made of less material than if it were solid. The connector 10S is the same as the connector 10K except that it includes web portion 11S' such that inclined roof panel 1 will be spaced further from the wall panel than in the arrangement shown in FIG. 12.

After effecting the connection, comprising panels 1', 1/50 and connectors 10R and 10S, the connector 10S (particularly the portions 15S and 15S" thereof), panel 1/50 and connector 10R (particularly the portion 11R thereof) are drilled such that there is formed therethrough a passage 8 a lower end of which coincides with an upper end of a cavity 7, the passage 8 thus providing access between the exterior of the assembly and that cavity. Without departure from the invention, the hole(s) formed in the portions 15S and 15S" and/or the portion 11R could instead be preformed, e.g. drilled or punched, possibly expediting installation. Also without departure from the invention, the hole(s) formed in the panel 1/50 could be predrilled, likewise possibly expediting installation. The holes may be formed at spaced positions along the length of the connector 10S, e.g. at 300 mm centres, whereby it can be ensured that alignment of one of them with a given cavity will require adjusting the relative positions of the connector and panel by no more than 150 mm.

Installation of service lines 9 (such as electrical cabling, pipework, etc) is, prior to installation of the roof panel, carried out by training the service line(s) through the passage 8 and into the cavity or void 7. At the appropriate vertical position at which an access point for the service(s) in question is to be provided, an access hole 8A is drilled, through one of the faces/skins 4 of panel 1' and core material, which hole provides access to the cavity or void 7 and the service line(s) therein. Typically, the access hole will be through the inner face/skin 4 of the panel 1', and thus between the space 400 surrounded by panels 1/50 and 1' (which will typically comprise an interior space, such as a room space, in the building), though it may be through the outer face/skin 4 of the panel 1' and thus between the space at the exterior side of the panel 1' (which will typically comprise an outdoor space).

The end of the/each service line trained through passages 8 and 7 is drawn through the access hole 8A and a fitting 9A applied/mounted to the side of the panel 1' through which the access hole is formed and connected to the/each line end. A given service line 9 and fitting 9A secured thereto will typically comprise any of a mains power cable and socket/switch fitting therefor, an electrical cable to power a utility (e.g. light, air conditioner, ceiling fan, etc), e.g. in/adjacent the space, and a switch/adjustor fitting to operate that utility, a water pipe and tap therefor, and a gas pipe and socket fitting.

In the event that the panel includes the conduit(s) and the space within a given cavity is to be accessed through either side of the panel, by penetration—e.g. by machining (preferably drilling)—the conduit side wall will be additionally penetrated.

Installation of a given service line, or a section thereof which extends through and/or is defined by a given cavity 7, may instead precede installation of the panel 1' without departure from the invention.

In the example described with reference to the drawings, the installation is such that the panel 1', through which the/each service is provided, is a wall panel and the/each service line passes through a ceiling panel supported over that wall panel (and also a connector via which the two panels are connected). However, in other examples embodying the invention the panel 1' can instead be, for example, a ceiling panel (e.g. in the case were the service line is to supply power to a light to be mounted to that panel) or floor panel, and/or the/each service line can instead pass through another component of the building adjacent to the panel 1' (e.g. another wall panel or a floor panel). Also, where the service line is to pass through a component adjacent the panel 1' (such a component comprising the ceiling panel in the described example), that component can instead be, for example, another wall panel adjacent the panel 1', or a floor panel over which the panel 1' is supported.

Figure 27:
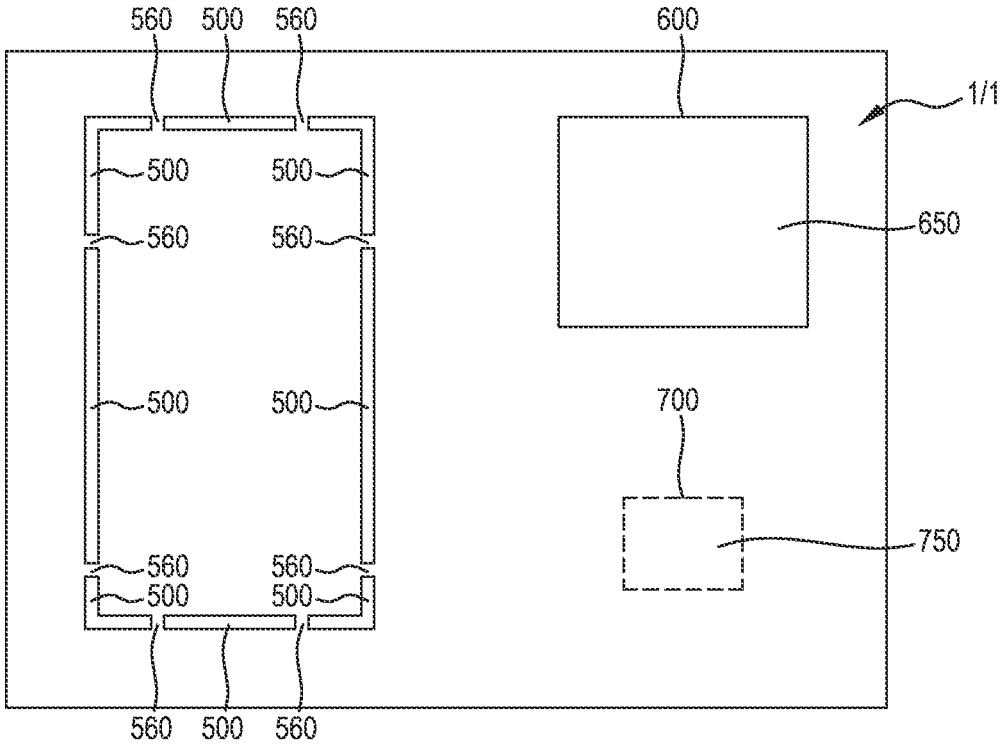
FIG. 27 shows a panel formed with cutouts defining removable portions such that removal thereof creates door, window and fitting penetrations in the panel.

Referring to FIG. 27, the panel 1 or 1', in particular where it serves as a wall panel, is or can be:

a prefabricated panel configured with at least one cutout 500, 600, 700 defining one or more portions 550, 650, 750 of the prefabricated panel which is/are removable such that one or more penetration(s) (not shown) is/are formed; or is formed by removal of the removable portion(s).

The cutout(s) may be machined, e.g. using a CNC router. The extent of the cutout(s) is that most (preferably over 90%) of the perimeter of the/each removable portion is defined by such cutouts (particularly cutouts 500), the remaining interconnection(s) 560 between that portion and the panel which is to result from the removal constituting one or more bridging portions frangible or breakable to permit the removal. The/each removable portion is thus a pop-out portion.

The cutout(s) is/are such that the one or more penetrations can be, for example, any one or more of a door penetration (which, in the example shown, would result from removal of portion 550); a window penetration (which, in the example shown, would result from removal of portion 650); and a penetration for a fitting (which, in the example shown, would result from removal of portion 750).

The cutout(s) can be formed, as the cutout 600 is in the example shown, such that friction and/or an interference fit between said panel configured with at least one penetration and the, each or at least one said removable portion holds the latter to the former. The cutouts may, as the cutouts 700 do in the example shown, define a regularly perforated configuration around the entirety of the perimeter of the removal portion (portion 750 in the example shown).

Advantageously, owing to the configuration of panel 1' (and in particular the/each void 7 utilised therein), the sheltering of that interior space provided by the panel 1/50, and the water-resistant/waterproof interconnection between the panels 1' and 1/50, comprising connectors 10R and 10S and adhesive 20, the interior space is isolated from the elements (wind, rain etc.) prior to installation of the roof panel, whereby the installation of the services in advance of the installation of the roof panel is rendered feasible (and is considerably easier than if the roof is installed beforehand as in conventional building). Because each cavity 7 is preformed, there is no need during construction to drill or core out the core 3 of the wall panel to form it.

The interior space, prior to application of the roof panel, is not only satisfactorily sheltered/isolated from the elements but also can be inaccessible by vandals or thieves—i.e. "lock-up" in respect of that interior space (if not of the whole building) is achieved prior to installation of the roof.

The provision of voids 7 at spaced positions along the panel 1' affords that panel versatility, in that an appropriate one/group of the voids 7 to receive the service line(s) may vary according to the particular configuration/requirement of the building concerned, without the structural capability of the panel 1' being compromised.

Although each of the connectors described herein with reference to the drawings is separately formed from the panel(s) to which it is to be secured, a variant thereof, in accordance with an alternative embodiment of the invention, can be integrally formed with a said panel (whereby the connector is connected to that panel)—in which case securing of the connector between the panel and said component may consist solely of connecting/securing the connector to said component. In particular, the connector can be integrally formed with a said/each skin or covering of the panel.

It will be clear from the foregoing that preferred embodiments of the invention provide structural insulated panels (SIPs) and sandwich panels, including finished such panels, and means of manufacturing, interconnecting, and building with, same.

Throughout this specification, including the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

While various embodiments of the present invention have been described above, it should be understood that they have been presented by way of example only, and not by way of limitation. It will be apparent to a person skilled in the relevant art that various changes in form and detail can be made therein without departing from the spirit and scope of the invention. Thus, the present invention should not be limited by any of the above described exemplary embodiments.

The invention claimed is:

1. A method of constructing a building, the method comprising:

installing a wall structure of the building, the wall structure comprising a wall panel having opposed skins and a core within which extends at least one cavity, and a ceiling structure of the building, the ceiling structure comprising a ceiling panel, such that the ceiling structure is adjacent the wall structure, and the wall and ceiling structures bound a space, at a side and a top, respectively, of the space, and such that the space is sheltered and/or in a locked-up state;

after said installing the wall structure and the ceiling structure step, installing at least one service line through the at least one cavity of said wall panel and/or installing at least one service line which comprises the at least one cavity of said wall panel; and after said installing the at least one service line step, installing a roof structure of the building over the ceiling structure, wherein a connector is secured between the wall structure and the ceiling structure to form therebetween a connection which is such that the connector engages both the ceiling panel and at least one of the skins of the wall panel so as to direct, to at least one skin engaged thereby, loading exerted by the ceiling structure, wherein the at least one cavity is accessed through at least one opening defined by said ceiling panel to install the at least one service line.

2. The method of claim 1, wherein a top plate is defined by the connector that secures the wall structure to the ceiling structure.

3. The method of claim 1, wherein at least one external opening into the at least one cavity is formed, and wherein the installing of the at least one said service line is such that a service to be provided thereby is provided through at least one external opening.

4. A building constructed by the method of claim 1.

5. The method of claim 1, wherein the access to the at least one cavity is through at least one passage comprising a said opening, a lower end of the passage coinciding with an upper end of the cavity.

6. The method of claim 1, wherein the at least one cavity is accessed through at least one opening through said connector between the wall panel and the ceiling panel to install the at least one service line.

7. The method of claim 6, wherein the at least one opening through said connector comprises a plurality of holes preformed at spaced positions along a length of the connector to align with respective ones of the at least one cavity.

8. The method of claim 1, wherein the ceiling panel comprises a core and opposed skins.

9. The method of claim 1 comprising:

forming a connection between the ceiling structure and the roof structure by securing a connector between the ceiling panel and the roof structure.

10. The method of claim 9, wherein the connector that is secured between the ceiling structure and the roof structure is secured to the ceiling panel and thereafter secured to the roof structure, wherein the at least one cavity is accessed through that connector, to install the at least one service line, after the securing thereof to the ceiling panel and before the securing thereof to the roof structure.

11. The method of claim 9, wherein the roof structure comprises a roof panel, and the connector that is secured between the ceiling panel and the roof structure is secured to the roof panel.

12. The method of claim 1, wherein securing the connector between the wall structure and the ceiling structure comprises bonding a portion of the connector between an upper end of the wall panel and a lower side of the ceiling panel.

13. The method of claim 1, wherein securing the connector between the wall structure and the ceiling structure comprises bonding the connector to either or each of the wall panel and the ceiling panel.

14. The method of claim 1 comprising:

attaining said locked-up state prior to installation of the at least one service line.

15. A method of constructing a building including a wall structure and a ceiling structure adjacent the wall structure, the method comprising:

installing a wall structure and a ceiling structure, such that the wall structure bounds a space at a side thereof and the ceiling structure bounds the space at a top thereof, the space defining an interior space in the building, such that the space or interior space is sheltered and/or in a locked-up state;

forming a connection between the wall structure and the ceiling structure, wherein said wall structure comprises a wall panel, the wall panel comprising opposed skins and a core within which extends at least one cavity via which either or each of fluid and power is suppliable through the wall panel, wherein said ceiling structure comprises a ceiling panel, and wherein said forming of the connection comprises securing a connector between the wall panel and the ceiling panel;

installing at least one service line which comprises the at least one cavity of the wall panel and/or installing at least one service line through the at least one cavity of the wall panel, after said installing the wall structure and the ceiling structure step, wherein the at least one cavity is accessed through at least one opening defined by the ceiling panel to install said at least one service line.

16. The method of claim 15 wherein the securing a connector between the wall panel and the ceiling panel is such that the connector engages both the ceiling panel and at least one of the opposed skins of the wall panel so as to direct, to the at least one of the opposed skins engaged thereby, loading exerted by the ceiling structure.

17. The method of claim 15, wherein the at least one cavity is accessed through at least one opening defined by said connector between the wall panel and the ceiling panel, to install the at least one service line.

18. The method of claim 17, wherein the at least one opening defined by the connector comprises a plurality of holes preformed at spaced positions along a length of the connector to align with respective ones of the at least one cavity.

19. The method of claim 17, comprising drilling the ceiling panel and the connector such that there is formed the at least one opening defined by the ceiling panel and the at least one opening defined by the connector.

20. The method of claim 15, wherein the ceiling panel comprises a core and opposed skins.

21. The method of claim 15 comprising:

subsequent to installing said at least one service line, installing a roof structure of the building over the ceiling structure, wherein a connection is formed between the ceiling structure and the roof structure.

22. The method of claim 21, wherein the connection between the ceiling structure and the roof structure is formed by securing a connector between the ceiling panel and the roof structure.

23. The method of claim 22, wherein the connector that is secured between the ceiling structure and the roof structure is secured to the ceiling panel and thereafter secured to the roof structure, and the at least one cavity is accessed through the connector, to install the at least one service line, after the securing thereof to the ceiling panel and before the securing thereof to the roof structure.

24. The method of claim 22, wherein the roof structure comprises a roof panel, and the connector that is secured between the ceiling panel and the roof structure is secured to the roof panel.

25. The method of claim 15 comprising:

attaining said locked-up state prior to installation of the at least one service line.

26. A building constructed by the method of claim 15.

27. The method of claim 15, wherein the access to the at least one cavity is through at least one passage comprising a said opening, a lower end of the passage coinciding with an upper end of the cavity.

28. The method of claim 15, wherein a top plate is defined by the connector that secures the wall structure to the ceiling structure.

29. The method of claim 15, wherein at least one external opening into at least one said cavity is formed, and wherein the installing of the at least one service line is such that a service to be provided thereby is provided through at least one external opening.

30. The method of claim 15, wherein said securing the connector between the wall structure and the ceiling structure comprises bonding a portion of the connector between an upper end of the wall panel and a lower side of the ceiling panel.

31. The method of claim 15, wherein said securing the connector between the wall structure and the ceiling structure comprises bonding the connector to either or each of the wall panel and the ceiling panel.

* * * * *